US005576729A

United States Patent [19]

Yamazaki

[11] Patent Number: 5,576,729

[45] Date of Patent: Nov. 19, 1996

[54] LIQUID CRYSTAL DISPLAY DEVICE AND ELECTRONIC EQUIPMENT USING THE SAME

[75] Inventor: Katsunori Yamazaki, Suwa, Japan

[73] Assignee: Seiko Epson Corporation, Tokyo, Japan

[21] Appl. No.: 170,355

[22] PCT Filed: May 14, 1993

[86] PCT No.: PCT/JP93/00639

§ 371 Date: Jan. 3, 1994

§ 102(e) Date: Jan. 3, 1994

[87] PCT Pub. No.: WO93/23845

PCT Pub. Date: Nov. 25, 1993

[30] Foreign Application Priority Data

May 14, 1992 [JP] Japan ..... 4-122141
Sep. 10, 1992 [JP] Japan ..... 4-242227

[51] Int. Cl.[6] ..... G09G 3/36

[52] U.S. Cl. ..... 345/94; 345/96; 345/208

[58] Field of Search ..... 345/87, 90, 94, 345/96, 208

[56] References Cited

U.S. PATENT DOCUMENTS 5,117,298 5/1992 Hirai ..... 345/96
5,184,118 2/1993 Yamazaki ..... 345/96
5,270,697 12/1993 Takeda ..... 345/96

FOREIGN PATENT DOCUMENTS 0295802 12/1988 European Pat. Off. .
0303510 2/1989 European Pat. Off. .
0424030 4/1991 European Pat. Off. .
60-19195 1/1985 Japan .
62-31825 2/1987 Japan .
62-56937 3/1987 Japan .
62-157010 7/1987 Japan .
2-89 1/1990 Japan .
4050919 2/1992 Japan .
5-46127 2/1993 Japan .
2159314 11/1985 United Kingdom .
92/21122 11/1992 WIPO .

*Primary Examiner*—Mark R. Powell
*Assistant Examiner*—Matthew Luu
*Attorney, Agent, or Firm*—Oliff & Berridge

[57] ABSTRACT

A liquid crystal display device has a liquid crystal display panel with a given number of scanning electrodes and signal electrodes, an X driver which applies signal voltages, including on-voltages or off-voltages, to the signal electrodes, a Y driver which applies scanning voltages, including sections voltages or non-selection voltages, to the scanning electrodes, a power supply circuit which applies given voltages to the X driver and the Y driver, and a polarity inversion control circuit which inverts the polarity of the on-voltage and the like applied to the liquid crystal display panel from the X driver and the Y driver as appropriate. The polarity inversion control circuit switches the polarity of the signal voltages and scanning voltages applied to the liquid crystal display panel in response to the pattern of characters and figures displayed on the liquid crystal panel and makes it possible to minimize charging and discharging of capacitors formed by the pixels.

17 Claims, 25 Drawing Sheets

FIG. 18

$$
\begin{bmatrix}
-V & -V & -V & 0 & 0 & 0 & 0 & 0 & 0 & \cdots \\
0 & 0 & 0 & -V & -V & -V & 0 & 0 & 0 & \cdots \\
0 & 0 & 0 & 0 & 0 & 0 & -V & -V & -V & \cdots \\
 & \vdots & & & \cdots & & & \cdots & & \\
 & \vdots & & & \cdots & & & \cdots & & \\
-V & -V & +V & & \cdots & & & \cdots & & \\
 & \vdots & & & \cdots & & & \cdots & & \\
 & \vdots & & & \cdots & & & \cdots & & \\
-V & +V & +V & & \cdots & & & \cdots & & \\
 & \vdots & & & \cdots & & & \cdots & & \\
 & \vdots & & & \cdots & & & \cdots & & \\
-V & +V & -V & & \cdots & & & \cdots & & \\
 & \vdots & & & \cdots & & & \cdots & & \\
 & \vdots & & & \cdots & & & \cdots & &
\end{bmatrix}
$$

FIG. 21

$$\begin{bmatrix} -V & +V & 0 & 0 & 0 & 0 \\ 0 & 0 & -V & +V & 0 & 0 \\ 0 & 0 & 0 & 0 & -V & +V \\ +V & -V & 0 & 0 & 0 & 0 \\ 0 & 0 & +V & -V & 0 & 0 \\ 0 & 0 & 0 & 0 & +V & -V \end{bmatrix}$$

LIQUID CRYSTAL DISPLAY DEVICE AND ELECTRONIC EQUIPMENT USING THE SAME

This application is a 371 PCT/JP 93/00639 filed May 14, 1993 and published as WO93/23845 Nov. 25, 1993.

FIELD OF THE INVENTION

The present invention relates to liquid crystal display devices and electronic equipment using the same for displaying characters, figures and the like on a liquid crystal display panel by means of passive-matrix addressing.

BACKGROUND OF THE INVENTION

The driving method known as amplitude selective addressing has been conventionally used to drive passive-matrix display devices. The 6-level driving method is most commonly used of the methods categorized as amplitude selective addressing. An example of the 6-level driving method is given in Japanese Patent Application Laid-open No. Hei2-89. The 6-level driving method will now be explained with reference to FIGS. 23 through 25C.

FIG. 23 shows the configuration and display components of a liquid crystal display panel. The figure shows a liquid crystal display panel 300 comprising a liquid crystal layer (not shown) and a pair of substrates 302 and 304, sandwiching the liquid crystal layer. Scanning electrodes Y1–Y6 are formed horizontally within substrate 302. The other substrate 304 contains signal electrodes X1–X6. Pixels are formed at intersections between scanning electrodes Y1–Y6 and signal electrodes X1–X6. In FIG. 23, on-status pixels are shown with hatching, and off-status pixels are shown without hatching.

The liquid crystal display panel 300 shown in FIG. 23 has only 6×6 pixels in order to simplify the explanation. The number of pixels in liquid crystal display panels in actual use will normally be far greater than this.

Either a selection voltage or non-selection voltage is applied in sequential order to each of the scanning electrodes Y1 to Y6. The period required to apply the selection voltage once to each of the scanning electrodes Y1–Y6 is called one frame.

At the same time as when either a selection voltage or non-selection voltage is applied to each of the scanning electrodes Y1–YG, either an on-voltage or off-voltage is applied to each of the signal electrodes X1–X6. That is, in order to turn on a pixel at an intersection between a scanning electrode and a signal electrode, an on-voltage is applied to the signal electrode when the scanning electrode is selected. In order not to turn on the pixel, an off-voltage is applied to the signal electrode when the scanning electrode is selected.

FIGS. 24A, 24B, 240, and FIGS. 25A, 25B, 25C show examples of driving voltage (applied voltage) waveforms.

FIGS. 24A, 24B, and 24C respectively show a signal voltage waveform applied to signal electrode X5, a scanning voltage waveform applied to scanning electrode Y3, and a voltage waveform applied to a pixel (on-status) at the intersection between signal electrode X5 and scanning electrode Y3.

Also, FIGS. 25A, 25B, and 25C respectively show a signal voltage waveform applied to signal electrode X5, a scanning voltage waveform applied to scanning electrode Y4, and a voltage waveform applied to a pixel (off-status) at the intersection between signal electrode X5 and scanning electrode Y4.

In FIGS. 24A, 24B, 24C, 25A, 25B, and 250, both F1 and F2 indicate one frame.

In the frame F1, selection voltage=V0, non-selection voltage=V4 on-voltage=V5, off-voltage=V3 in the frame F2, selection voltage=V5, non-selection voltage=V1 on-voltage=V0, off-voltage=V2 where,

V0–V1=V1–V2=V

V3–V4=V4–V5=V

V0–V5=k.V (k; positive number).

Thus the system is AC driven, through the polarity being inverted between frame F1, and frame F2.

Also, a 6-level driving method whereby the polarity is periodically switched in intervals other than those corresponding to frames F1 and F2 is disclosed in Japanese Patent Application Laid-open No. Sho62-31825.

An alternative to the 6-level driving method is the so called IHAT method. This method, proposed by T. N. Ruckmongathan, makes driving at low voltages possible and enables display uniformity to be achieved (1988 International Display Research Conference). In this driving method, N lines of line electrodes are bundled to p (p=N/M) groups of subgroups, each of which consists of M lines of line electrodes selected together. This method is disclosed in Japanese Patent Application Laid-open No. Hei5-46127.

Incidentally, driving a liquid crystal display panel by such methods as the aforementioned 6-level driving method and the IHAT method may require significant power consumption depending on the pattern of characters, figures, and the like displayed by the panel.

For example, consider scanning electrode Y1 in the liquid crystal display panel 300 shown in FIG. 23. If the scanning electrode Y1 is not selected during a frame period F1, non-selection voltage V4 is applied to the scanning electrode Y1. As the scanning electrode that will have a selection voltage applied shifts from Y2 through to Y6 (hereafter, "the selected scanning electrode"), on-voltage V5 and off-voltage V3 will be applied alternately and repeatedly to signal electrodes X1–X4, and X6. Therefore, in the period when scanning electrode Y1 is not selected, voltages –V and +V will be applied alternately to each pixel at the intersections of scanning electrode Y1 and signal electrodes X1–X4, and X6.

In addition, because the scanning electrodes Y1–Y6, and signal electrodes X1–X4, X6 have a set width, and the liquid crystal layer between them acts as a dielectric, each pixel is electrically equivalent to a capacitor. Therefore, the aforementioned alternating voltage will be applied to these capacitors, which results in power being consumed by the power supply circuit driving the liquid crystal display panel 300.

An increase in power consumption will not only be observed when pixels repeatedly alternate between on-status and off-status during a frame period, but also whenever the polarity is changed in a frame.

Also, any methods which utilize conventional amplitude selective addressing may generate display unevenness depending on the patterns of characters and figures displayed on the liquid crystal display panel, as well as the aforementioned possible increase in power consumption. The IHAT method does improve the situation somewhat, though it does not completely eliminate display unevenness regardless of the patterns displayed.

In short, when the liquid crystal display panel 300 is driven by an amplitude selective addressing scheme, the voltage waveforms applied to pixels are not as ideal as the rectangular waves shown in FIGS. 24A through 25C. The first reason for this is the capacitance of each pixel, which is determined by the area of the pixel, the thickness of the liquid crystal layer, and the dielectric constant of the liquid crystal material. The second reason for this is that both the scanning and signal electrodes are made of transparent conductor films, which naturally have a certain level of electric resistance, generally with a sheet resistance of the order of dozens of ohms.

For these reasons therefore, even if an ideal rectangular waveform voltage as shown by FIGS. 24A through 25C is applied to the liquid crystal display panel 300, the actual voltage waveform applied to each pixel will be distorted somewhat. As a result, the effective voltage of the waveform applied to the pixels will vary, thus causing contrast unevenness.

This problem has been known for some time, and driving methods other than that disclosed in the aforementioned Japanese Patent Application Laid-open No. Sho62-31825 are disclosed in Japanese Patent Application Laid-open Nos. Sho60-19196 and Hei2-89.

In light of the problems inherent in conventional technologies, the present invention has been devised to provide a liquid crystal display panel driving method, a liquid crystal display device and electronic equipment using the same characterized by low power consumption and suppressed display unevenness.

DISCLOSURE OF THE INVENTION

The present invention provides liquid crystal display device comprising:

a liquid crystal display panel having a liquid crystal layer sandwiched by a plurality of scanning electrodes and a plurality of signal electrodes;

a first voltage applying means which applies a scanning voltage consisting of selection and non-selection voltages to a plurality of scanning electrodes of said liquid crystal display panel;

a second voltage applying means which applies a signal voltage consisting of on-voltage and off-voltage to a plurality of signal electrodes of said liquid crystal display panel;

a polarity inversion control means, connected to said first voltage applying means and said second voltage applying means, to control the polarity inversion of the driving voltage, which is the potential difference between said scanning electrode and said signal electrode, corresponding to the on/off-status of each pixel of said liquid crystal display panel; and, said liquid crystal display panel driven by an AC driver.

In this liquid crystal display device, the polarity of the driving voltage is inverted corresponding to the on/off-status of each pixel of a liquid crystal display panel. This limits the power consumption increase and display unevenness which can be generated by certain display patterns.

Also, preferably, it is a characteristic of said polarity inversion control means that it acquires the amount of electric charge to move across the capacitors formed by the pixels both when the polarity of said driving voltage is inverted and when it is not, as said scanning electrodes to which have been applied the selection voltage by said first voltage applying means are switched, and that said polarity inversion control means inverts the polarity of said driving voltage if said amount of electric charge to move is smaller when the polarity of said driving voltage is inverted.

By this means of control, the charging and discharging of capacitors formed by the pixels is reduced, which will lower the power consumption required to drive the liquid crystal display panel.

Also, preferably, it is a characteristic of said polarity inversion control means that it acquires the number of said signal electrodes which have their pixel on/off-status altered as said scanning electrodes which will have selection voltage applied by said first voltage applying means are switched, and that it ascertains the amount of said electric charge to move by comparing whether said number is smaller or larger than a given number.

Judging the amount of electric charge moving across the capacitors in this way, facilitates the decision as to whether or not to invert the polarity, which more easily enables a reduction in power consumption to be obtained.

Also, it is more preferable, for said given number to be approximately one half of the total number of said signal electrodes.

Accordingly, the amount of charge to move when the driving voltage polarity is inverted can be compared under almost the same conditions with that when the driving voltage polarity is not inverted, which will virtually guarantee a reduction in power consumption.

Also, it is more preferable, for said given number to be more than one half the total number of said signal electrodes.

In this way, even though the amount of charge to move when the driving voltage polarity is inverted is not compared under exactly the same conditions as when the driving voltage polarity is not inverted, the value to be compared can be reduced in magnitude, which will enable a simpler liquid crystal display device to be constructed.

Also, it is further preferable, that said given number be determined taking into account the capacitance created by the pixels on the scanning electrodes between said scanning electrodes and said signal electrodes when said scanning electrodes to have selection voltage applied by said first voltage applying means are switched.

This will also enable the capacitance created by the selected scanning electrodes to be taken into account. Together with the accurate control of polarity inversion, it will assure a reduction in power consumption.

Also, it is further preferable, that said given number be determined taking into account the capacitance contained in a power supply circuit which generates said scanning voltage and said signal voltage.

This will assure a reduction in power consumption.

Also, it is further preferable that said polarity inversion control means will acquire a sum of changes of voltages of the signal electrodes measured from said non-selection voltage both when polarity of said driving voltage is inverted as said scanning electrodes are switched which electrodes have the selection voltage applied by said 1st voltage applying means, and when the polarity of said driving voltage is not inverted, and that said polarity inversion control means will invert the polarity of said driving voltage, only if said total voltage change is smaller when the polarity of said driving voltage is inverted.

Through such control, the total voltage change of the signal electrodes can be reduced, which will reduce display unevenness caused by voltage variations.

Also, it is further preferable that said polarity inversion control means incorporates a control which inverts the polarity of said driving voltage corresponding to the on/off-status of each pixel of said liquid crystal display panel, and a control which inverts the polarity of said driving voltage at a given regular intervals regardless of the on/off-status of each pixel of said liquid crystal display panel.

This will serve to prevent the driving frequency of the liquid crystal display panel being abnormally low, and hence prevents display unevenness due to reduced contrast.

Also, it is further preferable that said polarity inversion control means limits the number of said polarity inversions. A further characteristic of the said polarity inversion control means is that it changes the frequency of polarity inversions in accordance with the number of times the conditions to invert polarity are satisfied in a given period of time. These strategies will prevent the driving frequency of the liquid crystal display panels from being abnormally high, and thereby reduce display unevenness.

Also, electronic equipment using the liquid crystal display device of the present invention will be characterized as comprising,

- a liquid crystal display panel having a liquid crystal layer sandwiched by a plurality of scanning electrodes and a plurality of signal electrodes;
- a first voltage applying means which applies a scanning voltage consisting of selection and non-selection voltages to the plurality of scanning electrodes of said liquid crystal display panel;
- a second voltage applying means which applies a signal voltage consisting of on-voltage and off-voltage to a plurality of signal electrodes of said liquid crystal display panel;
- a polarity inversion means, connected to said first voltage applying means and said second voltage applying means, to control the polarity inversion of the driving voltage, which is the potential difference between said scanning electrode and said signal electrode, corresponding to the on/off-status of each pixel of said liquid crystal display panel;
- and that images are displayed on said liquid crystal display.

Also, it is further preferable, that said polarity inversion control means acquires the amount of electric charge to move across the capacitors formed by the pixels, as said scanning electrodes, which will have selection voltage applied by said first voltage applying means, are switched, both when the polarity of said driving voltage is changed and when the same is not changed, and that said polarity inversion control means inverts the polarity of said driving voltage if said amount of charge to move is smaller when the polarity of said driving voltage is changed.

Also, further preferably, it is a characteristic that said polarity inversion means will acquire the total voltage change of the signal electrode from said non-selection voltage for both when polarity of said driving voltage is inverted and when the same is not inverted, when said scanning electrodes have the selection voltage applied by said first voltage applying means, and that said polarity inversion control means inverts the polarity of said driving voltage only if said total voltage change is smaller when the polarity of said driving voltage is inverted, In such electronic equipment, the polarity of the driving voltage is inverted in accordance with the images displayed on the liquid crystal display panel, thereby reducing power consumption and suppressing the occurrence of display unevenness.

BRIEF DESCRIPTION OF THE DRAWINGS

FIG. 18 is a matrix diagram showing a combination of selection voltages for L=3.

FIG. 21 is a matrix diagram showing a combination of selection voltages for L=2.

BEST FORMS TO EMBODY THE PRESENT INVENTION

Preferred embodiments of the present invention will now be explained in detail with reference to the figures.

FIRST EMBODIMENT

It is a characteristic that a liquid crystal display device according to the first embodiment inverts the polarity of the driving voltage applied to the liquid crystal display panel, in accordance with the patterns of characters and figures displayed by the liquid crystal display panel. Such polarity inversion makes it possible to reduce the power consumption of a liquid crystal display panel.

The liquid crystal display device according to the present embodiment uses a 6-level driving method, which comprises the six different voltages V0–V5 defined as follows.

first voltage group (corresponds to frame period F1 of conventional 6-level driving method)

first scanning voltage:
selection voltage=V0
non-selection voltage=V4 first signal voltage:
on-voltage=V5
off-voltage=V3 second voltage group (corresponds to frame period F2 of conventional 6-level driving method)

second scanning voltage:
selection voltage=V5
non-selection voltage=V1 second signal voltage:
on-voltage=V0
off-voltage=V2 where

V0–V1=V1–V2=V

V3–V4=V4–V5=V

V0–V5=k·V (k; positive number)

Figure 1:
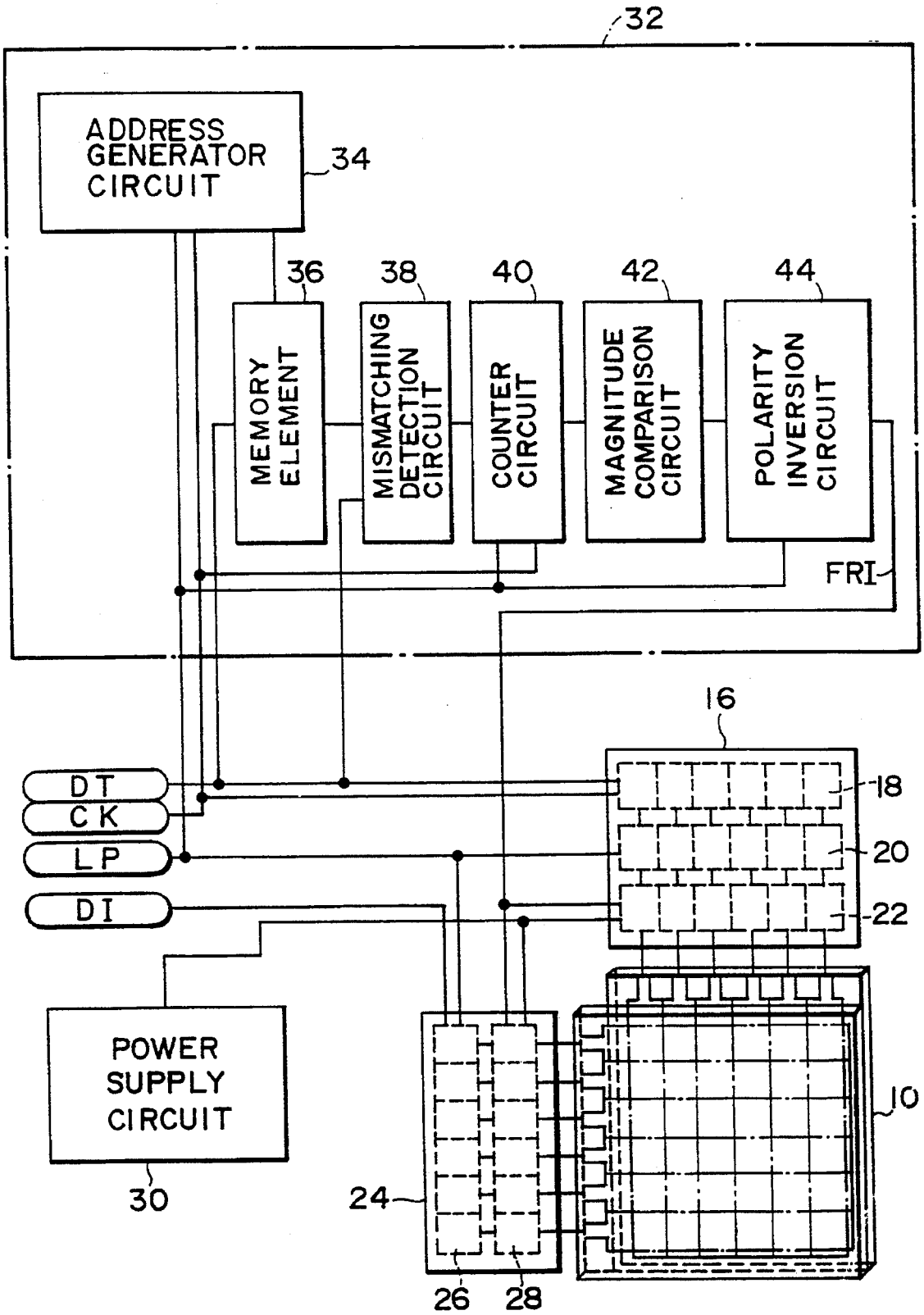
FIG. 1 is a diagram showing the configuration of the liquid crystal display device according to the first embodiment of the present invention.

FIG. 1 is a diagram showing the configuration of the liquid crystal display device according to the first embodiment of the present invention. It is characteristic that through the presence of the polarity inversion control circuit 32, the liquid crystal display device is AC driven, which inverts the polarity of the driving voltage applied to the liquid crystal display panel 10 in accordance with the patterns of characters and figures displayed by the liquid crystal display panel 10. This polarity inversion makes it possible to reduce power consumption by the power supply circuit 30 which supplies the driving voltage to the liquid crystal display panel 10.

The liquid crystal display device shown in FIG. 1 comprises liquid crystal display panel 10 having a given number of scanning electrodes and signal electrodes, X driver 16 which applies an on-voltage or off-voltage to the signal electrodes, Y driver 24 which applies a selection voltage or non-selection voltage to the scanning electrodes, power supply circuit 30 which applies a given voltage to X driver 16 and Y driver 24, and polarity inversion control circuit 32 which appropriately inverts the on-voltage and the like applied to liquid crystal display panel 10 from X driver 16 and Y driver 24. The first voltage applying means corresponds to the X driver 16 and the power supply circuit 30. The second voltage applying means corresponds to the Y driver 24 and the power supply circuit 30.

Figure 2:
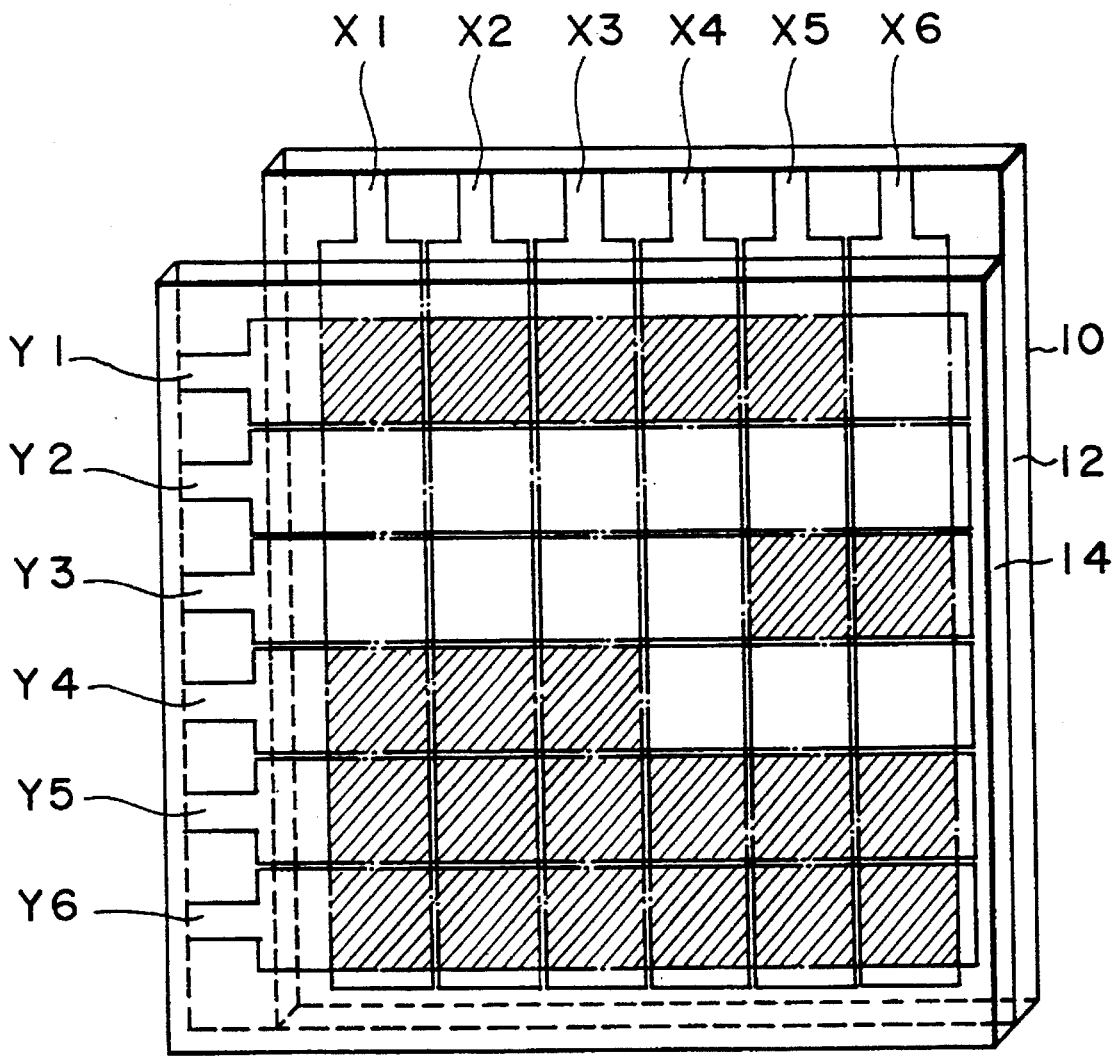
FIG. 2 is a diagram showing the configuration of the liquid crystal display panel used in the first embodiment.

FIG. 2 shows configuration of the liquid crystal display panel 10 mentioned above. As shown in the figure, the liquid crystal display panel 10 comprises a pair of substrates 12, 14 sandwiching the liquid crystal layer not shown. Six signal electrodes X1–X6 are arranged on the substrate 12. Six scanning electrodes Y1–Y6 are arranged on the substrate 14. At the intersections of scanning electrodes Y1–Y6 and signal electrodes X1–X6, pixels are formed, thus constituting the display.

In FIG. 2, the pixels masked with hatching indicate that the pixel is in on-status, and other pixels without hatching indicate that they are in off-status. Liquid crystal display panel 10 consisting of only 6×6=36 pixels is given here as an example. This small number of pixels serves only to simplify the explanation. In actuality, the panel would normally consist of many more pixels.

The X driver 16 shown in FIG. 1 applies an on-voltage or off-voltage to each signal electrode X1–X6 of the liquid crystal display panel 10. The X driver 16 comprises a shift register circuit 18, a latch circuit 20, and a level shifter circuit 22.

The shift register circuit 18 converts six sequentially input one bit data to a six bit parallel data, and outputs it. The latch circuit 20, which has six bit capacity similar to the parallel data, temporarily holds the six bit data output from the shift register circuit 18. The level shifter circuit 22 sets voltage levels corresponding to each bit of the six bit data output from the latch circuit 20, and applies the set voltage to each signal electrode of liquid crystal display panel 10 either as an on-voltage or as an off-voltage.

Figure 3A:
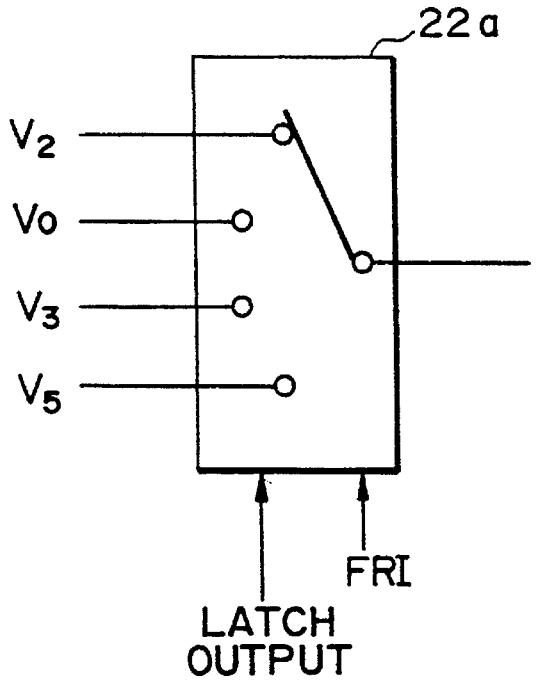
FIGS. 3A and 3B are diagrams showing details of typical level shifter circuits.
Figure 3B:
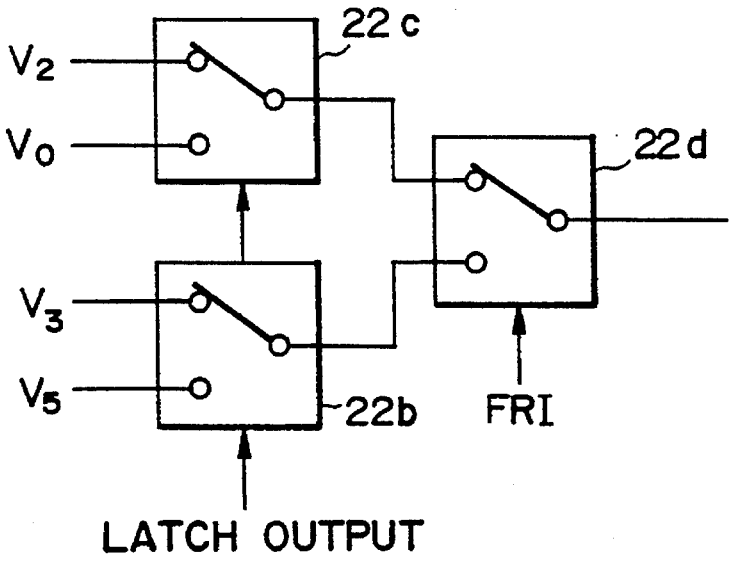

FIGS. 3A and 3B are diagrams showing the detailed structure of an example of level shifter circuit 22. FIG. 3A shows an example of a level shifter circuit 22 comprising a four input one output multiplexer 22*a*. The number of mutiplexers 22*a* installed in the level shifter circuit 22 corresponds to the number of signal electrodes. The multiplexer 22*a*, which has four input terminals with applied voltages V2, V0, V3, and V5, performs the switching operation based on the output of the latch circuit 20 and the polarity inversion signal FRI such that one of the input voltages appears at its output terminal. Specifically, when the polarity inversion signal FRI is logical "1", the first signal voltage will be selected, and either on-voltage V5 or off-voltage V3 will be selected in accordance with the output of latch circuit 20. On the other hand, when the polarity inversion signal FRI is logical "0", the second signal voltage will be selected, and either on-voltage V0 or off-voltage V2 will be selected in accordance with the output of latch circuit 20.

FIG. 3B shows an example of a level shifter circuit 22 comprising three, two input one output multiplexers 22*b*, 22*c*, and 22*d*. The number of each type of multiplexers 22*b*, 22*c*, and 22*d* installed in the level shifter circuit 22 corresponds to the number of signal electrodes. The multiplexer 22*b* has two input terminals: one receiving the first signal voltage or on-voltage V5, the other receiving off-voltage V3, and selects either of the voltages in accordance with the output of the latch circuit 20. The mutiplexer 22*c* has two input terminals: one receiving the second signal voltage or on-voltage V0, and the other receiving off-voltage V2, and selects either of the voltages in accordance with the output of the latch circuit 20. The multiplexer 22*d* has two input terminals receiving the two voltages selected by multiplexers 22*b* and 22*c* respectively. Also, it selects the first signal voltage applied via multiplexer 22*c* when the polarity inversion signal FRI is logic "1", and selects the second signal voltage applied via mutiplexer 22*d* when the polarity inversion signal FR is logic "0".

The Y driver 24 applies either a selection voltage or non-selection voltage to each of the scanning electrodes Y1–Y6. The Y driver 24 comprises a shift register circuit 26 and a level shifter circuit 28.

The shift register circuit 26 shifts data-in signal DI inputted once a frame in a synchronized manner with latch pulse LP, and outputs six bit parallel data of which one bit is "1", and others "0". This latch pulse LP is inputted when a scanning electrode is switched, in other words, the latch pulses are inputted in a frame a number of times equal to the number of scanning electrodes.

The level shifter circuit 28 sets voltage levels in accordance with each bit of the six bit parallel data outputted from the shift register 26, and applies the set voltage to each scanning electrode either as a selection voltage or as a non-selection voltage. Since the detailed configuration of the level shifter circuit 28 is basically the same as the level shifter circuit 22 of X driver 16, the configurations given in FIGS. 3A and 3B apply unchanged with the proviso that the first and second signal voltages V5, V3, V0, V2 must be replaced with the first and second scanning voltages V0, V4, V5, V1 as inputs for each input terminal of multiplexers 22*a*, 22*b*, 22*c*.

The power supply circuit 30 generates six different voltages V0–V5 at terminals T0–T5, and applies each of the voltages to X driver 16 and to Y driver 24. Specifically, the power supply circuit 30 applies first and second signal voltages V5, V3, V0, V2 to level shifter circuit 22 in X driver 16, and applies the first and the second scanning voltages V0, V4, V5, V1 to the level shifter circuit 28 in Y driver 24.

The polarity inversion control circuit 32 switches the signal voltages and the scanning voltages applied to the liquid crystal display panel 10 in accordance with patterns of characters and figures displayed by the liquid crystal display panel 10, or more specifically, corresponding to patterns of pixels currently selected and to be selected next. This polarity inversion control circuit 32 comprises an address generator circuit 34, a memory element 36, a mismatch detection circuit 38, a counter circuit 40, a magnitude comparison circuit 42, and a polarity inversion circuit 44.

The address generator circuit 34 is a circuit to generate memory addresses for memory element 36. The address generator circuit 34 can be composed of a counter, which is reset when a latch pulse LP is inputted, then outputs a counted value as an address obtained by performing a counting operation synchronized to clock signal CK inputted after resetting.

The memory element 36, which is constituted by a RAM, has the capacity for storing data DT of six pixels corresponding to one scanning electrode of the display panel 10. The memory element 36 stores the data DT inputted synchronously with the clock signal CK at a location designated by an address outputted from the address generator circuit 34. Also, in parallel with the storage operation (prior to the storage operation to be more precise), the memory element 36 outputs data DT stored at a location designated by an address outputted from the address generator circuit 34. The memory element 36, therefore, outputs scanning electrode data DT one line prior to the current one, and stores currently inputted scanning electrode data DT sequentially.

The mismatch detection circuit 38 detects whether data DT, outputted from the memory element 36, corresponding to a scanning electrode one line prior to the current line is different from the scanning electrode data DT currently inputted. That is, the mismatch detection circuit 38 compares the on/off-status of pixels on a signal electrode at two scanning electrodes.

The counter circuit 40, which counts comparison results of the mismatch detection circuit 38, can, for example, comprise a counter. Comparison results from the mismatch detection circuit 38 are inputted into the enable terminal of the counter comprising the counter circuit 40. The counter counts up synchronously with the clock signal only when the comparison result is a mismatch. The counters are reset when a latch pulse LP is inputted.

The magnitude comparison circuit 42 compares the magnitude of a given value (here, defined as 3, which is half the number of signal electrodes of the liquid crystal display panel 10) with the magnitude of value counted by the counter circuit 40.

The polarity inversion circuit 44 inverts the polarity inversion signal FRI synchronously with latch pulse LP, when it is found that the value counted by the counter circuit 40 is greater than a given value from the comparison result of the magnitude comparison circuit 42. For example, the polarity inversion circuit 44 inverts the polarity inversion signal FRI either from "0" to "1", or from "1" to "0" when the value counted by the counter circuit 40 is greater than a given value. Then the polarity inversion circuit 44 outputs the inversion signal FRI, which is inputted to the level shifter circuit 22 of the X driver 16 and the level shifter circuit 28 of the Y driver 24.

Figure 4:
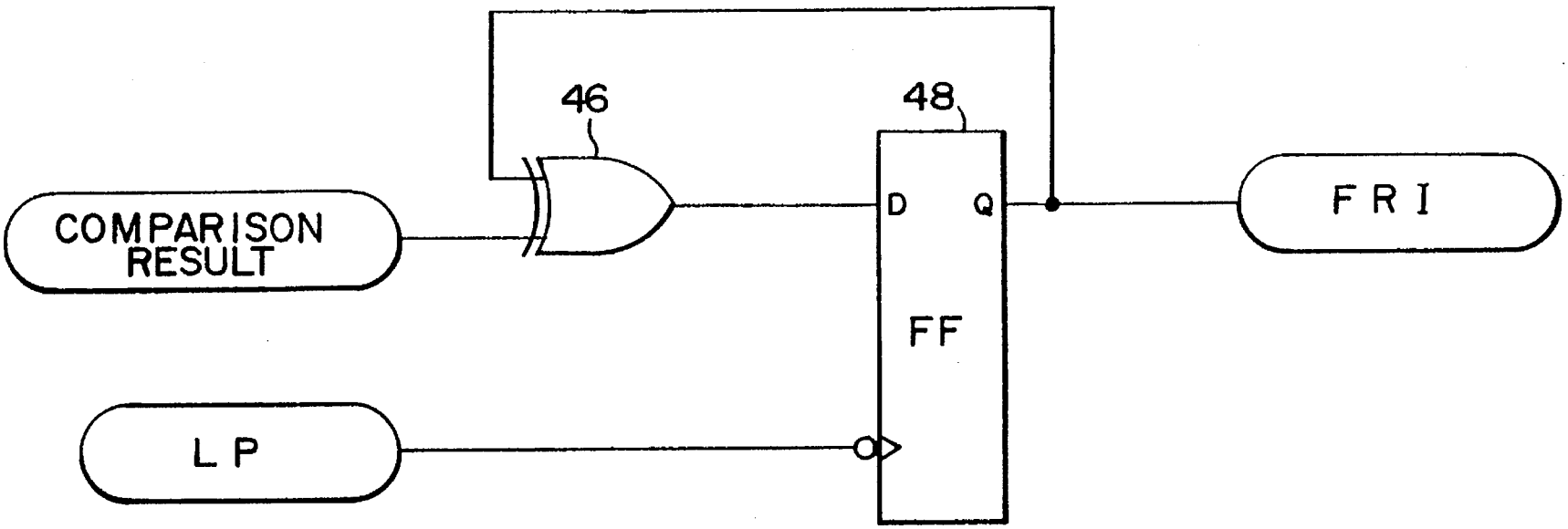
FIG. 4 is a diagram showing details of the polarity inversion circuit according to the first embodiment.

FIG. 4 is a diagram showing the detailed configuration of the polarity inversion circuit 44. As shown in the figure, the polarity inversion circuit 44 comprises an exclusive OR gate (EX-OR) 46 and a D type flip-flop (D-FF) 48.

One of the input terminals of the EX-OR 46 receives a comparison result from the magnitude comparison circuit 42, and the other of the input terminals of the EX-OR gate 46 receives the polarity inversion signal FRI outputted from output terminal Q of the D-FF 48. The output of the EX-OR gate 46 is input into a input terminal D of the D-FF 48. The latch pulse LP is inputted to the clock terminal of the D-FF 48 in negative logic.

Since the polarity inversion circuit 44 has the configuration described above, it changes the polarity inversion signal FRI outputted from the output terminal Q of the D-FF 48 either from "1" to "0", or from "0" to "1" as the latch pulse LP falls when the output of the magnitude comparison circuit 42 is logic "1".

The actual operations of the liquid crystal display device constituted in the foregoing manner are described hereinbelow.

In this embodiment, numbers Na, Nb, Nc, Nd will be defined to determine whether or not to invert the polarity, based on these numbers and the total number S of signal electrodes.

Na is defined as the number of signal electrodes Xn which form on-status pixels with scanning electrodes Yn, and form off-status pixels with scanning electrodes Yn+1 while selected (n+1 is defined as 1 when n=6).

Nb is defined as the number of signal electrodes Xn which form off-status pixels with scanning electrodes Yn, and form on-status pixels with scanning electrodes Yn+1 while selected.

Nc is defined as the number of signal electrodes Xn which form on-status pixels with scanning electrodes Yn, and form on-status pixels with scanning electrodes Yn+1 while selected.

Nd is defined as the number of signal electrodes Xn which form off-status pixels with scanning electrodes Yn, and form off-status pixels with scanning electrodes Yn+1.

Q is defined as the product between the capacitance formed by scanning electrodes excluding Yn and Yn+1 and the signal electrodes; and the voltage difference V between non-selection voltage and on-voltage (or off-voltage). If we let the capacitance be c, then Q=398×c×V. Here, it is assumed that the number of electrodes is 400.

Since both scanning electrodes Y and signal electrodes X have a certain width, and the liquid crystal layer acts as a dielectric, each pixel is electrically equivalent to a capacitor. To give an example, assume that the scanning electrodes and signal electrodes of a liquid crystal display panel 10 are 0.33 mm wide, and they are separated by 5 μm, and the dielectric constant of the liquid crystal is 5 (strictly speaking, it changes with driving conditions, but here, it is treated as a constant for simplicity). The capacitance c of each pixel is therefore;

$$c=5\epsilon_0(0.33\times10^{-3})^2/(5\times10^{-6})\approx1\text{ pF}.$$

Therefore, the value of Q given above will be Q=398×1 pF×V.

This means that if the polarity inversion signal FRI continues to select the first voltage group when the selected scanning electrode shifts from Yn to Yn+1, charge 2NbQ will move from terminal T0 to terminal T1 of the power supply circuit 30, and charge 2NaQ will move from terminal T1 to terminal T2. This movement of charge takes place each time (one selection period) the selected electrode is switched. To give an example, assuming one selection period is 30 μs, and V=1.5 V, then the average current during one selection period will be (Na+Nb)×39.8 μA. This current will be consumed by the power supply circuit 30 in driving the liquid crystal display panel 10.

Similarly, the average current in one selection period will be (Na+Nb)×39.8 μA, if the polarity inversion signal FRI continues to select the second voltage group when the selected scanning electrode shifts from Yn to Yn+1.

Secondly, if the voltage selected, based on the polarity inversion signal FRI, is switched from the second voltage group to the first voltage group when the selected scanning electrode shifts from Yn to Yn+1, charge 2NcQ will move from terminal T0 to terminal T1 of the power supply circuit 30, and charge 2NdQ will move from terminal T1 to terminal T2. The average consumption current would therefore be (Nc+Nd)×39.8 μA.

Similarly, if the voltage selected, based on the polarity inversion signal FRI, is switched from the first voltage group to the second voltage group when the selected scanning electrode shifts from Yn to Yn+1, the average consumption current would be (Nc+Nd)×39.8 μA.

Therefore, at the time when the selected scanning electrode shifts from Yn to Yn+1, if the voltage selected based on the polarity inversion signal FRI changes from the first voltage group to the second voltage group, or from the second voltage group to the first voltage group (i.e. when the polarity inverts), the consumption current will increase as Nc+Nd becomes larger. If the polarity is not inverted, the consumption current will increase as Na+Nb becomes larger.

Here, the total number of signal electrodes S will be given by;

$$S=(Na+Nb)+(Nc+Nd)$$

then, $$(Nc+Nd)=S-(Na+Nb).$$

Therefore, as (Na+Nb) becomes larger, the power consumption increases if the polarity does not invert, and the power consumption decreases if the polarity inverts. If (Na+Nb)=S/2, the power consumption is approximately the same when the polarity inverts and when it does not.

It can be found from the preceding that the current consumption can be reduced by obtaining a number (Na+Nb) of pixels which will change the on/off-status when the scanning electrode is changed from Yn to Yn+1, and by switching voltage groups based on the result of a magnitude comparison between the number (Na+Nb) and S/2. This embodiment focuses on this point. In other words, it provides a liquid crystal display panel driving method which does not invert the polarity if (Na+Nb) is smaller than S/2 as the scanning electrode is switched from Yn to Yn+1, and which inverts the polarity if (Na+Nb) is smaller than S/2 as the scanning electrode is switched from Yn to Yn+1.

An explanation in detail of the operation of the liquid crystal display device shown in FIG. 1 will now be provided.

Figure 5:
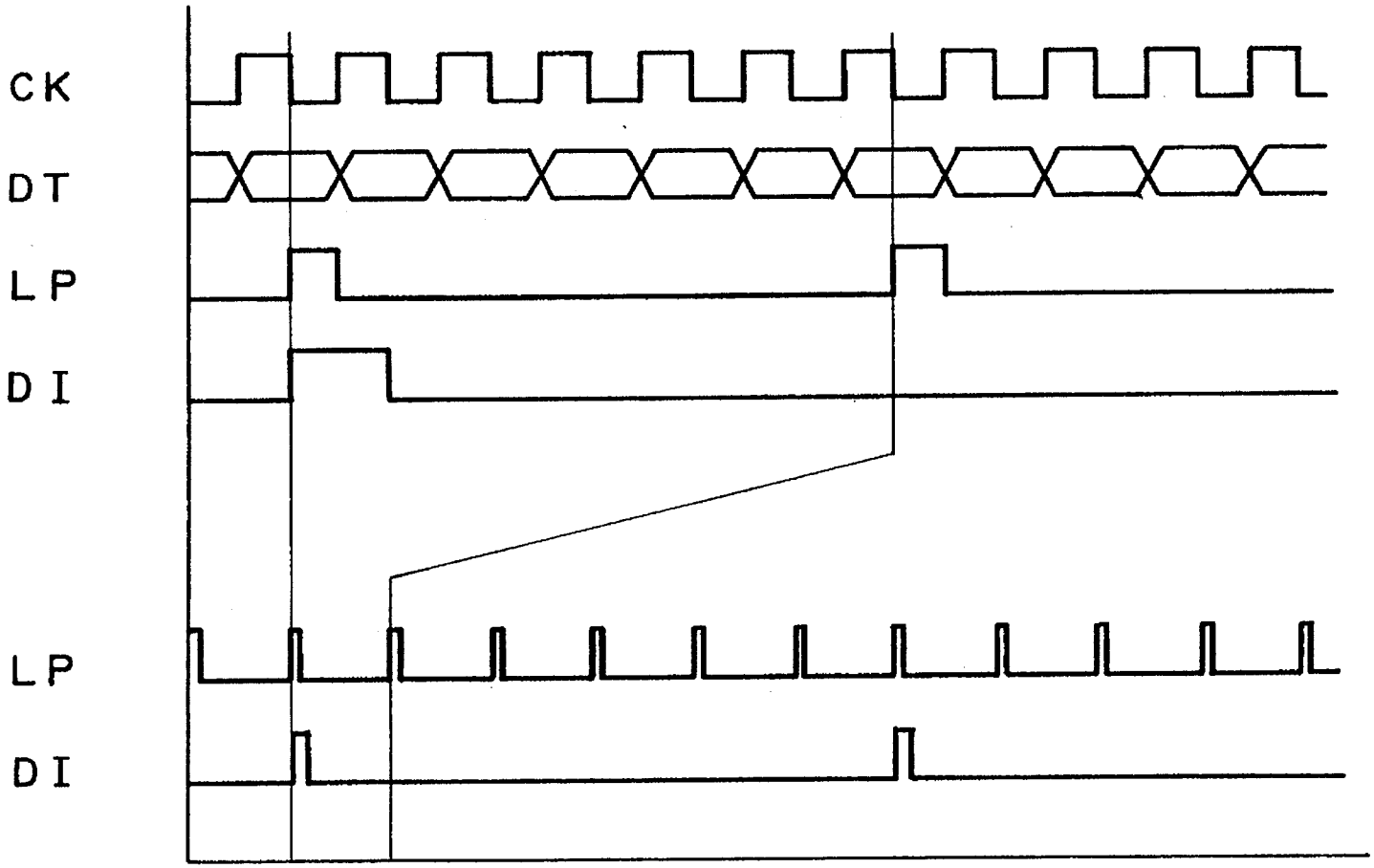
FIG. 5 is a chart showing the timing of the operations of the liquid crystal display device according to the first embodiment.

FIG. 5 is a diagram showing the timing of the operations of the liquid crystal display device according to this embodiment.

Firstly, data DT synchronized with a clock signal CK is inputted bit by bit to this liquid crystal display device. Synchronized with the falling edge of the clock signal CK, the shift register circuit 18 in the X driver 16 takes in the input data DT. The data DT thus taken in is shifted bit by bit sequentially. When six bits, equal to the number of signal electrodes of the liquid crystal display panel 10, are taken in by the shift register circuit 18, the latch circuit 20, whose operation is synchronized with the latch pulse signal LP, takes in and holds the six bits of data corresponding to the signal electrodes, and stored in the shift register circuit 18.

The level shifter circuit 22 applies either the first signal voltage or the second signal voltage to signal electrodes of the liquid crystal display panel 10 depending on the data stored in the latch circuit 20 and on the logic status of the polarity inversion control circuit 32.

In parallel with the preceding operation, the data-in signal DI synchronized with latch pulse LP is inputted to the shift register circuit of the Y driver 24. Synchronized with the latch pulse LP, the shift register circuit 26 shifts the inputted data-in signal DI once every six latch pulses LP. Therefore, an active scanning electrode would change, on each latch pulse LP input, sequentially from Y1 to Y6.

Accordingly, the operation of the X driver 16 and the Y driver 24 is such that a selection voltage V0 or V5 is applied only to scanning electrode. Y1, and a non-selection voltage V4 or V2 will be applied to the other scanning electrodes Y2 through Y6. Therefore, scanning electrode Y1 only, to which a selection voltage has been applied, becomes active to make the pixels, formed by the scanning electrode Y1 and the six signal electrodes X1 through X6, active. The on/off-status of each pixel is determined by the signal voltage applied to signal electrodes X1 through X6.

Next, the active scanning electrode will change from Y2 through Y6 sequentially. At each stage of the sequence, pixels formed on each signal electrode will be either in on-status or in off-status corresponding to the signal voltages applied to X1 through X6.

In parallel with the basic display operations described in the preceding, the polarity inversion control circuit 32 ascertains the on/off-status of the pixels formed on the currently selected scanning electrode Yn and to be formed on the next-to-be-selected scanning electrode Yn+1. Then, in accordance with the on/off-status so ascertained, the polarity inversion control circuit 32 changes the logic status of the polarity inversion signal FRI supplied to X driver 16 and Y driver 24.

In the following, the specific operation of the polarity inversion control circuit 32 is described using the liquid crystal display panel 10 shown in FIG. 2 as an example.

First, the values of the above mentioned Na and Nb are obtained for the liquid crystal display panel 10 shown in FIG. 2, and given here.

TABLE 1

| Selected Scanning Electrodes | Na | Nb |
|---|---|---|
| Y1 to Y2 | 5 | 0 |
| Y2 to Y3 | 0 | 2 |
| Y3 to Y4 | 2 | 3 |
| Y4 to Y5 | 0 | 3 |
| Y5 to Y6 | 0 | 0 |
| Y6 to Y1 | 1 | 0 |

For each of the selections, a magnitude comparison between Na+Nb and S/2 yields the results in Table 2.

TABLE 2

| Selected Scanning Electrodes | Comparison Result |
|---|---|
| Y1 to Y2 | Na + Nb > S/2 |
| Y2 to Y3 | Na + Nb < S/2 |
| Y3 to Y4 | Na + Nb > S/2 |
| Y4 to Y5 | Na + Nb = S/2 |
| Y5 to Y6 | Na + Nb < S/2 |
| Y6 to Y1 | Na + Nb < S/2 |

Here, the calculations to obtain the value of Na+Nb are performed by the mismatch detection circuit 38 and the counter circuit 40, both of which are contained in the polarity inversion control circuit 32. The magnitude comparisons between Na+Nb and S/2 are performed by magnitude comparison circuit 42.

Therefore, the polarity inversion circuit 44 inverts the polarity based on the comparison results of the magnitude comparison circuit 42 as shown in the following table.

TABLE 3

| Selected Scanning Electrodes | Polarity Inversion |
|---|---|
| Y1 to Y2 | Yes |
| Y2 to Y3 | No |
| Y3 to Y4 | Yes |
| Y4 to Y5 | Yes |
| Y5 to Y6 | No |
| Y6 to Y1 | No |

In this embodiment, polarity is inverted when the selected scanning electrode is switched from Y4 to Y5, even though it is not essential to do so since Na+Nb=S/2 during the switching.

Figure 6A:
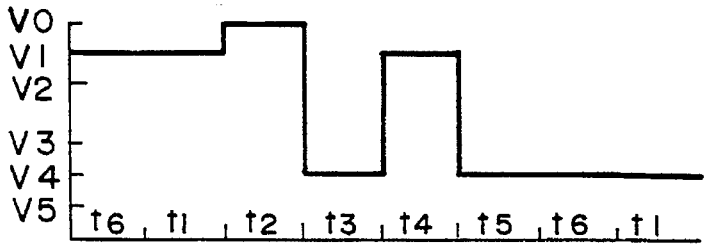
FIGS. 6A through 6G are diagrams showing voltage waveforms applied to each signal electrode and scanning electrode when a liquid crystal display panel is driven with polarity inversions by the polarity inversion control circuit according to the first embodiment.
Figure 6B:
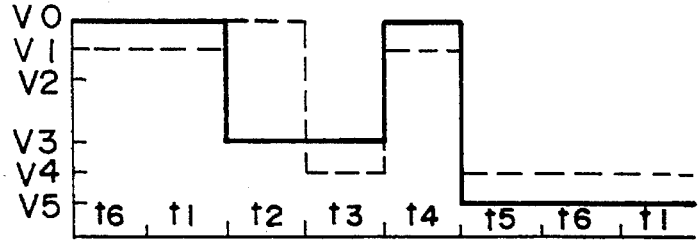
Figure 6C:
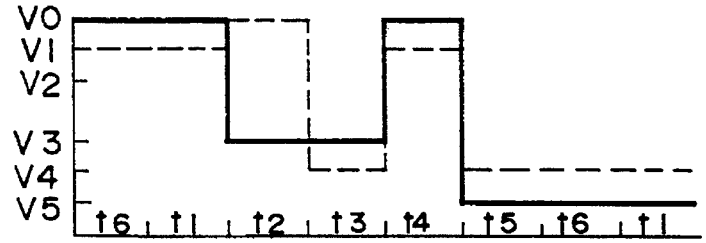
Figure 6D:
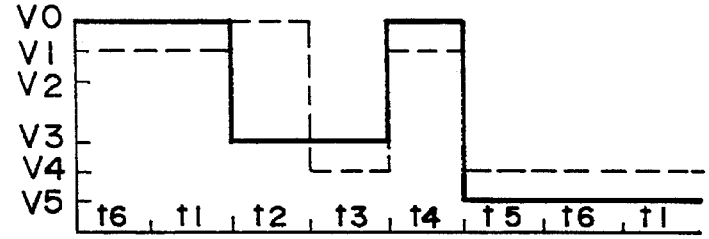
Figure 6E:
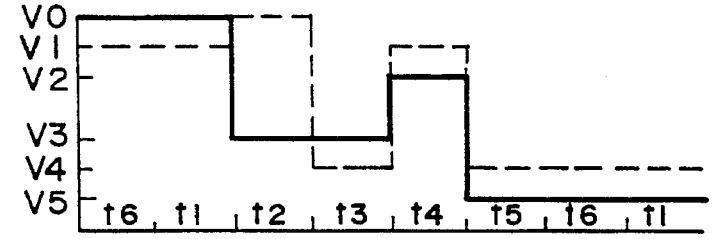
Figure 6F:
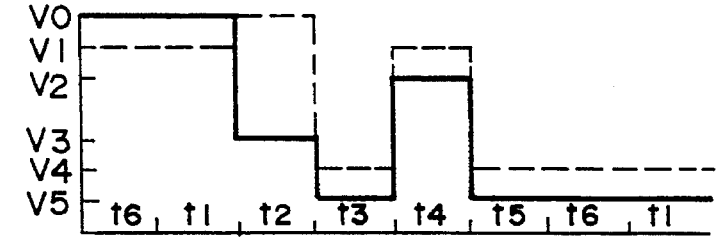
Figure 6G:
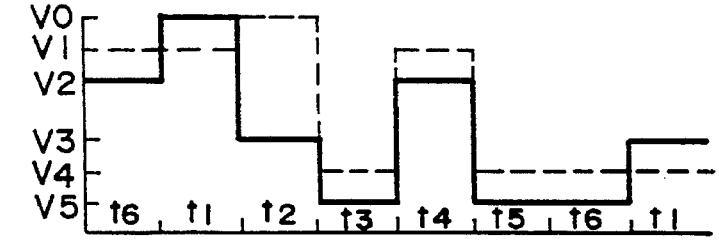

FIGS. 6A through 6G are diagrams showing voltage waveforms applied to each of the signal electrodes and scanning electrodes to drive the liquid crystal display panel 10, with polarity inversion control circuit performing the abovementioned polarity inversions. FIG. 6A shows a voltage waveform applied to the scanning electrode Y2, and FIGS. 6B through 6G respectively show voltage waveforms applied to signal electrodes X1 through X6. In FIGS. 6B through 6G, the scanning voltage waveform applied to the scanning electrode Y2 is shown by dotted lines. In these figures, t1 through t6 respectively represent rife times selection voltages are applied to scanning electrodes Y1 through Y6.

As shown in FIGS. 6A through 6G, and in Table 3, the liquid crystal display panel 10 is driven with polarity inversions, as will be described below, during times t1 through t6.

Time t1: the liquid crystal display panel 10 is driven by the second voltage group.

Time t2: the liquid crystal display panel 10 is driven by the first voltage group, since the polarity is inverted.

Time t3: the liquid crystal display panel 10 is driven by the first voltage group, since the polarity is not inverted.

Time t4: the liquid crystal display panel 10 is driven by the second voltage group, since the polarity is inverted.

Time t5: the liquid crystal display panel 10 is driven by the first voltage group, since the polarity is inverted.

Time t6: the liquid crystal display panel 10 is driven by the first voltage group, since the polarity is not inverted.

Next time t1: the liquid crystal display panel 10 is driven by the first voltage group, since the polarity is not inverted.

Next, the amount of charge discharged by the liquid crystal display panel 10 when the selected scanning electrode is switched from Y1 to Y2 will be investigated with reference to FIGS. 6A through 6G. Here, the capacitance of each of the capacitors formed by the pixels is defined as c, and charges charged and discharged by capacitors formed by signal electrodes Xm and scanning electrodes Y1 and Y2 are ignored.

Since polarities are inverted at the same time as each of the signal electrodes X1 through X5 are switched from the on-voltage to the off-voltage, voltages applied to the capacitors formed by signal electrodes X1 through X5 and by scanning electrodes Y3 through Y6 do not change. No charge is, therefore, discharged.

On the other hand, even though the voltage applied to the signal electrode X6 continues to be an off-voltage, the polarity will be inverted. Thus, the voltage applied to the four capacitors corresponding to pixels formed by signal electrode X6 and scanning electrodes Y3 through Y6 changes from −V to V. Therefore, the amount of charge to be discharged will be 4×c2 V coulomb. That is, the amount of charge discharged by the liquid crystal display panel 10 as the selected scanning electrode is switched from Y1 to Y2 is only 8 cV coulomb.

Similarly, the amounts of the charges to be discharged from the liquid crystal display panel 10 as the scanning electrodes are switched from Y2 to Y3, Y3 to Y4, Y4 to Y5, Y5 to Y6, and Y6 to Y1 are respectively 2×8 cV, 1×8 cV, 3×8 cV, 0×8 cV, and 1×8 cV. Therefore, the total charge released from the liquid crystal display panel 10 from time period from t1 to the next t1 is 8×8 cV. The consumption current to driving the liquid crystal display panel 10 is therefore proportional to the charge released. That is, provided that one frame is defined as the period required to apply a selection voltage once to each scanning electrode, the amount of charge to be discharged during one frame is 64 cV.

Next, such a case will be considered when the polarity is inverted in each frame period, as occurs in a conventional driving method such as amplitude selective addressing. One way of example, driving the liquid crystal display panel 10 using the first voltage group for one frame, and using the second voltage group for the next frame will result in a charge of 10×8 cV=160 cV being discharged during one frame period. This means that using the driving method according to this embodiment of the present invention will reduce power consumption to a ratio of 1/2.5.

Thus, a reduction in power consumed in driving the liquid crystal display panel 10 can be achieved by using a driving method which determines whether or not to invert the polarity depending on display status of the liquid crystal display panel 10, thus reducing charging and discharging of the capacitors formed by the scanning electrodes and signal electrodes.

Incidentally, even though a 6×6 pixel liquid crystal display panel as shown in FIG. 2 is considered in this embodiment, the size of liquid crystal display panels in actual use will be of the order of 400×640 pixels. The following is a calculation of the power consumption for a liquid crystal display panel of such a scale using a conventional driving method, assuming that pixels corresponding to even numbered scanning electrodes are to be turned on, and that pixels corresponding to odd numbered scanning electrodes are not to be turned on.

In such a display method, the voltages applied to all the signal electrodes X1 through X640 in the display are changed either from on-voltage to off-voltage or from off-voltage to on-voltage, when the selected scanning electrode is switched from Yn (n is an integer ranging from 1 to 400) to Yn+1. During this period, a non-selection voltage is applied to scanning electrodes other than scanning electrodes Yn and Yn+1.

As mentioned above, each pixel has a capacitance of approximately 1 pF. The amount of charge q1 stored in pixels (capacitors) formed by scanning electrodes excluding Yn and Yn+1 and by all the signal electrodes X1 through X640 in the display panel with the scanning electrode Yn being selected is therefore;

$$\begin{aligned} q1 &= (400-2)\times 640\times 1\ \text{pF}\times(\pm\text{V}) \\ &\approx 0.25\ \mu\text{F}\times(\pm\text{V}) \end{aligned}$$

On the other hand, the amount of charge q2 stored in pixels (capacitors) formed by scanning electrodes excluding Yn and Yn+1 and by all the signal electrodes X1 through X640 in the display panel with the scanning electrode Yn+1 being selected is;

$$\begin{aligned} q2 &= (400-2)\times 640\times 1\ \text{pF}\times(\mp\text{V}) \\ &\approx 0.25\ \mu\text{F}\times(\mp\text{V}). \end{aligned}$$

Therefore, it can be seen that charge q≈0.50 μF×V moves when the selection of the scanning electrode Y is switched.

Since the charge q moves between the terminals of the power supply circuit while one frame is displayed, current flows between the terminals. By way of example, if the period of a scanning electrode selection is taken to be 30 μs and the voltage 1.5 V, then, the average current flowing will be approximately 25 mA. The current will flow, and be consumed in the power supply circuit.

Therefore, if the abovementioned liquid crystal display panel is driven by the liquid crystal display device of the present embodiment, it is anticipated that the power consumption will be reduced to a ratio of around 1/2.5, which results in a power consumption of around 10 mA in one frame.

SECOND EMBODIMENT

A liquid crystal display device according to the second embodiment will now be described.

The liquid crystal display device according to the second embodiment is characterized by a polarity inversion control of the driving voltage applied to the liquid crystal display panel 10 corresponding to patterns of characters and figures displayed by the liquid crystal display panel (hereafter, "internal polarity inversion control"), and by an external polarity inversion control (hereafter, "external polarity inversion control"). Examples of external polarity inversion control can be found in conventional methods where the polarity is inverted in every frame and according to the method disclosed in Japanese Patent Application Laid-open No. Sho62-31825 where the polarity is inverted in terms of units of a given number of scanning electrodes. In these cases, a reduction in power consumption of the liquid crystal display device is realized by through the operation of the internal polarity inversion control and the external polarity inversion control.

It is arbitrary which of the two is to be prioritized: the internal polarity inversion control, or the external polarity inversion control. For example, there is one case in which priority is given to the external polarity inversion control through a configuration where polarity inversion will be performed by the external polarity inversion control even when polarity inversion is not performed by the internal polarity inversion control; conversely, priority can be given to the internal polarity inversion control through a configuration where polarity inversion will be performed by the internal polarity inversion control, regardless of the polarity inversion performed by the external polarity inversion control. It is also possible to configure the system such that the polarity is inverted only when it is directed by one of the two: the internal polarity inversion control or the external polarity inversion control.

Figure 7:
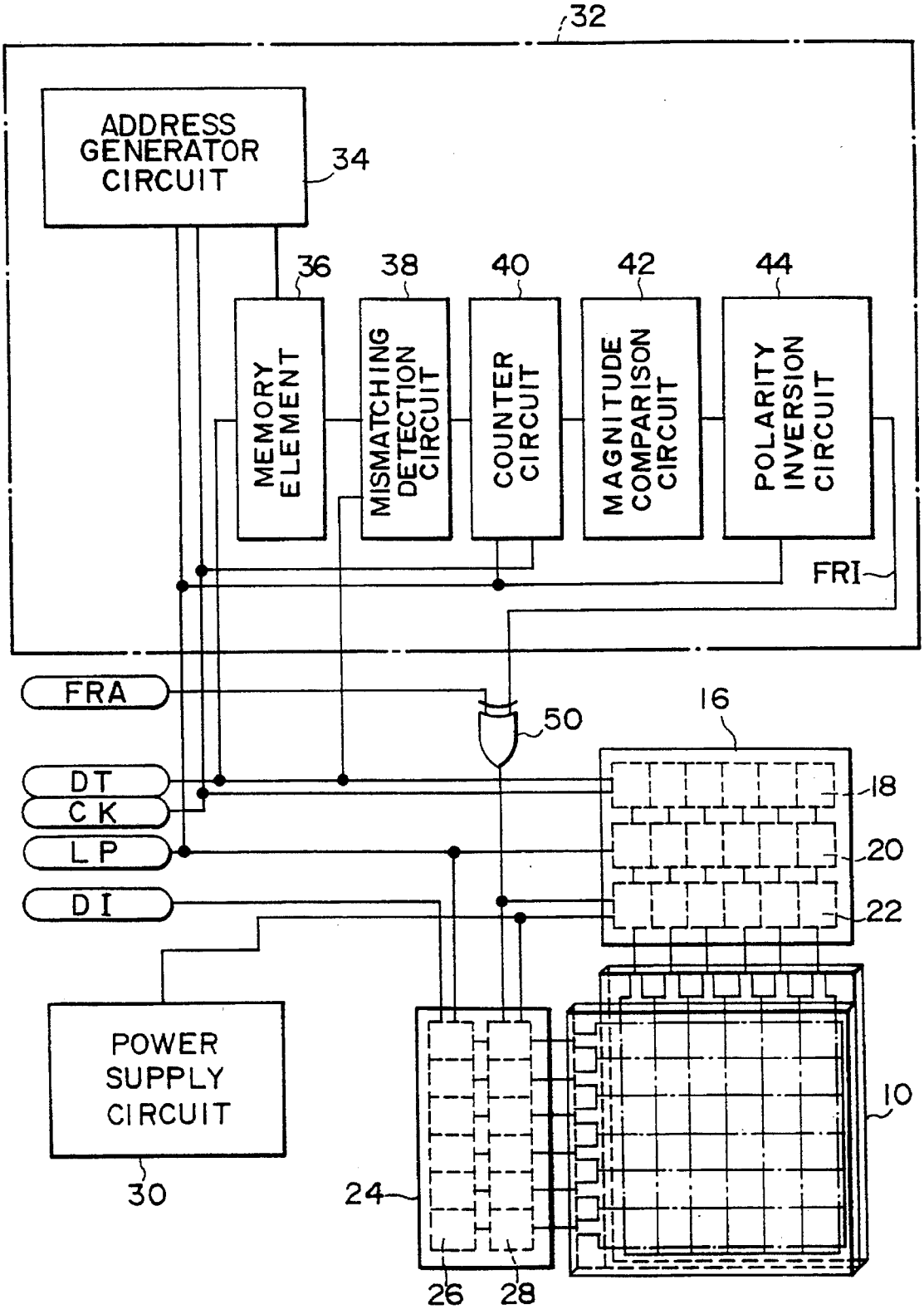
FIG. 7 is a diagram showing the configuration of the liquid crystal display device according to the second embodiment.

FIG. 7 is a diagram showing the configuration of a liquid crystal display device with an external polarity inversion control. The liquid crystal display device is configured such that it will perform polarity inversion only when it is directed by one of the two: the internal polarity inversion control or the external polarity inversion control.

The liquid crystal display device shown in FIG. 7 comprises a liquid crystal display panel 10, an X driver 16, a Y driver 24, a power supply circuit 30, a polarity inversion control circuit 32, and an exclusive OR gate (EX-OR gate) 50. Except for the EX-OR gate 50, the configuration is basically the same as that of the liquid crystal display device according to the first embodiment. In the following description of the second embodiment therefore, the role of different part EX-OR gate 50 will be focused on, omitting a description of the common parts.

A polarity inversion signal FRI, outputted from the polarity inversion circuit 44, is inputted through one of the EX-OR gate 50 input terminals, and an external polarity inversion signal FRA, inputted from outside, is inputted through the other of the EX-OR gate 50 input terminals. The external polarity inversion signal FRA changes either from logical "0" to "1" or "1" to "0" in a cycle equal to or less than the number of scanning electrodes in the liquid crystal display panel 10. There can be more than one cycle.

Each of the output terminals of EX-OR gate 50 are connected to a level shifter circuit 22 in X driver 16 and to a level shifter circuit 28 in Y driver 24, respectively.

Since the EX-OR gate 50 performs the logic operation of exclusive addition of signals inputted through its two input terminals, the logic level of the output is inverted only when logic level of either the polarity inversion signal FRI or the external polarity inversion signal FRA is inverted, exclusively. Therefore, when the logic level of only one of the two signals; the polarity inversion signal FRI and the external polarity inversion signal FRA, is inverted, the polarities of the voltages applied to signal electrodes X1–X6 and scanning electrodes Y1–Y6 of the liquid crystal display panel 10 are inverted.

Thus, even with the addition of the external inversion control, the feature that polarity inversion is determined corresponding to the display content of the liquid crystal display panel 10 remains unchanged. Therefore, the reduction in power consumed in driving the liquid crystal display panel 10 is achieved by reducing the charging and discharging of electric charge in and from the capacitors formed by the scanning electrodes and signal electrodes.

In addition, in the liquid crystal display device of the present embodiment, the external inversion control forces polarity inversion if polarity inversion does not take place for a long period because of the nature of the display of the liquid crystal display panel 10. Contrast deterioration and the like which might arise depending on the nature of the display can therefore be avoided.

THIRD EMBODIMENT

A liquid crystal display device according to the third embodiment will now be described.

For the liquid crystal display device according to the first and the second embodiments, where the polarity is inverted when the value Na+Nb exceeds one half of the number of signal electrodes S of a liquid crystal display device 10, counter circuit 40 contained in polarity inversion control circuit 32 requires a larger number of bits as the number of signal electrodes of the liquid crystal display panel 10 increases.

Therefore, the liquid crystal display device according to the third embodiment is configured to invert the polarity when the value Na+Nb exceeds S/P, where S is the number of the signal electrodes, and P is a number larger than 2. This reduces the number of bits handled both at the counter circuit 40, and at the magnitude comparison circuit 42, which therefore allows the configuration of the polarity inversion control circuit 32 to be simpler.

The liquid crystal display device according to the third embodiment basically has the same configuration as the liquid crystal display device according to the first embodiment shown in FIG. 1. It differs from the liquid crystal display device of the first embodiment in two aspects; the counter circuit requires fewer bits, and the magnitude comparison circuit 42 uses S/P instead of S/2 as a comparison value.

The fact that the magnitude comparison circuit 42 uses S/P as a comparison value does not change the basic fact that it performs polarity inversion corresponding to the nature of the display of the liquid crystal display panel 10, thereby reducing charging and discharging of the capacitors formed by the scanning electrodes and the signal electrodes and thereby allowing a reduction in power consumed in driving the liquid crystal display panel 10. This method, however, is slightly less effective in reducing power consumption compared with the method where the magnitude comparison circuit 42 bases its comparisons on the value S/2. Therefore, the decision whether or not to adopt the liquid crystal display device of the third embodiment should be made in the light of this disadvantage, and the advantage of its simpler circuit configuration.

FOURTH EMBODIMENT

A liquid crystal display device according to the fourth embodiment will now be described.

The liquid crystal display device according to the fourth embodiment takes into account of the effects of the capacitors formed by pixels on the scanning electrodes when they change from selection to non-selection or from non-selection to selection, which were disregarded in the first and second embodiments.

The amount of charge to move, when only one scanning electrode is always selected, can be given as follows.

Amount of charge to move when the polarity is not inverted is;

$$2(S-2)(Na+Nb)cV+\{(k+1)(Na+Nb)+(k-1)(Nc+Nd)\}cV.$$

Amount of charge to move when the polarity is inverted is;

$$2(S-2)(Nc+Nd)cV+\{2(n+1)(Nc+Nd)+2(k-1)(Na+Nb)-8Nd\}cV.$$

Defining X=Na+Nb and S−X=Nc+Nd yields the amount of charge to move when the polarity is not inverted as;

$$\{(2S-2)X+(k-1)S\}cv.$$

Similarly, the amount of charge to move when the polarity is inverted can be written as;

$$\{-2SX+2(S+k-1)S-8Nd\}cV.$$

Comparing the above results reveals that if X>(S·S−4Nd)/(2S−1), the amount of charge to move is greater when the polarity is not inverted.

Therefore, it is possible to further reduce the power consumption through a configuration where the polarity is inverted when Na+Nb becomes larger than (S·S−4Nd)/(2S−1).

Figure 8:
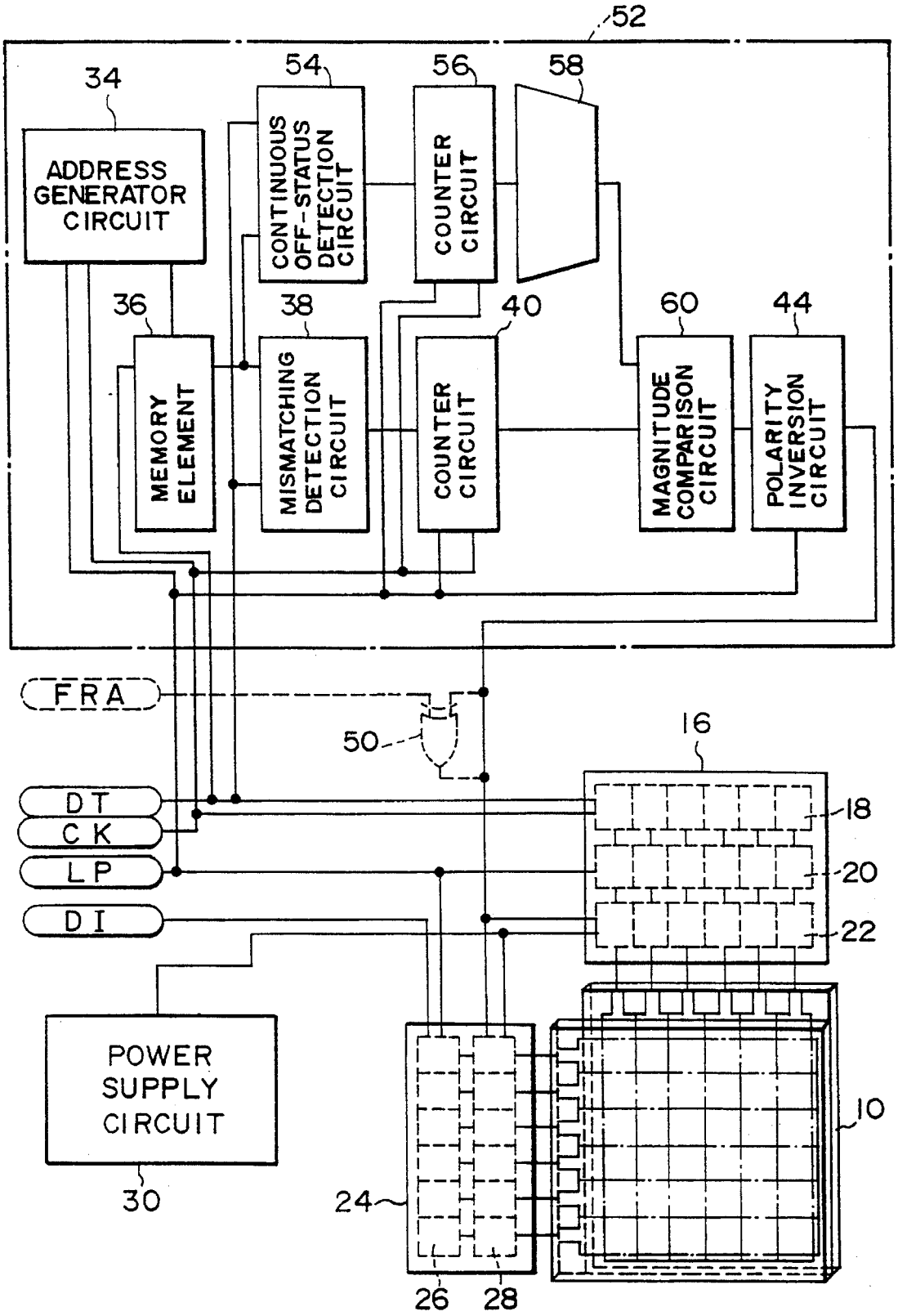
FIG. 8 is a diagram showing the configuration of a liquid crystal display device according to the fourth embodiment.

FIG. 8 is a diagram showing the liquid crystal display device according to the fourth embodiment. The liquid crystal display device shown in the figure comprises a liquid crystal display panel 10, X driver 16, Y driver 24, a power supply circuit 30, and a polarity inversion control circuit 52. Except for the polarity inversion control circuit 52, the configuration is basically the same as the liquid crystal display device according to the first embodiment shown in FIG. 1.

The polarity inversion control circuit 52 comprises an address generator circuit 34, a memory element 36, a mismatch detection circuit 38, a counter circuit 40, a polarity inversion circuit 44, a continuous off-status detection circuit 54, a counter circuit 56, arithmetic circuit 58, and a magnitude comparison circuit 60. The polarity inversion control circuit 52 is different from that of the first embodiment in terms of the continuous off-status detection circuit 54, counter circuit 56, arithmetic circuit 58, and the magnitude comparison circuit 60. These circuits will now be described.

The continuous off-status detection circuit 54 and the counter circuit 56 obtain the aforementioned Nd. That is, the continuous off-status detection circuit 54 detects that the data DT corresponding to the scanning electrode one line before, which is outputted from the memory element 36, and the currently inputted scanning electrode data DT are both "0", and that neither of the pixels adjacent to the two scanning electrodes are turned on.

The counter circuit 56 counts detection results generated by the continuous off-status detection circuit 54, and can comprise, for example, a counter. The detection results of the continuous off-status detection circuit 54 are inputted to an enable terminal of the counter in the counter circuit 56. The counter counts up, synchronized with clock signal CK, only when continuous off-status is detected by the continuous off-status detection circuit 54. The counted value is outputted from the counter circuit 56 as Nd. The counter is configured such that it is reset when a latch pulse LP is inputted.

The arithmetic circuit 58 calculates (S·S−4Nd)/(2S−1) using Nd obtained by the aforementioned counter circuit 56. If the number of the signal electrodes S is large enough, 2S−1 closely approaches 2S. This makes calculating (S/2)-(2Nd/S) instead of (S·S−4Nd)/(2S−1) permissible.

The magnitude comparison circuit 60 compares the magnitude of a calculation result of the arithmetic circuit 58 with a count value (Na+Nb) generated by the counter circuit 40. The comparison result is fed to the polarity inversion circuit 44, which generates and outputs polarity inversion signal FRI in the same manner as described in the first embodiment.

Thus, by using a driving method which determines whether or not to invert the polarity reflecting the nature of the display on the scanning electrode currently and next to be selected, the charging and discharging of the capacitors formed by the scanning electrodes and signal electrodes can be kept to a minimum. This enables a reduction in the power consumed in driving the liquid crystal display panel 10.

It is possible in this embodiment, to incorporate the external polarity inversion control described in the second embodiment. In this case, it is necessary to install the EX-OR gate 50 indicated by broken lines in FIG. 8, whose two input terminals are fed by the output of the polarity inversion circuit 44 (the polarity inversion signal FRI) and by the external polarity inversion signal FRA, respectively. It is also acceptable for the output of the EX-OR gate 50 to be used in place of the polarity inversion signal FRI outputted from polarity inversion circuit 44.

FIFTH EMBODIMENT

A liquid crystal display device according to the fifth embodiment will now be described.

The power supply circuit 30 used in the liquid crystal display device in the first through fourth embodiments may include capacitors between output terminals T0 through T5 connected to liquid crystal display panel 10. Also, power supply circuit 30 can supply the output voltage through a voltage follower circuit using operational amplifiers. In those cases, part of the charge discharged from the liquid crystal display panel 10 is stored in the capacitors in power supply circuit 30. The manner of charge storage varies according to such characteristics as the capacitance of the capacitors in power supply circuit 30, the internal impedance of the power supply circuit 30, and current input/output capabilities.

Depending on these characteristics and capacitor connections, therefore the power consumed by the power supply circuit 30 corresponding to the abovementioned Na, Nb, Nc, and Nd may change. Strictly speaking, the capacitance of each capacitor formed by each pixel is different when it is in on-status and when it is not.

Even in such cases, it is possible to find the power consumption as a function of Na, Nb, Nc, and Nd, when the polarity is inverted and when it is not through experimental and other means. Thus, a reduction in power consumption can be achieved as described in the aforementioned embodiments 1 through 4, by inverting the polarity only when power consumption falls rather than by not inverting the polarity.

Figure 9:
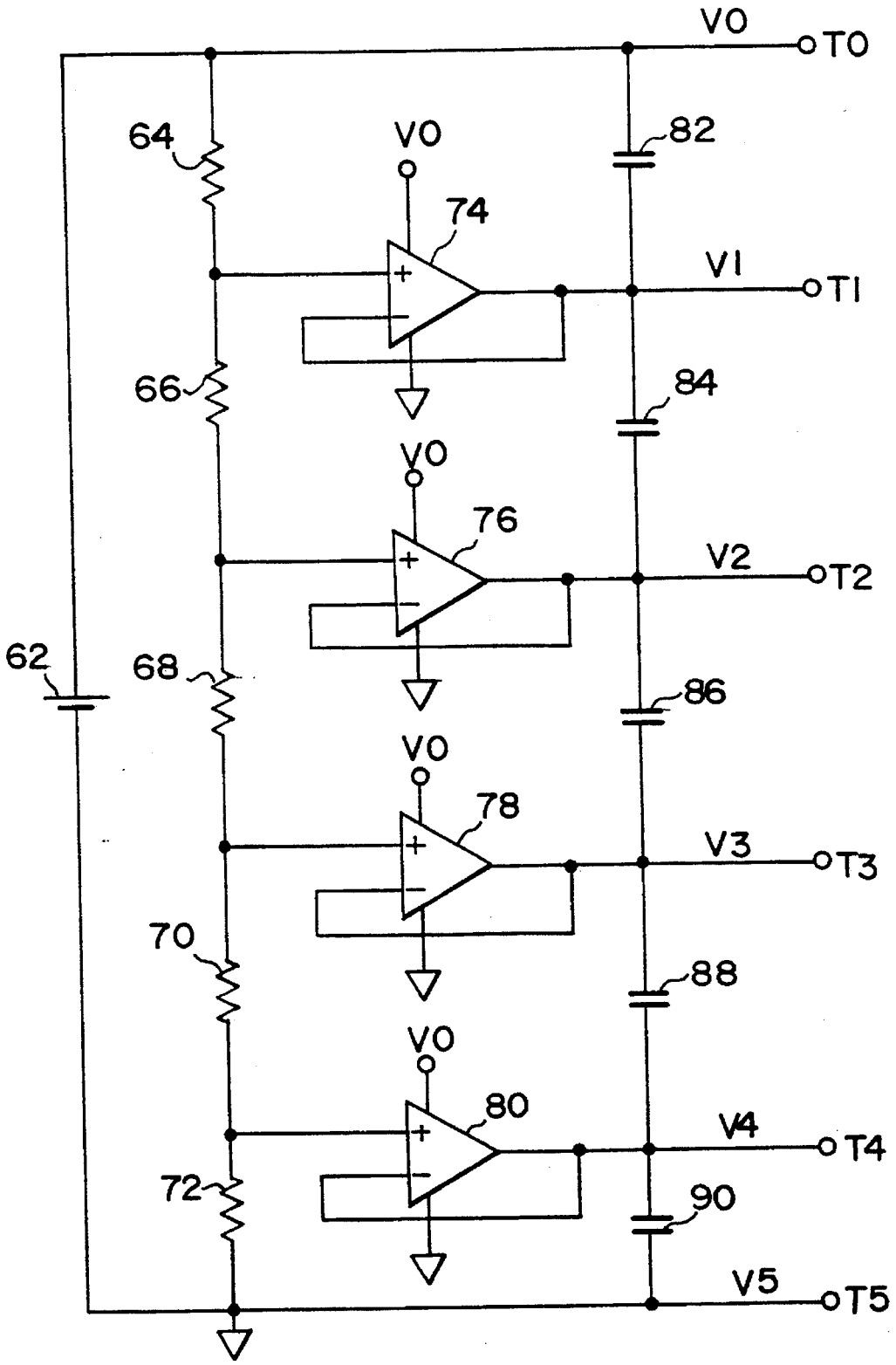
FIG. 9 is a diagram showing details of the power supply circuit.

FIG. 9 is a diagram showing details of the power supply circuit 30. The power supply circuit 30 may also have a number of other configurations. One example is shown in FIG. 9.

In the figure, the power supply circuit 30 comprises a voltage source 62 which may be a battery or an external power source, five resistors 64, 66, 68, 70, 72 which divide the voltage supplied by voltage source 62, operational amplifiers 74, 76, 78, and 80 which comprise voltage follower circuits, and five capacitors 82, 84, 86, 88, and 90 which absorb surge current inputted to or outputted from terminals T0–T5.

The voltage source 62 generates the voltage N·V(= V0–V5) described in the first embodiment between its positive terminal and its negative terminal. The positive terminal is connected to terminal T0, and the negative terminal is connected to T5.

The five resistors 64, 66, 68, 70, and 72 are connected in series. The two ends of the series circuit are connected to the positive terminal and the negative terminal of the power supply circuit 62, respectively. The resistance of each of the resistors 64, 66, 70, and 72 is R, and that of resistor 68 is (k–4)R. Therefore, the voltages V0–V5 required for the six-level driving method will be at the ends and junctions of the series of five resistors 64, 66, 68, 70, and 72.

The four operational amplifiers 74, 76, 78, and 80 comprise voltage followers as mentioned above, which output the voltages divided by resisters 64, 66, 68, 70, and 72 to terminals T1, T2, T3, and T4 at a lower impedance.

In practice, the non-inverted input terminal of operational amplifier 74 is connected to the junction of resistors 64 and 66, and its inverted input terminal is connected to the output terminal of the operational amplifier 74 itself. Also, the output terminal of operational amplifier 74 is connected to the terminal T1.

Similarly, the non-inverted input terminal of operational amplifier 76 is connected to the junction of resistors 66 and 68, and its inverted input terminal is connected to the output terminal of the operational amplifier 76 itself. Also, the output terminal of operational amplifier 76 is connected to terminal T2.

The non-inverted input terminal of operational amplifier 78 is connected to the junction of resistors 68 and 70, and its inverted input terminal is connected to the output terminal of the operational amplifier 78 itself. Also, the output terminal of operational amplifier 78 is connected to terminal T3.

The non-inverted input terminal of operational amplifier 80 is connected to the junction of resistors 70 and 72, and its inverted input terminal is connected to the output terminal of the operational amplifier 80 itself. Also, the output terminal of operational amplifier 80 is connected to terminal T4.

Voltages V0 and V5 are applied as supply voltages to the power terminals of the four operational amplifiers 74, 76, 78, and 80, The five capacitors 82, 84, 86, 88, and 90 are placed such that the six terminals T0–T5 are connected with each other via one of the capacitors. To simplify the explanation, it is assumed that capacitors 82, 84, 86, 88, and 90 have equivalent capacitances and impedances.

In power supply circuit 30 according to such a configuration, a voltage V1 which appears at the output terminal of operational amplifier 74 approximates the supply voltage V0 of operational amplifier 74. Operational amplifier 74, therefore, having a smaller current output capacity, can only supply a small amount of current. Conversely, voltage V4 which appears at the output terminal of operational amplifier 80, approximates supply voltage V5. The operational amplifier 80, therefore, has a reduced input current capacity. When a current flows into an operational amplifier with reduced input current capacity, a greater proportion goes into charging the capacitor connected to its output terminal, resulting in a fall in power consumption.

Therefore, considering the case when polarity inversion does not occur, the amount of charge which flows from the capacitors formed by the pixels to the operational amplifier 74 or 80 when pixels of the liquid crystal display panel 10 change from off-status to on-status is greater than the amount of charge which flows from the capacitors formed by the pixels to operational amplifier 74 or 80 when the pixels change from on-status to off-status. Conversely, when the polarity is inverted the amount of charge which flows from the capacitors formed by pixels to operational amplifier 74 or 80 when pixels of the liquid crystal display panel 10 change from on-status to off-status, is greater than the amount of charge which flows from the capacitors formed by pixels to operational amplifier 74 or 80 when the pixels change from off-status to on-status.

The foregoing can be expressed numerically as per the following: when polarity inversion does not take place, the charge movement is proportional to $Na+\alpha Nb$; when polarity inversion takes place, the charge movement is proportional to $\alpha Nc+Nd$; where $\alpha$ is a number greater than 1. The movement of these charges represent the power consumed.

Therefore, if the condition $Na+\alpha Nb>\alpha Nc+Nd$ is satisfied, the power consumption will be smaller if the polarity is inverted. If this condition is not satisfied, the power consumption is less when the polarity is not inverted.

The above condition can be rewritten as; $\alpha(Nb-Nc)>Nd-Na$. By controlling the polarity inversion according to this condition, the power consumption can be reduced. In addition, since the internal configuration of power supply circuit 30 has also been taken into account in this embodiment, a reduction in power consumption is assured.

Figure 10:
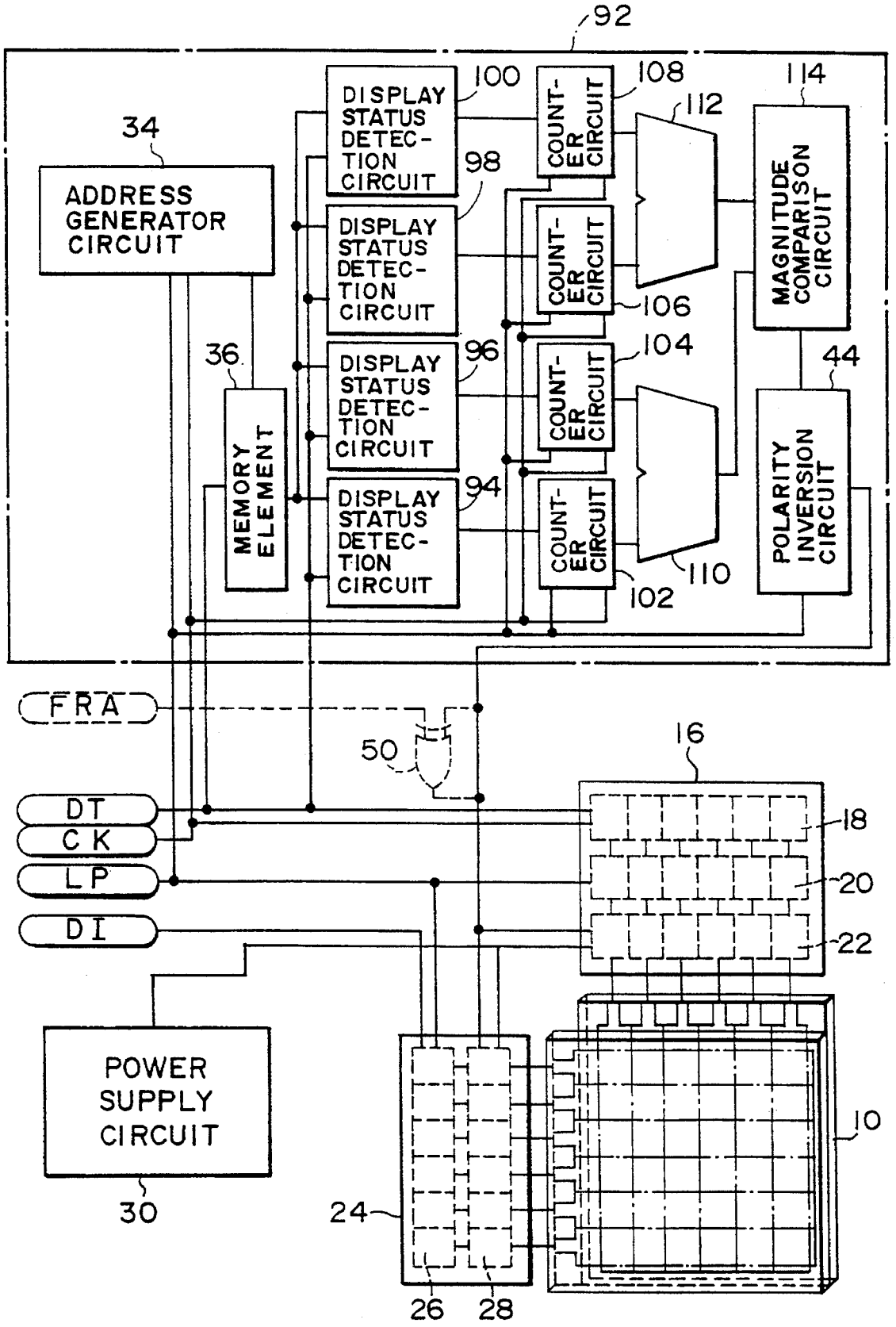
FIG. 10 is a diagram showing the configuration of the liquid crystal display device according to the fifth embodiment.

FIG. 10 is a diagram showing the configuration of the liquid crystal display device according to the fifth embodiment. The liquid crystal display device shown in the figure comprises a liquid crystal display panel 10, X driver 16, Y driver 24, a power supply circuit 30, and a polarity inversion control circuit 92. The configuration of the device is basically the same as that of the liquid crystal display device according to the first embodiment shown in FIG. 1 except for the polarity inversion control circuit 92.

The polarity inversion control circuit 92 comprises an address generator circuit 34, a memory element 36, four display status detection circuits 94, 96, 98, and 100, four counter circuits 102, 104, 106, and 108, two arithmetic circuits 110 and 112, a magnitude comparison circuit 114, and a polarity inversion circuit 44. Among these components, the four display status detection circuits 94, 96, 98, and 100, four counter circuits 102, 104, 106, and 108, two arithmetic circuits 110 and 112, and the magnitude comparison circuit 114 differ from the components found in the first embodiment. They will be described hereinbelow.

The display status detection circuit 94 and the counter circuit 102 are incorporated to acquire the aforementioned Na. That is, the display status detection circuit 94 detects that data DT, corresponding to a scanning electrode one line before, outputted from the memory element 36 is "1" indicating on-status, and that the currently inputted scanning electrode data DT is "0" indicating off-status. The counter circuit 102 counts detection results of the display status detection circuit 94, which may comprise a counter. The detection result of the display status detection circuit 94 is input into the enable terminal of the counter in the counter circuit 102. Synchronized with a clock signal CK, the counter counts up only when the display status detection circuit 94 detects that a pixel on a scanning electrode is in on-status and a pixel on the next scanning electrode and on the same signal electrode is in off-status. The counted value is outputted from the counter circuit 102 as Na. The counter is configured such that it is reset when a latch pulse LP is inputted.

Similarly, the display status detection circuit 96 and the counter circuit 104 are incorporated to acquire the aforementioned Nd. A counter in the counter circuit 104 counts up only when the display status detection circuit 96 detects that a pixel on a scanning electrode is in off-status and a pixel on the next scanning electrode and on the same signal electrode is also in off-status. The counted value is outputted from the counter circuit 104 as Nd.

The display status detection circuit 98 and the counter circuit 106 are incorporated to acquire the aforementioned Nc. A counter in the counter circuit 106 counts up only when the display status detection circuit 98 detects that both of the pixels on adjacent scanning electrodes are in on-status. The counted value is outputted from the counter circuit 106 as Nc.

The display status detection circuit 100 and the counter circuit 108 are incorporated to acquire the aforementioned Nb. A counter in the counter circuit 108 counts up only when the display status detection circuit 100 detects that the pixels on an adjacent scanning electrode change status from off-status to on-status. The counted value is outputted from the counter circuit 108 as Nb.

The arithmetic circuit 110 calculates the value of $Nd-Na$ using the abovementioned counted value Na outputted from the counter circuit 102 and the counted value Nd outputted from the counter circuit 104. The arithmetic circuit 112 calculates the value of $\alpha(Nb-Nc)$ using the abovementioned counted value Nc outputted from the counter circuit 106 and the counted value Nb outputted from the counter circuit 108.

The magnitude comparison circuit 114 compares the magnitude of the calculation result $Nd-Na$ produced by the arithmetic circuit 110 with the calculation result $\alpha(Nb-Nc)$ produced by the arithmetic circuit 112. If the latter is larger, the signal inputted from the magnitude comparison circuit 114 to the polarity inversion circuit 44 becomes logic level "1".

Subsequently, a polarity inversion signal FRI is generated by the polarity inversion circuit 44 in the same manner as in the first embodiment.

Thus, the charging and discharging of the capacitors formed by the scanning and signal electrodes can be kept to a minimum by using a driving method which determines whether or not to perform polarity inversion taking into account of the internal configuration of the power supply circuit 30, which in turn enables a reduction in the power consumed driving the liquid crystal display panel 10.

Additionally, it is even possible for the liquid crystal display device according to the present embodiment to incorporate the external polarity inversion control as per the second embodiment. In this case, it is necessary to install the EX-OR gate 50 indicated by broken lines in FIG. 10, whose two input terminals are fed by the output of the polarity inversion circuit 44 (the polarity inversion signal FRI) and by the external polarity inversion signal FRA, respectively. The output of the EX-OR gate 50 may also be used in place of the polarity inversion signal FRI outputted from the polarity inversion circuit 44.

Finally, although the fifth embodiment described above sets conditions which take into account of the asymmetrical capabilities of operational amplifiers, it is also possible to set conditions which depend on variations in capacitor characteristics.

SIXTH EMBODIMENT

The liquid crystal display devices in the first through fifth embodiments can be incorporated in various forms of electronic equipment which require display functions. The power consumption of the electronic equipment as a whole incorporating the liquid crystal device can be lessened by reducing the power consumption of the liquid crystal display device. It is therefore possible to simplify the power supply circuits in electronic equipment supplied by power lines, leading to a reduction in size and weight. Battery powered electronic equipment will also be able to either run on smaller capacity batteries, or operate for a longer period of time with the same capacity batteries.

SEVENTH EMBODIMENT

A liquid crystal display device according to the seventh embodiment will now be described.

The liquid crystal display device according to the seventh embodiment is characterized in that it inverts the polarity of the driving voltage applied to the liquid crystal display panel corresponding to the patterns of characters and figures displayed on the liquid crystal display panel. This aspect is similar to that of the first embodiment, but it is different inasmuch as it enables a reduction in the display unevenness of the liquid crystal display device.

The IHAT method, disclosed, for example, in Japanese Patent Application Laid-open No. Hei5-46127, is adopted in the present embodiment of the liquid crystal display device. The IHAT method is broadly outlined hereinbelow. In this description, the terms and expressions adopted generally follow the use in the laid-open document. For example line electrodes correspond to scanning electrode, and row electrodes correspond to signal electrodes.

N line electrodes are divided into p subgroups each of which comprise M line electrodes (p=N/M). Data for a pixel, formed at the intersection of an arbitrary line electrode and a selected subgroup, is expressed by an M bit word;

$$[d_{k1}, d_{k2}, \ldots d_{kM}]$$

where, $d_{ki}$(i=1, . . . , M)=0 or 1.

In the above expression, "0" corresponds to a off-status pixel, and "1" corresponds to a on-status pixel, and "k" is a number between 0 and (p−1) corresponding to each subgroup.

The selection pattern of line electrodes in a selected subgroup is expressed in $2^M$(=Q) M bit words $w_1$, $w_2$, . . . , $w_Q$, each of which is in the form of;

$$[a_{k1}, a_{k2}, \ldots, a_{kM}]$$

where, $a_{ki}$(i=1, . . . , M)=0 or 1.

The IHAT method is characterized by the following steps in driving.

(1) Choose the first line electrode subgroup.

(2) Choose the first M bit word $w_1$, as the line electrode selection pattern.

(3) In the selected subgroup, compare the line electrode pattern with the data pattern bit by bit in exclusive OR logic, and acquire the sum i of the exclusive OR logic outputs.

(4) For the above summation i, set row electrode voltage as $V_i$.

(5) Choose $V_i$ independently for each row in the matrix.

(6) Apply voltages to line electrodes and to row electrodes simultaneously for time T. In other words voltage $V_i$ to the row electrodes, and first line electrode selection pattern $w_1$ (line electrodes not selected are grounded, line electrodes selected will have $-v_i$ for 0, $+v_i$ for 1) to the line electrodes.

(7) Choose new line electrode selection pattern $w_2$, then choose voltages corresponding to it in the same manner as in (3) through (5) to apply voltages to rows and lines simultaneously for time T as in (6).

(8) One cycle is completed when all the Q line electrode selection patterns have been selected.

(9) Select a subgroup for the next line electrode, and repeat cycle (2) through (8).

In the procedure just described, $d_i$ (=0 or 1) and $a_i$ (=0 or 1) can be replaced with $d_j$ (=+1 or −1) and $a_j$ (=−1 or +1), respectively. Thus, acquiring the bit by bit products of a line electrode pattern and a data pattern in a selected subgroup, and obtaining the sum of the products as an alternative to obtaining the sum i of the exclusive logic OR outputs of (3).

The procedure above describes moving on to the next subgroup after continuously selecting all the selection patterns for a subgroup, but it is also acceptable to configure the system such that the next selection pattern is moved onto after applying voltages for a selection pattern to all the subgroups.

The liquid crystal display device according to the present embodiment is driven by the IHAT method as described above. An example, when the number of scanning electrodes selected simultaneously is 1 will be explained hereinbelow.

In this case the non-selection voltage is set as 0, the selection voltage is either −V or +V, and the signal voltage is either −v or +v. In other words, when the selection voltage is +V, the on-voltage is −v and the off-voltage is +v. Conversely, when the selection voltage is −V, the on-voltage is +v and the off-voltage is −v.

Figure 11:
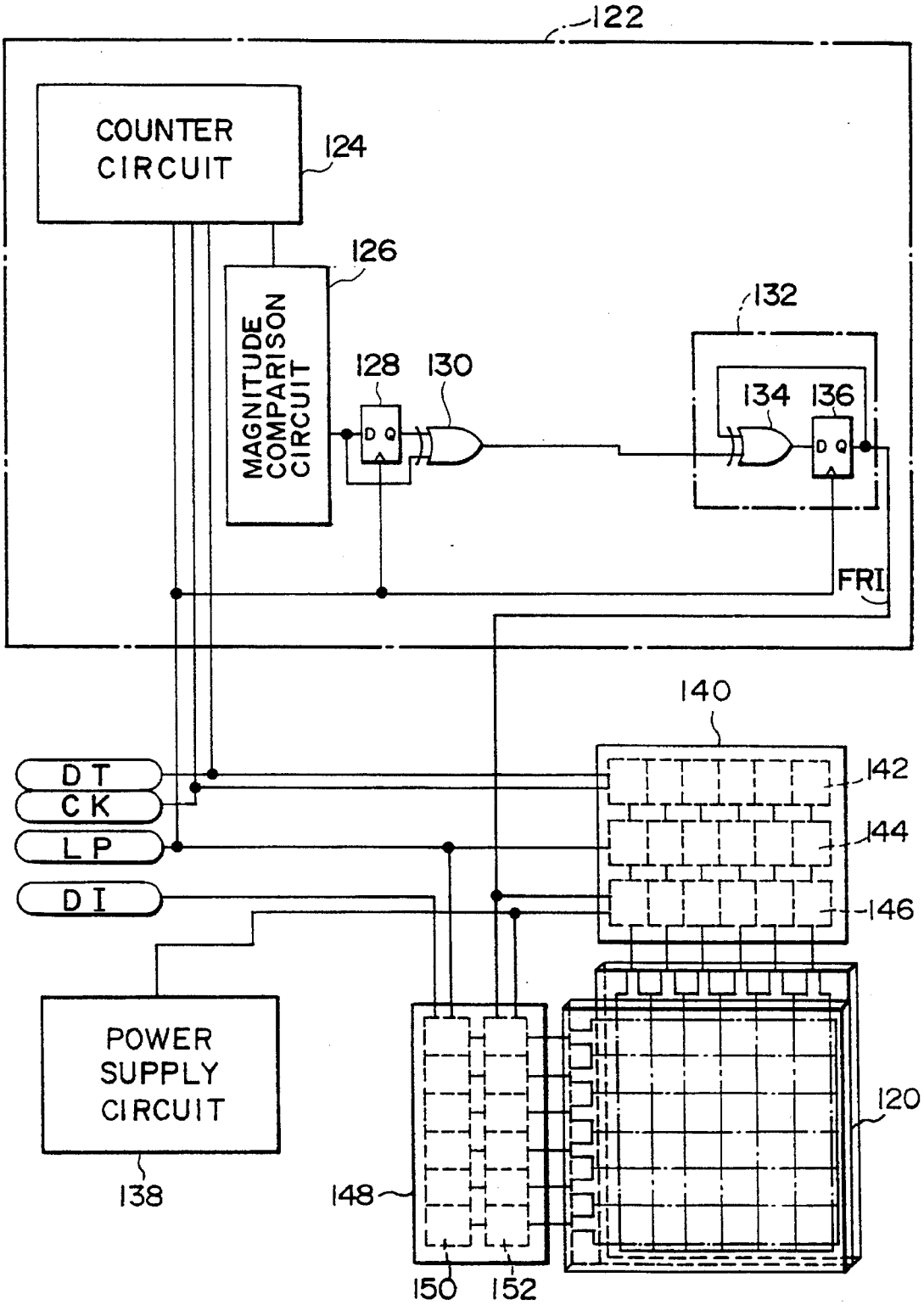
FIG. 11 is a diagram showing the configuration of the liquid crystal display device according to the seventh embodiment.

FIG. 11 is a diagram showing the configuration of the liquid crystal display device according to the seventh embodiment. With polarity inversion control circuit 122, this liquid crystal display device is characterized in that it performs AC driving by inverting the polarity of the driving voltage applied to the liquid crystal display panel 120 corresponding to the patterns of characters and figures displayed by the liquid crystal display device 120. Display unevenness on the liquid crystal display panel 120 can be reduced through the polarity inversion.

The liquid crystal display device shown in FIG. 11 comprises a liquid crystal display panel 120 which has a given number of scanning electrodes and signal electrodes, X driver 140 and Y driver 148 which apply driving voltages to the liquid crystal display panel 120, a power supply circuit 138 which generates a given voltage, and a polarity inversion control circuit 122 which controls polarity inversion corresponding to the on/off-status of the pixels of the liquid crystal display panel 120.

Figure 12:
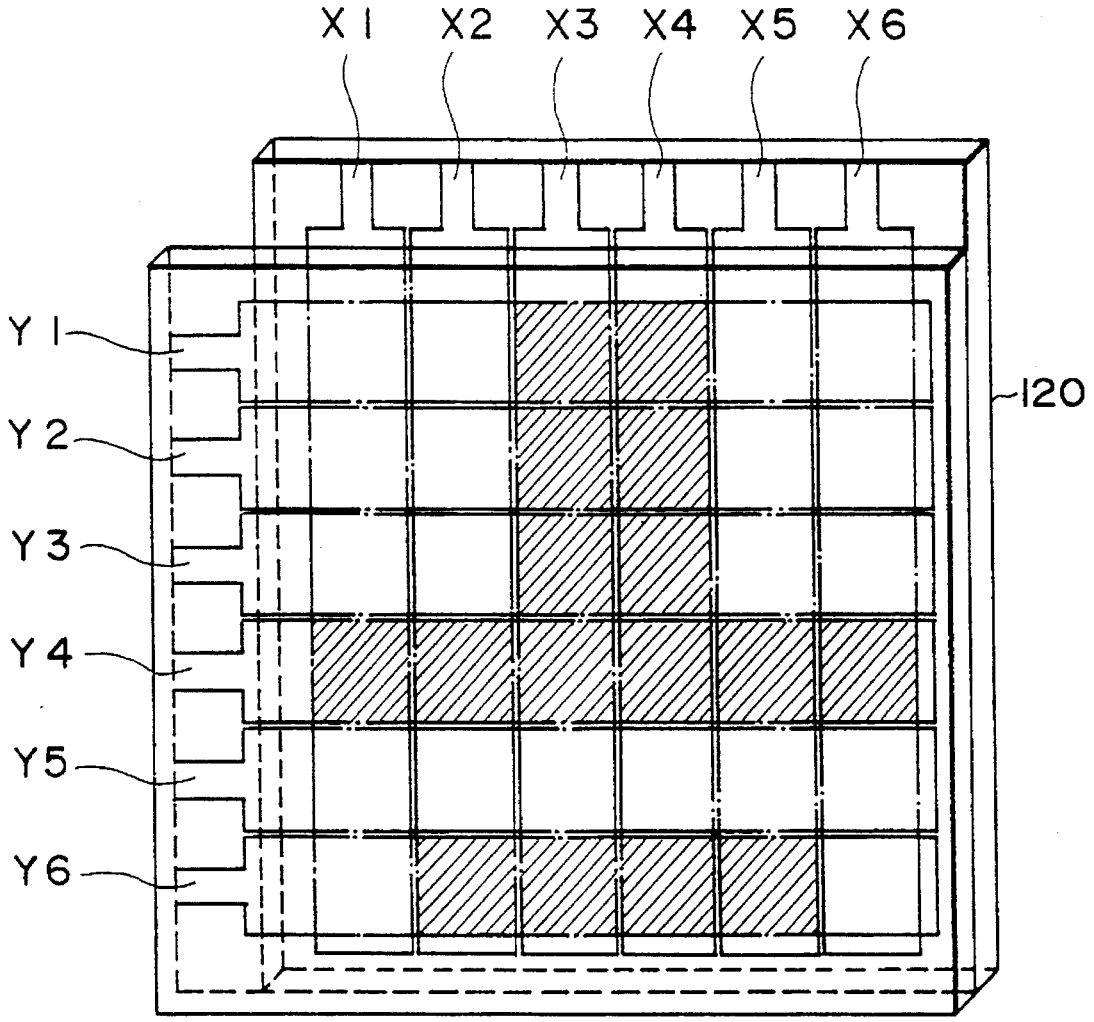
FIG. 12 is a diagram showing an example of the on/off-status of each pixel of the liquid crystal display panel according to the seventh embodiment.

FIG. 12 is a diagram showing an example of the on/off-status of each pixel of the aforementioned liquid crystal display panel 120. The basic structure of the liquid crystal display panel 120 is identical to that of the liquid crystal display panel 10 according to the first embodiment shown in FIG. 2. Hatching on pixels in FIG. 12 indicates the pixels are in on-status and the other pixels are not.

The X driver 140 applies either an on-voltage or off-voltage (−v or +v) to each of the signal electrodes X1 through X6 of the liquid crystal display panel 120. The X driver 140 comprises a shift register circuit 142, a latch circuit 144, and an level shifter circuit 146.

The shift register circuit 142 converts six one-bit data to six-bit parallel data, and outputs it. The latch circuit 144, which has six-bit capacity the same as the parallel data, temporarily holds the six-bit parallel data outputted by the shift register circuit 142.

The level shifter circuit 146 sets voltage levels corresponding to each bit of the six-bit data outputted from the latch circuit 144, and applies the set voltages either as on-voltages or as off-voltages to each of the signal electrodes of the liquid crystal display panel 120. More specifically since the on-voltage and off-voltage are either −v or +v, the level shifter circuit 146 appropriately chooses either of the voltages to apply to each of the signal electrodes of the liquid crystal display panel 120.

The Y driver 148 applies a selection voltage or a non-selection voltage to each of the scanning electrodes Y1 through Y6. The Y driver 148 comprises a shift register circuit 150, and a level shifter circuit 152.

The shift register circuit 150, which has six-bit capacity, sequentially shifts an inputted data-in signal DI synchronized with a latch pulse LP. Therefore, a six-bit data, only one bit of which is "1", is outputted, and the position of a "1" bit shifts is shifted sequentially.

The level shifter circuit 152 sets each voltage level corresponding to each bit of the six-bit parallel data outputted from the shift register circuit 150, and applies the set voltage to each of the scanning electrodes of the liquid crystal display panel 120 either as a selection voltage or as a non-selection voltage. More specifically either −V or +V is applied as a selection voltage, and 0 V is applied as a non-selection voltage. In other words, a non-selection voltage is applied to a scanning electrode by grounding the scanning electrode.

The power supply circuit 138 generates signal voltages −v and +v, and also generates scanning voltages −V and +V, and applies these voltages to X driver 140 and Y driver 148. Specifically, the power supply circuit 138 supplies voltages −v and +v to the level shifter circuit 146 in X driver 140, and also supplies voltages −V and +V to the level shifter circuit 152 in Y driver 148.

The polarity inversion control circuit 122 switches the polarity of signal voltages and scanning voltages applied to the liquid crystal display panel 120 depending on the patterns of characters and figures displayed by the liquid crystal display panel 120, or more specifically, depending on the number of pixels in on-status on the currently selected scanning electrode and the number of pixels to be in on-status on the scanning electrode to be selected next. This polarity inversion control circuit 122 comprises a counter circuit 124, a magnitude comparison circuit 126, a D-type flip-flop (D-FF) 128, an exclusive OR gate (EX-OR gate) 130, and a polarity inversion circuit 132.

The counter circuit 124 counts the number of on-status pixels on the scanning electrode under scrutiny. More specifically, it comprises a counter, which receives a latch pulse LP at its reset terminal, a clock signal CK at its clock terminal, and a data DT at its enable terminal. The counter circuit 124 is, therefore, reset synchronously with the latch pulse LP, and counts up synchronously with the clock signal CK only when the data inputted is "1".

The magnitude comparison circuit 126 compares the magnitude of the counted value of the counter circuit 124 with a given number (here it is three which is half the number of the signal electrodes of the liquid crystal display panel 120).

The D-FF 128, which functions as a circuit to hold a comparison result, holds a comparison result of the magnitude comparison circuit 126 synchronized with the latch pulse LP.

The EX-OR gate 130, which functions as a circuit to ascertain an inversion condition, receives a comparison result from the magnitude comparison circuit 126 at one of its input terminals, and receives output Q of the D-FF 128 at the other of its input terminals. Since the D-FF 128 holds the comparison result of the pixels on the currently selected scanning electrode, the EX-OR gate 130 determines whether or not to invert the polarity based on that result, and on the comparison result for pixels on the scanning electrode to be selected next.

The polarity inversion circuit 132, which comprises an EX-OR gate 134 and a D-FF 136, inverts the output of the D-FF 136 when the output of the aforementioned EX-OR gate 130 is "1". The output of the D-FF 136 is outputted from the polarity inversion control circuit 122 as a polarity inversion signal FRI, and is inputted to the level shifter circuit 146 in the X driver 140 and to the level shifter circuit 152 in the Y driver 148.

The actual operation of the liquid crystal display device according to such a configuration will now be described.

In the present embodiment, the decision whether or not to invert the polarity is based on the total number S of signal electrodes and on numbers M and N to be defined below.

When a selection voltage is applied to a particular scanning electrode, the number of on-status pixels among the pixels formed at the intersections of the scanning electrode and signal electrodes is defined as M. Similarly, the number of on-status pixels among pixels formed at the intersections of the scanning electrode to be selected next and the signal electrodes is defined as N. The total number of the signal electrodes is defined as S, as in the first embodiment.

Suppose a polarity inversion does not take place when the selected scanning electrode changes from Yn to Yn+1. ¦M−N¦ is the absolute value of the difference between the number of signal electrodes to which the applied voltage changes from the on-voltage to the off-voltage and the number of signal electrodes to which the applied voltage changes from the off-voltage to the on-voltage. That is, focusing on scanning electrodes which are not selected other than the two scanning electrodes Yn and Yn+1, the value ¦M−N¦, represents the total voltage change of the signal electrodes in terms of the non-selection voltage. If the value ¦M−N¦ is large, the voltage on the scanning electrode will be distorted accordingly.

This time, assume a polarity inversion does take place when the selected scanning electrode changes from Yn to Yn+1. In this case, the value ¦M-(S−N)¦=¦M+N−S¦ is corresponding to the foregoing value ¦M−N¦. Thus, when the value ¦M+N−S¦ is large, the voltage on the scanning electrode is distorted in accordance with the value.

It can therefore be concluded that when the value ¦M−N¦ is large, display unevenness can be reduced by inverting the polarity, and that when the value ¦M+N−S¦ is large, it can be reduced by not inverting the polarity. Thus, by performing a polarity inversion when condition ¦M−N¦>¦M+N−S¦ is satisfied, the distortion of voltage applied to a scanning electrode can be minimized, resulting in a reduction of display unevenness.

In simpler terms, the conditions under which polarity is to be inverted (hereafter, "inversion condition") may be either of the following.

1) $M>S/2$ and $N<S/2$

2) $M<S/2$ and $N>S/2$

The detailed operations of the liquid display device shown in FIG. 11 will now be described.

The polarity inversion control circuit 122 checks the on/off-status of pixels on the currently selected scanning electrode Yn and on a scanning electrode Yn+1 to be selected next in the liquid crystal display panel 120, and, switches the logic status of the polarity inversion signal FRI supplied to X driver 140 and Y driver 148 in accordance with the on/off-status thus ascertained.

In the following, the actual operation of the polarity inversion control circuit 122 will be explained using the display pattern example on the liquid crystal display panel 120 shown in FIG. 12. In this description, the polarity inversion control circuit 122 will be covered in detail, except for the basic operation in displaying given patterns on the liquid crystal display panel 120 since that is identical to that of the first embodiment shown in FIG. 1.

The aforementioned M and N obtained for the liquid crystal display panel shown in FIG. 12 are as follows.

TABLE 4

| Selected Scanning Electrodes | M | N |
|---|---|---|
| Y1 to Y2 | 2 | 2 |
| Y2 to Y3 | 2 | 2 |
| Y3 to Y4 | 2 | 6 |
| Y4 to Y5 | 6 | 0 |
| Y5 to Y6 | 0 | 4 |
| Y6 to Y1 | 4 | 2 |

Given these results, checking the aforementioned inversion condition 1) (M>3 and N<3) and using a truth table format, where 1 represents the condition being satisfied and 0 represents the condition not being satisfied gives the following.

TABLE 5

| Selected Scanning Electrodes | M > 3 | N < 3 | M > 3 and N < 3 |
|---|---|---|---|
| Y1 to Y2 | 0 | 1 | 0 |
| Y2 to Y3 | 0 | 1 | 0 |
| Y3 to Y4 | 0 | 0 | 0 |
| Y4 to Y5 | 1 | 1 | 1 |
| Y5 to Y6 | 0 | 0 | 0 |
| Y6 to Y1 | 1 | 1 | 1 |

Similarly, checking the inversion condition 2) (M<S/2 and N>S/2) gives the following.

TABLE 6

| Selected Scanning Electrodes | M < 3 | N > 3 | M < 3 and N > 3 |
|---|---|---|---|
| Y1 to Y2 | 1 | 0 | 0 |
| Y2 to Y3 | 1 | 0 | 0 |
| Y3 to Y4 | 1 | 1 | 1 |
| Y4 to Y5 | 0 | 0 | 0 |
| Y5 to Y6 | 1 | 1 | 1 |
| Y6 to Y1 | 0 | 0 | 0 |

When the inversion condition 1) or 2) is satisfied as per tables 5 or 6, the EX-OR gate 130 outputs "1". Thus, the polarity inversion circuit 132 performs polarity inversion as per the following table, corresponding to the output of the EX-OR gate 130 when the scanning electrodes are switched.

TABLE 7

| Selected Scanning Electrodes | Polarity Inversion |
|---|---|
| Y1 to Y2 | No |
| Y2 to Y3 | No |
| Y3 to Y4 | Yes |
| Y4 to Y5 | Yes |
| Y5 to Y6 | Yes |
| Y6 to Y1 | Yes |

Next, the operation of the polarity inversion control circuit 122, which determines whether or not to perform the polarity inversion shown in Table 7, will be described.

Firstly, the counter circuit 124 is reset synchronized with the latch pulse LP which is inputted each time when the selected scanning electrode is switched. Next, the counter circuit 124 counts up only when data DT inputted into its enable terminal synchronized with the clock signal OK is "1", indicating on-status. Thus, when the data DT for six signal electrodes is inputted to the counter circuit 124, it outputs a number of on-status pixels among those on one scanning electrode.

The magnitude comparison circuit 126 outputs "1" as a comparison result when a counted value produced by the counter circuit 124 is greater than "3", which is half the number S of signal electrodes. When the counted value is less than "3", it outputs "0" as a comparison result.

The comparison results are taken in by the D-FF 128 synchronously, with latch pulses LP. Thus, if a value outputted from the D-FF 128 corresponds to a currently selected scanning electrode, then the value outputted from the magnitude comparison circuit 126 corresponds to the scanning electrode to be selected next.

The EX-OR gate 130, which performs an exclusive logical "or" operation between the outputs of the D-FF 128 and the magnitude circuit 126, effectively determines whether or not only one of the switching conditions 1) and 2), the results of which are shown in FIG. 5 and FIG. 6, is satisfied.

Figure 13A:
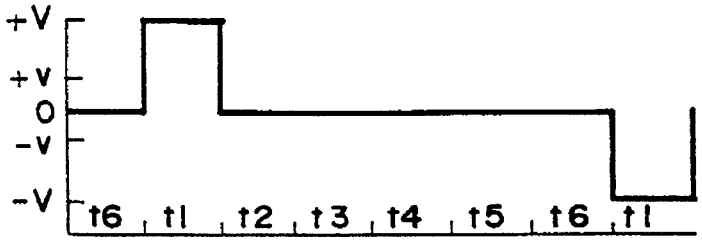
FIGS. 13A through 13H are diagrams showing voltage waveforms applied to each electrode when the pattern shown in FIG. 12 is displayed on the liquid crystal display panel shown in FIG. 11.
Figure 13B:
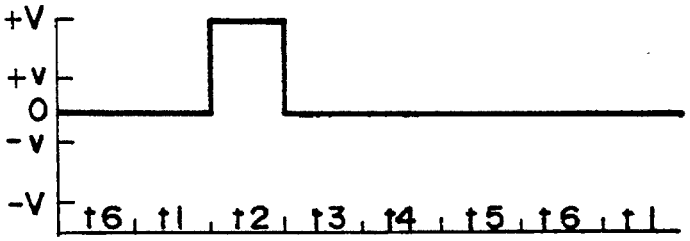
Figure 13C:
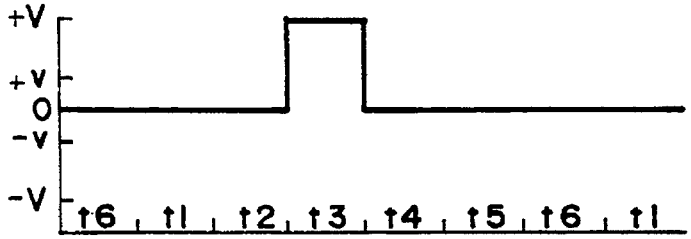
Figure 13D:
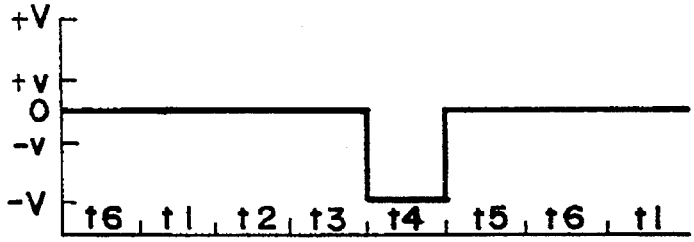
Figure 13E:
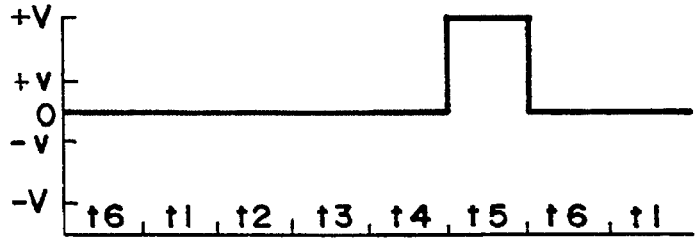
Figure 13F:
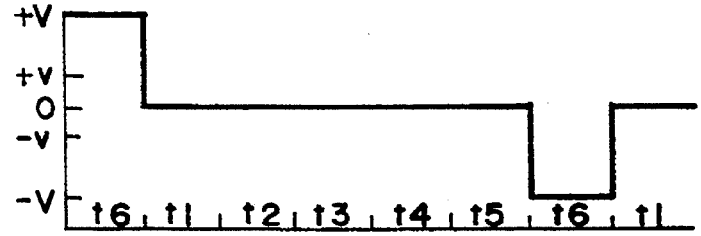
Figure 13G:
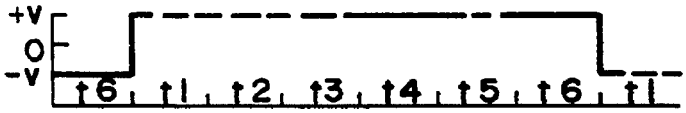
Figure 13H:
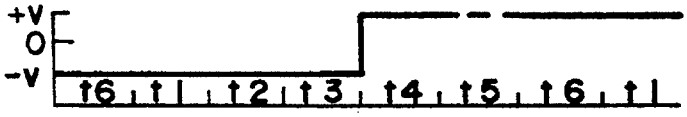

FIGS. 13A through 13H are diagrams showing voltage waveforms applied to each electrode to display the pattern given in FIG. 12 using the liquid crystal display panel 120 shown in FIG. 11. FIGS. 13A through 13F show voltage waveforms applied to scanning electrodes Y1 through Y6, while FIGS. 13G and 13H show voltage waveforms applied to signal electrodes X2 and X3. In FIGS. 13G and 13H, waveforms drawn with solid lines correspond to on-voltages, and waveforms drawn with broken lines correspond to off-voltages. In these figures, t1 through t6 represent the time during which selection voltages are applied to scanning electrodes Y1 through Y6, respectively. As FIGS. 13A through 13F show, since the inversion condition is satisfied, both cases when scanning electrode Y4 is selected and when scanning electrode Y6 is selected, the polarities of the scanning voltages and the signal voltages are inverted, synchronized with the switching timing to these scanning electrodes in these cases.

Thus, by using a driving method which determines whether or not to perform polarity inversion corresponding to the nature of the display of the liquid crystal display panel 120, voltage distortion on scanning electrodes can be minimized, thus reducing the occurrence of display unevenness.

Even though the seventh embodiment has been described as using the IHAT method to drive the liquid crystal display panel 120, the polarity inversions can be performed in an identical manner when the six-level driving method is used. However, the since scanning voltages and the signal voltages are different, the power supply circuit 138, X driver 140, and Y driver 148 according to the present embodiment need to be replaced with the power supply circuit 30, X driver 16, and Y driver 24 according to the first embodiment.

EIGHTH EMBODIMENT

A liquid crystal display panel according to the eighth embodiment will now be described.

The liquid crystal display panel according to the eighth embodiment is characterized by the addition of a polarity inversion control to the internal polarity inversion control according to the seventh embodiment. The added polarity inversion control is similar to the external polarity inversion control of the aforementioned second embodiment which forces polarity inversion.

Figure 14:
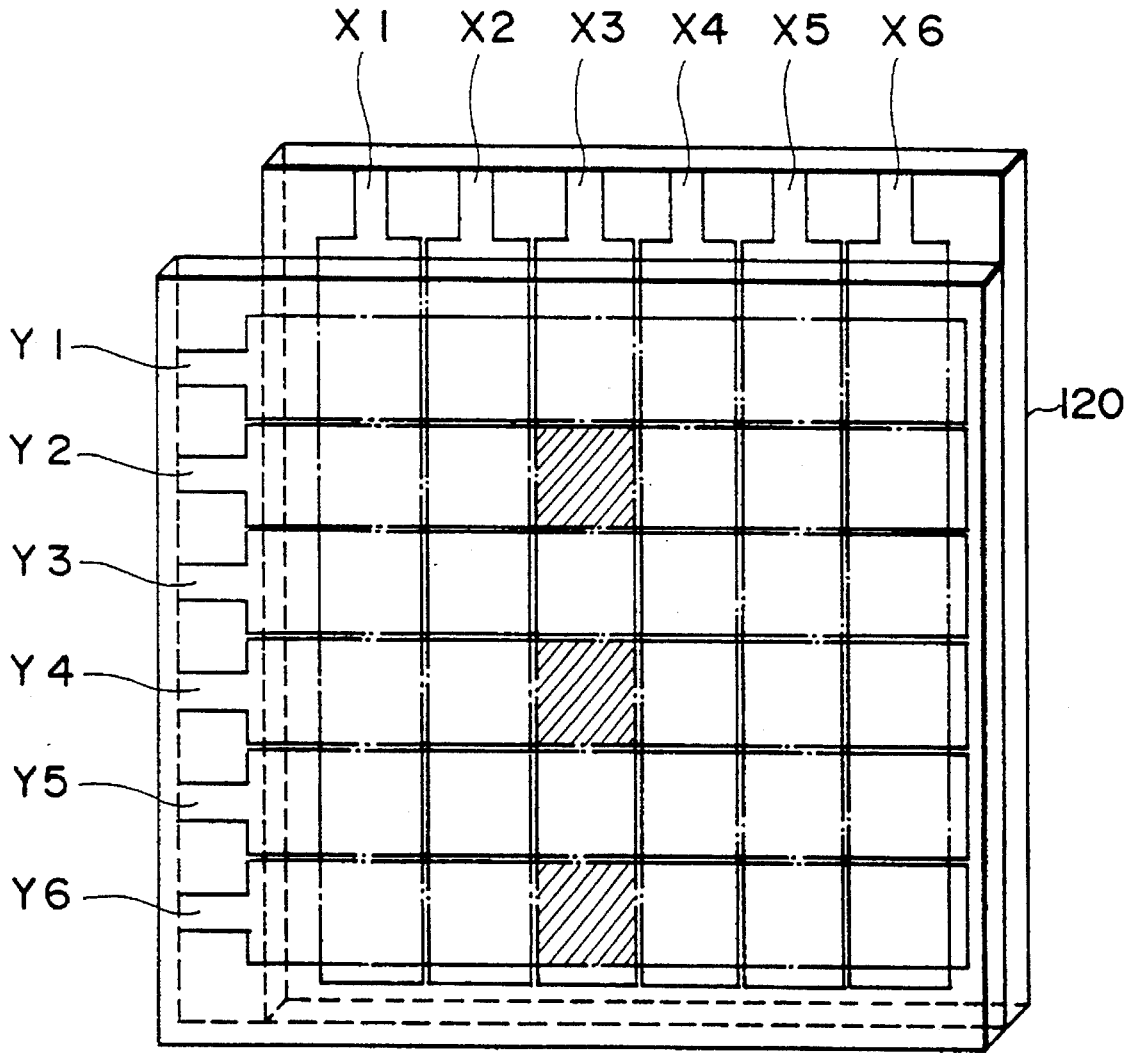
FIG. 14 is a diagram showing another example of the on/off-status of each pixel of the liquid crystal display panel.

FIG. 14 is a diagram showing a further example of the on/off-status of each pixel of the aforementioned liquid crystal display panel 120. Since the display pattern shown in the figure never satisfies the polarity inversion condition, polarity inversion does not take place at all. This means that the same off-voltage continues to be applied to signal electrodes X1, X2, X4, X5, and X6, which results in the application of a voltage with a relatively low frequency component to pixels on each of the signal electrodes. In general, since the transmittivity of each pixel of the liquid crystal display panel 120 depends on the frequency component of the application voltage, the transmittivity of pixels on the signal electrode X3 and that of pixels on other signal electrodes will be different, causing display unevenness.

To reduce display unevenness caused by the aforementioned difference in frequency components of the application voltage, the liquid crystal display device according to the present embodiment forces polarity inversion at a given intervals even if the inversion condition is not satisfied.

Figure 15:
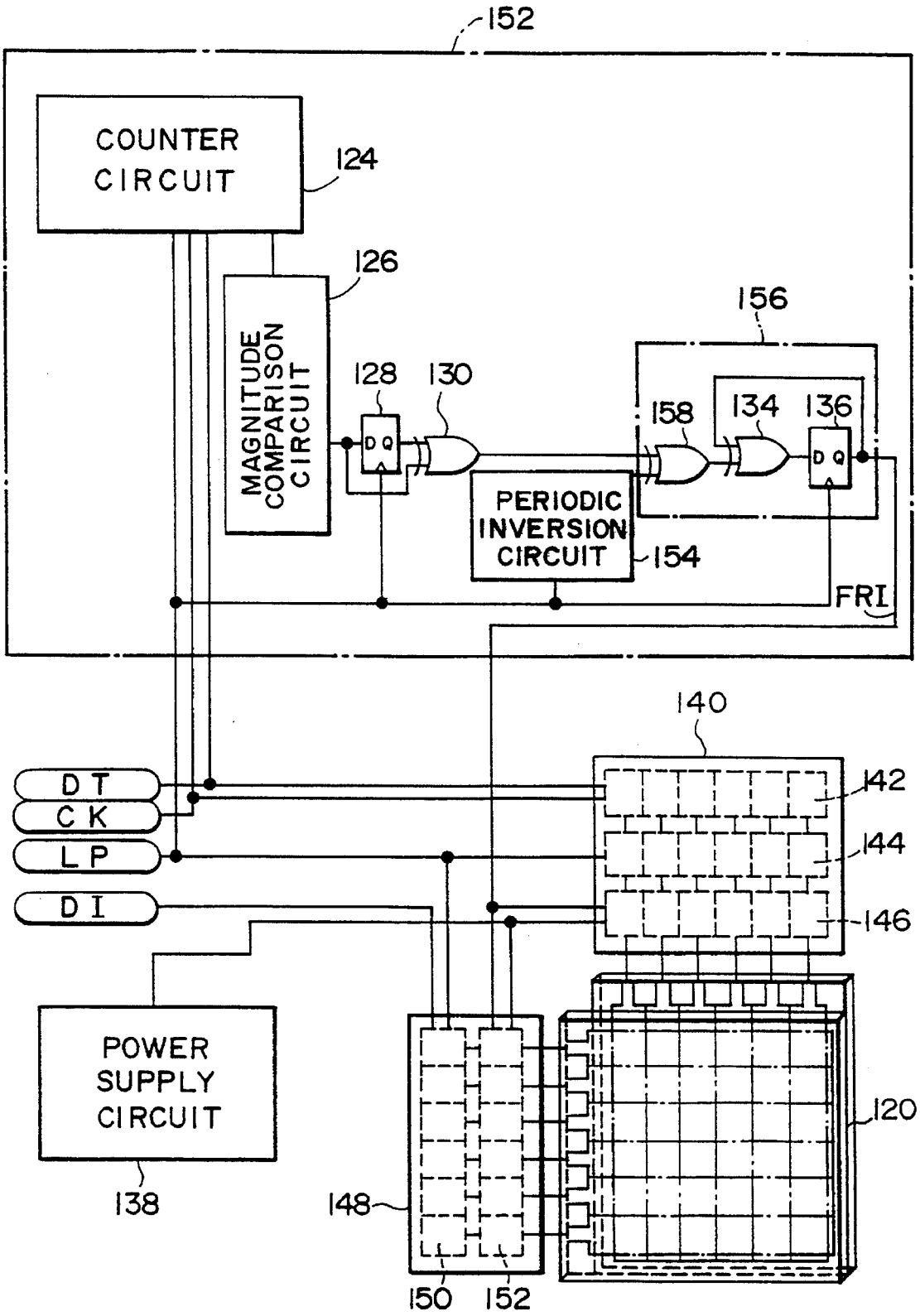
FIG. 15 is a diagram showing the configuration of the liquid crystal display device according to the eighth embodiment with forced polarity inversion.

FIG. 15 is a diagram of the liquid crystal display device according to the present embodiment which has the added function of forced polarity inversion. The liquid crystal display device shown in the figure comprises a liquid crystal display panel 120, X driver 140, Y driver 148, a power supply circuit 138, and a polarity inversion control circuit 152. The configuration is basically identical to the liquid crystal display panel according to the seventh embodiment shown in FIG. 11 except for the polarity inversion control circuit 152. The description of the liquid crystal display device according to the eighth embodiment will therefore focus on the polarity inversion control circuit 152, excluding the components common to the two embodiments.

The polarity inversion control circuit 152 comprises a counter circuit 124, a magnitude comparison circuit 126, a D-FF 128, an EX-OR gate 130, a periodic inversion circuit 154, and a polarity inversion circuit 156. In comparison with the polarity inversion control circuit 122 according to the seventh embodiment shown in FIG. 11, the polarity inversion control circuit 152 differs inasmuch as there is a periodic inversion circuit 154 at the output side of the EX-OR gate 130, and in replacing polarity inversion circuit 132 shown in FIG. 11 with the polarity inversion circuit 156.

The periodic inversion circuit 154, which comprises a mod-m counter, performs a counting operation synchronously with a latch pulse LP. The periodic inversion circuit 154 counts up synchronously with the latch pulse LP, and outputs a carry signal (="1") when the counted value reaches m-1. Therefore, the periodic inversion circuit 154 outputs a carry signal every time one cycle of supplying the selection voltage to m electrodes is completed.

The polarity inversion circuit 156, which comprises an EX-OR gate 134, a D-FF 136, and an OR gate 158, is configured to invert the output of the D-FF 136 when the aforementioned EX-OR gate 130 or a D-FF 136 outputs "1".

Therefore, even if the output of the EX-OR gate 130 does not become "1" with the inversion conditions not being satisfied the output of the periodic inversion circuit 154 is "1" at regular time intervals in order to force polarity inversions at each interval.

Thus, voltage distortions can be minimized to reduce the occurrence of display unevenness by adding a forced polarity inversion to the driving method which determines whether or not to perform polarity inversion corresponding to the nature of the image on the liquid crystal display panel 120.

The external polarity inversion control performed by the liquid crystal display device according to the second embodiment aims to force polarity inversions, which is essentially the same as the present embodiment. This means that it is possible to control the polarity inversion in the present embodiment in the same way as that in the liquid crystal display device according to the second embodiment, by replacing the EX-OR gate 50 of the second embodiment with an OR gate. Conversely, it is possible to control the polarity inversion in the second embodiment in the same way as that is in the liquid crystal display device of the present embodiment, by replacing the OR gate 158 of the present embodiment with an EX-OR gate.

NINTH EMBODIMENT

A liquid crystal display device according to the ninth embodiment will now be explained.

In the liquid crystal display device according to the seventh embodiment, polarity inversion occurs whenever the inversion conditions are satisfied. Therefore, depending on the patterns displayed, there may be situations when polarity inversions occur each time the scanning electrodes are switched. In such cases, it has been confirmed by experiments that display unevenness can be reduced by limiting the number of polarity inversions. For example, display unevenness can be reduced by ignoring one in every two polarity inversions. Display unevenness can also be reduced by inverting the polarity when inversion conditions are satisfied in the first frame and by ignoring polarity inversion one in every two inversions when the inversion conditions are satisfied in the second frame. Further variations in this rate are possible.

To reduce display unevenness by limiting polarity inversions as described in the foregoing, the liquid crystal display device according to the present embodiment ignores one polarity inversion for a given number of times the inversion condition is satisfied.

Figure 16:
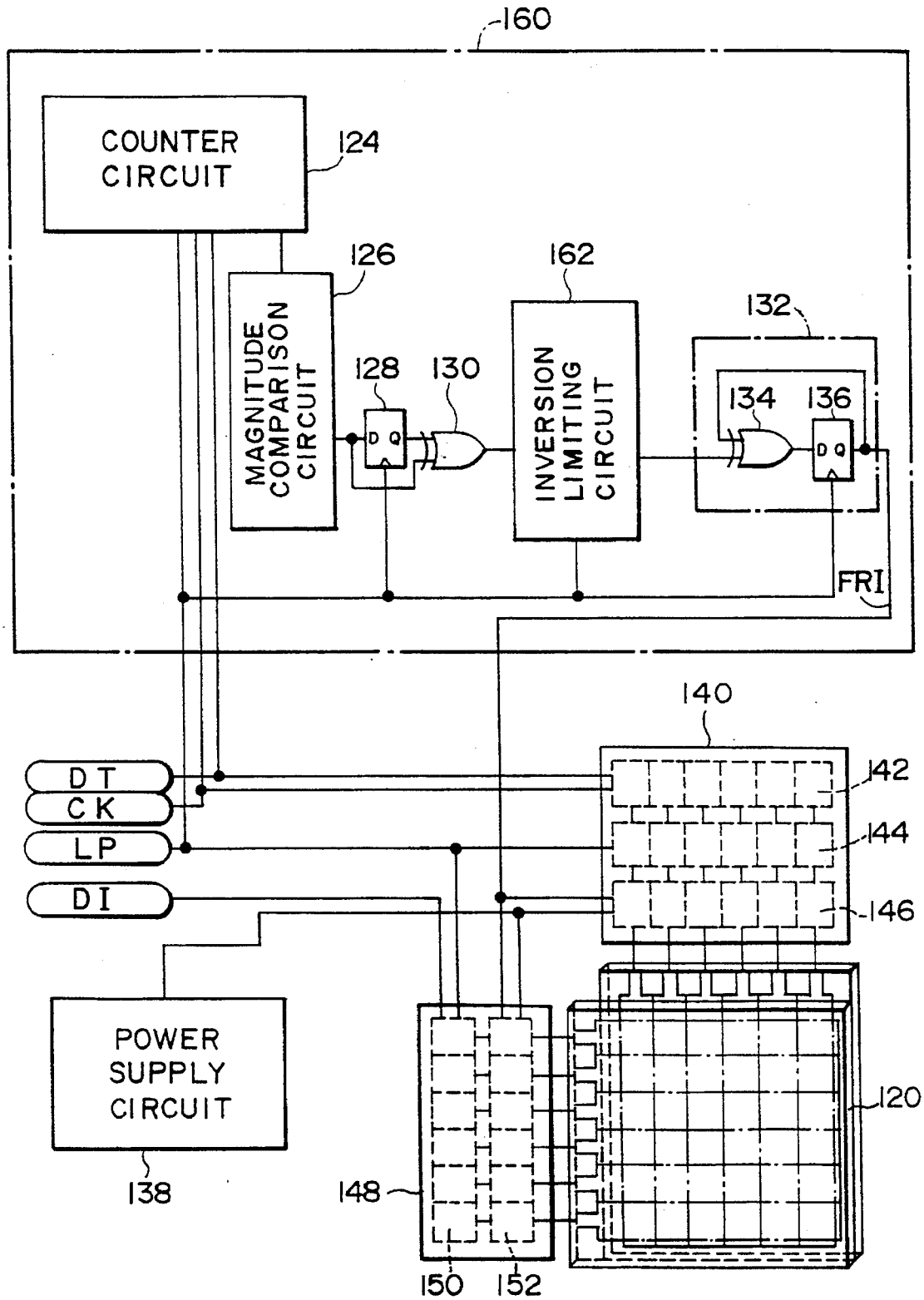
FIG. 16 is a diagram showing the configuration of the liquid crystal display device according to the ninth embodiment with restricted polarity inversion.

FIG. 16 is a diagram showing the configuration of the liquid crystal display device according to the present embodiment with limited polarity inversions. The liquid crystal display device in the figure comprises a liquid crystal display panel 120, X driver 140, Y driver 148, a power supply circuit 138, and a polarity inversion control circuit 160. It is basically identical to the liquid crystal display device according to the seventh embodiment shown in FIG. 11 except for the addition of the polarity inversion control circuit 160. Therefore, the following description will focus on the polarity inversion control circuit 160, omitting a description of the other common components.

The polarity inversion control circuit 160 comprises a counter circuit 124, a magnitude comparison circuit 126, a D-FF 128, an EX-OR gate 130, an inversion limiting circuit 162, and a polarity inversion circuit 132. It differs from the polarity inversion control circuit 122 of the first embodiment shown in FIG. 11 in that the inversion limiting circuit 162 is found between the EX-OR gate 130 and the polarity inversion circuit 132.

The inversion limiting circuit 162, which comprises a mod-n counter, performs a counting operation synchronized with a latch pulse LP. The inversion control circuit 162 counts up, synchronously with the latch pulse LP, only when the output of the EX-OR gate 130 is "1", and generates a carry signal (="1") when the counted value reaches n-1. Therefore, the output of the inversion limiting circuit 162 becomes "1" to invert the polarity only when there are n scanning electrodes which satisfy the inversion condition.

Thus, it is possible to minimize voltage distortion on the scanning electrodes and to reduce display unevenness by using a driving method which determines whether to invert the polarity depending on the image displayed by the liquid crystal display panel 120 and by applying a set limitation to the polarity inversions.

TENTH EMBODIMENT

A liquid crystal display device according to the tenth embodiment will now be described.

The liquid crystal display device according to the seventh embodiment determines whether to perform polarity inversion depending on whether or not the inversion condition is satisfied. Therefore, depending on the image displayed by the liquid crystal display panel 120, it is possible that the inversion condition is frequently satisfied and not satisfied as the selected scanning electrode changes. This will also result in frequent polarity inversion. The polarity inversions will reduce display unevenness on the display screen as a whole, but there may also be localized effects, such as sudden increases in brightness in previously dark areas. Considering the fact that human eyesight is not very sensitive to slow changes in brightness, and is sensitive to rapid change of brightness, the rapid change mentioned above is equally unacceptable as localized display unevenness, since they both lead to a deterioration in display quality.

To reduce the localized display unevenness caused by the abovementioned sudden brightness change, the frequency of polarity inversions in the liquid crystal display device according to the present invention is changed in stages corresponding to the number of times the inversion condition is satisfied during a given period of time. That is, focusing on the fact that shortening the period in which the polarity is inverted when the number of times the inversion condition has been satisfied has increased in one frame period, is almost equivalent to performing polarity inversions when the inversion condition is satisfied discretely. The frequency of polarity inversion in the liquid crystal display device is changed in stages corresponding to the number of times the inversion condition is satisfied in a given frame period.

Figure 17:
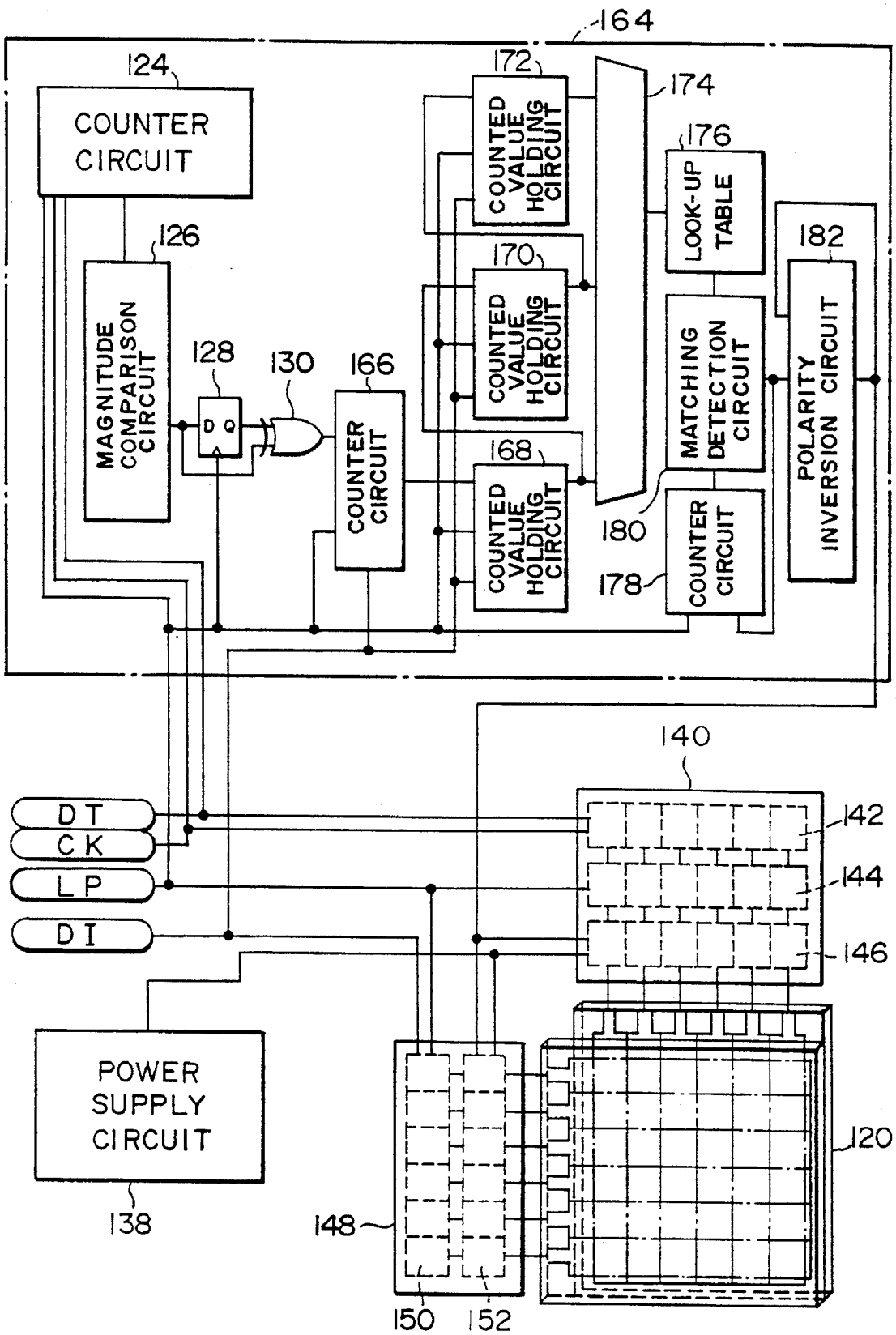
FIG. 17 is a diagram showing the configuration of the liquid crystal display device according to the tenth embodiment with the frequency of polarity inversion changed in steps.

FIG. 17 shows the configuration of a liquid crystal display device according to the present embodiment which changes the frequency of polarity inversions in a stepwise manner. The liquid crystal display device shown in FIG. 17 comprises a liquid crystal display panel 120, X driver 140, Y driver 148, a power supply circuit 138, and a polarity inversion control circuit 164. Since the configuration is basically the same as the liquid crystal display device according to the seventh embodiment shown in FIG. 11, except for the polarity inversion control circuit 164, the description of the liquid crystal display device according to the tenth embodiment omit the areas in common, and focus on the part that is different, the polarity inversion control circuit 164.

The polarity inversion control circuit 164 comprises a counter circuit 124, a magnitude comparison circuit 126, a D-FF 128, an EX-OR gate 130, a counter circuit 166, counted value holding circuit 168, 170, 172, a mean value calculating circuits 174, a look-up table 176, a counter circuit 178, a matching detection circuit 180, and a polarity inversion circuit 182. Comparing this with the polarity inversion control circuit 122 according to the seventh embodiment shown in FIG. 11, both configurations are identical in that the counter circuit 124, the magnitude comparison circuit 126, the D-FF 128, and the EX-OR gate 130, judge when the inversion condition is satisfied, but differ in the details of the subsequent polarity inversion process.

The counter circuit 166, which comprises a counter, counts up synchronously with the latch pulse LP when an output of EX-OR gate 130 inputted to an enable terminal is "1", and resets synchronously with a latch pulse LP when a data-in signal DI is "1".

Three counted value holding circuits 168, 170, and 172 take in and hold data DT synchronized with a latch pulse LP when a data-in signal DI is "1". The counted value holding circuit 168 takes in the counted value as data outputted from the counter circuit 166. The counted value holding circuit 170 takes in data held in the counted value holding circuit 168. Further, the counted value holding circuit 172 takes in data held in the counted value holding circuit 170. Three counted value holding circuits are described here but their number is arbitrary; it may be two, three, or more.

The data held in the counted value holding circuits 168, 170, and 172 act as inputs for mean value calculating circuit 174, which calculates the mean value of the three data. If there are multiple counted value holding circuits, it is acceptable, for example, to calculate the mean value of the outputs of counted value holding circuits at regular intervals, rather than averaging the output of all the circuits.

In addition, the weightings given to the data in calculating the mean value do not have to be equal. For example, the weightings can be one for the counted value holding circuit 168, two for the counted value holding circuit 170, and three for the counted value holding circuit 172. It can also be configured, for example, in two stages, making one input data item of the counted value holding circuit 172 the mean value of data held in the counted value holding circuits 168 and 170, thereby obtaining the mean value of the counted value holding circuits 168, 170 and 172.

The look-up table 176, which use as input the mean value calculated in the mean value calculating circuit 174, outputs one given data for each input mean value. The look-up table 176 which may be a ROM, for example, is configured to output smaller data for larger input mean values.

The counter circuit 178, which comprises a counter, counts up synchronously with a latch pulse LP. And, the counter circuit 178 is reset, synchronously with a latch pulse LP, corresponding to a matching detection signal outputted by the matching detection circuit 180.

The matching detection circuit 180 compares data outputted from the look-up table 176 with a counted value generated by the counter circuit 178, and outputs a matching detection signal if they are identical.

The polarity inversion circuit 182, which comprises a D-FF for example, accepts inverted output of the D-FF itself synchronized with a latch pulse LP when a matching detection signal is outputted (when the output signal is logic "1") from the matching detection circuit 180. The polarity inversion circuit 182 can comprise a D-FF having the inverted output as shown in FIG. 17, but it can also be composed of a combination of a D-FF and an EX-OR gate as shown in FIG. 11 if the D-FF output is not inverted.

The operation of the liquid crystal display device according to the present embodiment with the above configuration will now be explained.

The counter circuit 166 counts up when the output of the EX-OR gate 130 is "1" or when the inversion condition is satisfied, and is reset by data-in signal DI. Thus, the counter circuit 166 counts the number of times the inversion condition is satisfied in one frame period.

Next, the counted value holding circuit 168 holds the number of times, counted by the counter circuit 166, the inversion condition is satisfied in one frame period. At the same time, the counted value holding circuit 170 holds the number of times the inversion condition is satisfied in the previous frame. The counted value holding circuit 172 holds the number of times the inversion condition is satisfied in a frame, two frames prior to the current one.

The mean value calculating circuit 174 calculates and outputs the mean value for the three frames of the number of times the inversion condition is satisfied.

The look-up table 176 outputs one of given numbers corresponding to the mean value outputted from the mean value calculating circuit 174. More specifically, the look-up table 176 outputs a smaller value for a larger mean value input.

The counter circuit 178 outputs a counted value "0" when reset by a matching detection signal outputted from the matching detection circuit 180. The counter circuit 178 operates as a mod-(m+1) counter when a value m is outputted from the look-up table 176. Thus, the matching detection circuit 180 will output a matching detection signal "1", when the latch pulse LP is outputted (m+1) times.

As a result, the polarity inversion circuit 182 inverts the logic of the polarity inversion signal FRI to invert the polarity once every (m+1) times the latch pulse LP is outputted.

The polarity inversion control circuit 164 comprised by the liquid crystal display device according to the present embodiment increases the frequency of polarity inversions in a frame, since the period, in which the logic of polarity inversion signal FRI is inverted, is shortened as the number of times the polarity inversion condition is satisfied increases. Logic inversions of polarity inversion signal FRI, however, are performed gradually, even when the image displayed changes suddenly, since the period of inversion of the polarity inversion signal FRI logic changes according to the mean number of times the inversion condition is satisfied for a number of frames. Thus, localized display unevenness can be reduced without the occurrence of such events as dark areas suddenly becoming bright, since the period of the polarity inversion signal FRI approaches an optimal value gradually, even when the image displayed changes suddenly.

ELEVENTH EMBODIMENT

A liquid crystal display device according to the eleventh embodiment will now be explained.

In the aforementioned seventh through tenth embodiments, it was explained that the IHAT method was used in conjunction with the selection of a single scanning electrode. The eleventh embodiment is characterized by improvements made in the liquid crystal display device to reduce display unevenness when L ($L \geqq 2$) scanning electrodes are selected simultaneously.

FIG. 18 is a matrix diagram showing the combinations of selection voltages when L=3. Each row of the diagram corresponds to a scanning electrode. The symbols −V and +V represent scanning electrodes which have had selection voltages applied to them, while 0 represents a scanning electrode to which a non-selection voltage has been applied. Each column corresponds to time dependent variations of a selection or non-selection voltage applied to each scanning electrode. The combinations of the scanning voltages shown in the diagram are such that the sum of the squares of each element of the column vectors in the matrix is equal for all the column vectors, and the sum of the product of the corresponding elements corresponding in two different column vectors will be zero. In other words, the combinations are such that reciprocal column vectors are perpendicular to each other.

Selection voltages are applied sequentially to the scanning electrodes in accordance with the combinations established by the aforementioned matrix. Specifically, a selection voltage is applied to L scanning electrodes in the combination represented by the row vector in the first row of the matrix. Next, a selection voltage is applied to the next L scanning electrodes in accordance with the combination represented by the row vector in the second row. Selection voltages are applied in this way, L scanning electrodes at a time, until the last row vector of the matrix is reached, at which point the process returns to the row vector in the first row.

In parallel with the application of the said selection voltages, on-voltage and off-voltage are applied to each signal electrode. Specifically, the on-voltage and off-voltage to be applied to each signal electrode are determined as follows:

(i) For the L scanning electrodes to which a selection voltage is applied, it is defined that +1 corresponds to the selection voltage +V and that −1 corresponds to the selection voltage −V.

(ii) For each signal electrode which intersects with the L scanning electrodes to which the selection voltage is applied, it is also defined that −1 corresponds to the pixels in on-status and that +1 corresponds to the pixels in off-status.

(iii) For the pixels on each said signal electrode, the product of the pixel on/off-status and the status of the selection voltage of the scanning electrode which forms the pixel is calculated, and then the total sum of the products on the same signal electrode is calculated.

(iv) A voltage proportional to the total sum of the products calculated is applied to the signal electrode for which it was calculated. The product is either +1 or −1, so the total sum will have one of L+1 values, and an on-voltage or an off-voltage will be determined to correspond to each value. For example, when L=2, the total sum of the product may have one of three values; −2, 0 and +2. The on-voltage and off-voltage determined, therefore, will be −v, 0 and +v. When L=3, the total sum of the product may have one of four values; −3, −1, +1 and +3. The on-voltage and off-voltage, therefore, will be $-v_2$, $-v_1$, $+v_1$ and $+v_2$.

The on-voltage and off-voltage thus determined are applied to each signal electrode, making it possible to drive the liquid crystal display panel in which L scanning electrodes have been simultaneously selected.

A liquid crystal display device according to the eleventh embodiment will now be explained in detail using the example when L=2.

Figure 19:
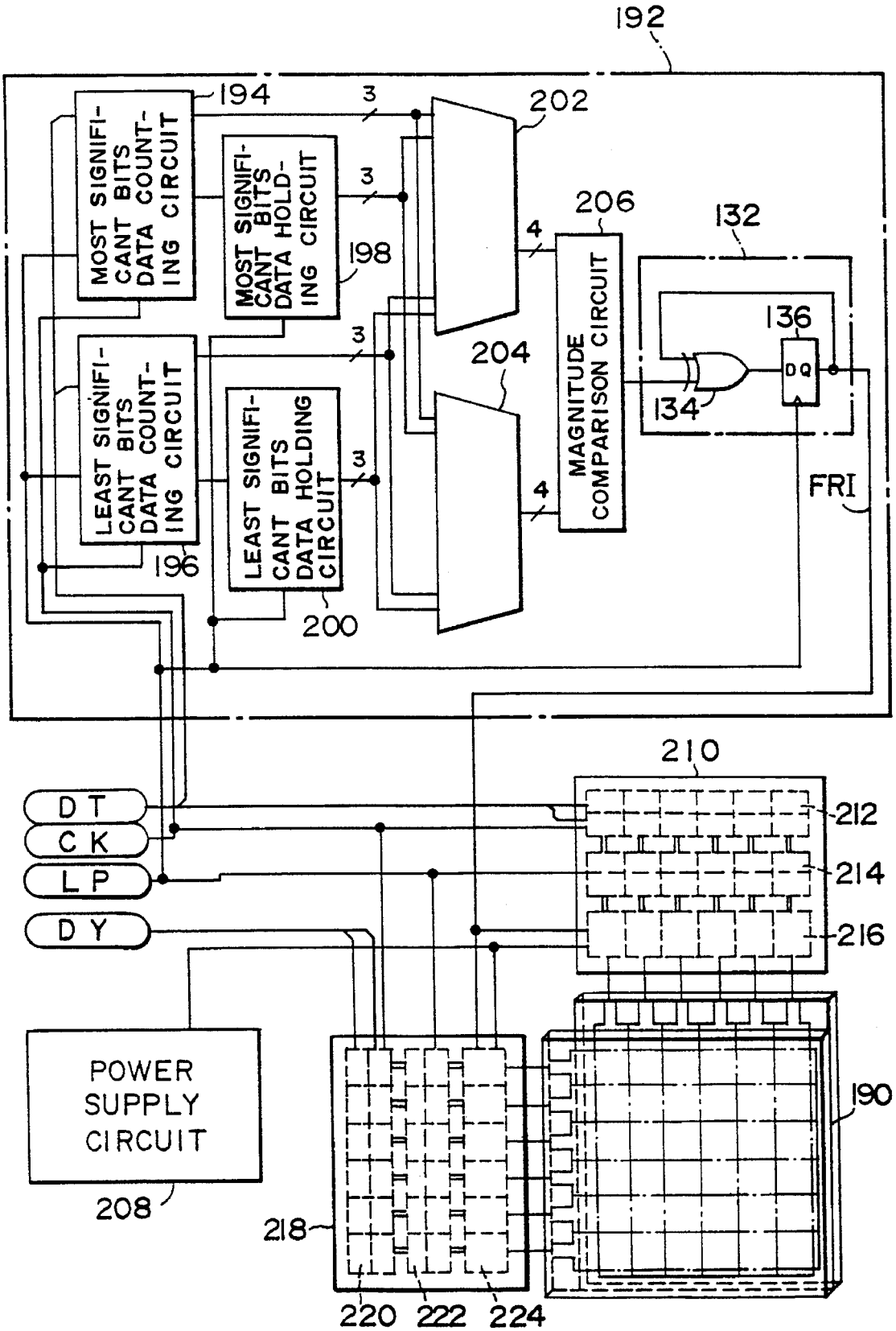
FIG. 19 is a diagram showing the configuration of the liquid crystal display device according to the eleventh embodiment.

FIG. 19 depicts the configuration of a liquid crystal display device according to the eleventh embodiment. The liquid crystal display device depicted in the diagram comprises a liquid crystal display panel 190 containing a given number of scanning and signal electrodes, X driver 210 and Y driver 218 which apply the driving voltage to liquid crystal panel 190, power supply circuit 208 which generates a given voltage, and a polarity inversion control circuit 192 which controls polarity inversion in accordance with the on/off-status of the pixels on liquid crystal display panel 190.

Figure 20:
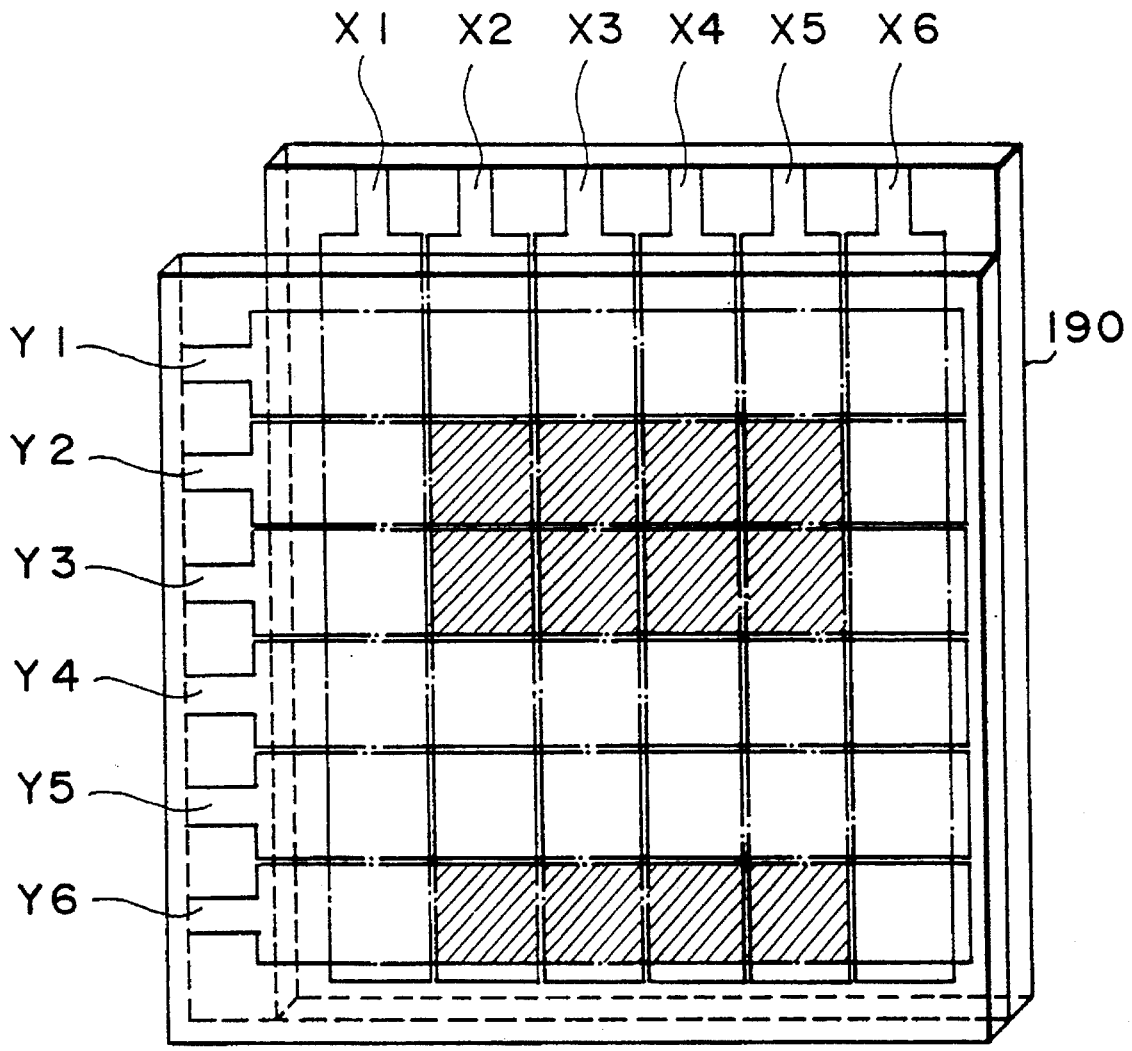
FIG. 20 is a diagram showing an example of the on/off-status of each pixel of the liquid crystal display panel according to the eleventh embodiment.

FIG. 20 gives an example of the on/off-status of pixels in said liquid crystal display panel 190. The basic configuration of liquid crystal display panel 190 is the same as for the liquid crystal display panel 120 according to the seventh embodiment depicted in FIG. 12. The pixels in FIG. 20 which are marked with cross-hatching represent on-status pixels, and the remainder represent off-status pixels.

X driver 210 applies on-voltages and an off-voltage −v, 0 and +v (when L=2) to each of signal electrodes X1 to X6 of the liquid crystal display panel 190. X driver 210 comprises shift register circuit 212, latch circuit 214, and level shifter circuit 216.

Shift register circuit 212 has a capacity of 2×6 bits, and shifts sequentially inputted two-bit data six at a time. Each of the two-bit data indicates whether the pixels formed by the corresponding signal electrode and two scanning electrodes are in on-status or off-status. Latch-circuit 214 temporarily holds each of the six two-bit data outputted from shift register circuit 212, and has the same capacity as the data; 2×6 bits.

Level shifter circuit 216 determines the voltage levels appropriate to each of the six two-bit data outputted from latch circuit 214, and for each signal voltage for the liquid crystal panel 190, applies that voltage so determined as either an on-voltage or an off-voltage. Specifically, because the on-voltage and off-voltage are one of −v, 0 or +v, level shifter circuit 216 selects the appropriate voltage from among them and applies it to each of the signal electrodes of liquid crystal display panel 190.

Y driver 218 applies a selection voltage or a non-selection voltage to each of the scanning electrodes Y1 to Y6 of liquid crystal display panel 190. In this embodiment, because we are considering the case when L=2, a selection voltage is applied simultaneously to two scanning electrodes and a non-selection voltage is applied to the remaining scanning electrodes. Y driver 218 comprises a shift register circuit 220, latch circuit 222, and level shifter circuit 224.

Shift register circuit 220 has a capacity of 2×6 bits, and shifts sequentially input two-bit data six at a time. The two-bit data indicate the selection voltage applied to the two simultaneously selected scanning electrodes. For example, 10 corresponds to +V, and 01 corresponds to −V. Similarly, 00 corresponds to non-selection voltage 0 V.

Latch circuit 222 temporarily holds each of the six two-bit data outputted from shift register circuit 220, and has the same capacity as the data; 2×6 bits.

Level shifter circuit 224 determines the voltage levels corresponding to each of the six two-bit data outputted from latch circuit 222, and applies either of the two selection voltages or a non-selection voltage to liquid crystal panel 190.

Power supply circuit 208 applies −v, 0 or +v voltages to X driver 210 as signal voltages, and −V, 0 or +V voltages to Y driver 218 as scanning voltages.

In response to the pattern of characters and figures displayed on liquid crystal display panel 190, and specifically, at the point at which the two simultaneously selected scanning electrodes switch, polarity inversion control circuit 192 compares the total sum of the relative voltage changes of the signal electrodes measured from the non-selection voltage when polarity is inverted, and the total sum of the relative voltage changes of the signal electrodes measured from the non-selection voltage when the polarity is not inverted, and when the former is the smaller, inverts the polarity. This way, voltage distortion generated on the un-selected scanning electrodes is suppressed, and it becomes possible to reduce display unevenness.

Polarity inversion control circuit 192 comprises most significant bits data counting circuit 194, least significant bits data counting circuit 196, most significant bits data holding circuit 198, least significant bits data holding circuit 200, non-inversion case arithmetic circuit 202, inversion case arithmetic circuit 204, magnitude comparison circuit 206, and polarity inversion circuit 132.

Most significant bits data counting circuit 194 is reset synchronously with latch pulse LP, and only when the significant bit of the two-bit data DT input is 1, does it count synchronously with clock signal CK. Similarly, least significant bits data counting circuit 196 is reset synchronously with latch pulse LP, and only when the least significant bit of the two-bit data DT input is 1, does it count synchronously with clock signal CK.

Most significant bits data holding circuit 198 comprises a multiple bit (in this embodiment, three bits) D-FF, and synchronously with latch pulse LP, takes in and holds the result of the calculations of most significant bits data counting circuit 194. Similarly, least significant bits data holding circuit 200 comprises a multiple bit D-FF, and synchronously with latch pulse LP, takes in and holds the result of the calculations of least significant bits data counting circuit 196.

Non-inversion case arithmetic circuit 202 comprises, for example, a gate array, and calculates the total sum of the relative voltage changes of the signal electrodes measured from the non-selection voltage when the polarity is not inverted on the basis of the results calculated by most significant bits data counting circuit 194 and least significant bits data counting circuit 196 and the contents of the most significant bits data holding circuit 198 and least significant bits data holding circuit 200. Similarly, inversion case arithmetic circuit 204 comprises, for example, a gate array, and calculates the total sum of the relative voltage changes of the signal electrodes measured from the non-selection voltage when the polarity is inverted, on the basis of the results calculated by most significant bits data counting circuit 194 and least significant bits data counting circuit 196 and the contents of the most significant bits data holding circuit 198 and least significant bits data holding circuit 200.

Magnitude comparison circuit 206 receives as input the results of calculations by non-inversion case arithmetic circuit 202 and inversion case arithmetic circuit 204, and compares the magnitude of the two results. Magnitude comparison circuit 206 assigns the logic 1 to the output signal when the result calculated by non-inversion arithmetic circuit 202 is greater than the result calculated by inversion case arithmetic circuit 204. In the opposite case it assigns the logic 0 to the output signal.

Polarity inversion circuit 132 inverts the logic of the polarity inversion signal in accordance with the results of the comparison carried out by magnitude comparison circuit 206, and, specifically, when the logic of the output signal from magnitude comparison circuit 206 is 1, it inverts the logic of polarity inversion signal FRI. Polarity inversion circuit 132 itself is the same as the circuit according to the seventh embodiment depicted in FIG. 11, and comprises EX-OR gate 134 and D-FF 136.

The actual operation of a liquid crystal display device with the said configuration will now be explained.

FIG. 21 is a matrix diagram showing combinations of the selection voltages when L=2. Each row of the matrix depicts the status of the selection voltages applied to the scanning electrodes, while each column depicts the changes over time of the scanning voltage application status. As shown in the diagram, the scanning electrodes of liquid crystal display panel 190 are selected two at a time.

Specifically, simultaneous with the first −V selection voltage being applied to scanning electrode Y1, +V selection voltage is applied to scanning electrode Y2 and non-selection voltage OV is applied to the remaining Y3 to Y6 scanning electrodes. Similarly, when selection voltages −V and +V are applied to Y3 and Y4, they are then applied to Y5 and Y6. In this fashion, when the application of the scanning voltages to the first frame is completed, the selection voltages +V and −V represented by the line vector of the fourth line of the matrix are applied to each of Y1 and Y2, Y3 and Y4, and Y5 and Y6.

Next, for each signal electrode, the product of the pixel on/off-status and the status of the selection voltage of the scanning electrode which forms the pixel is calculated, and when the total sum of the products of similar signal electrodes is calculated the results are as shown in (i) to (iii). For the display pattern of liquid crystal display panel 190 depicted in FIG. 20, the said total sums of the products are the same for signal electrodes X1 and X6, and for signal electrodes X2 to X5. For this reason, calculations are performed for signal electrodes X1 and X2.

(i) When selection voltages are being applied to scanning electrodes
Y1 an d Y2 in frame 1:
The total sum for signal electrode X1 is 0

The total sum for signal electrode X2 is 0

(ii) When selection voltages are being applied to scanning electrodes
Y3 and Y4 in frame 1:
The total sum for signal electrode X1 is 0
The total sum for signal electrode X2 is 2

(iii) When selection voltages are being applied to scanning electrodes
Y5 and Y6 in frame 1:
The total sum for signal electrode X1 is 0
The total sum for signal electrode X2 is 0.

Conversely, consider the hypothetical situation whereby liquid crystal display panel 190 is driven by a line vector for which the elements of each line vector in the matrix being multiplied by −1 (The situation corresponds to polarity inversion. Hereafter, this type of line vector will be referred to as "an inverted line vector".) Repeating the said calculations:

(i) When selection voltages are being applied to scanning electrodes
Y1 and Y2 in frame 1:
The total sum for signal electrode X1 is 0
The total sum for signal electrode X2 is 2

(ii) When selection voltages are being applied to scanning electrodes
Y3 and Y4 in frame 1:
The total sum for signal electrode X1 is 0
The total sum for signal electrode X2 is 0

(iii) When selection voltages are being applied to scanning electrodes
Y5 and Y6 in frame 1:
The total sum for signal electrode X1 is 0
The total sum for signal electrode X2 is 2.

As shown in the foregoing, when an inverted line vector is not used (when polarity is not inverted), and selection voltages are applied to scanning electrodes Y1 and Y2 of frame 1, then the total sum of signal electrodes X2 to X5 is 0. Further, when selection voltages are applied to scanning electrodes Y3 and Y4 of frame 1, then the total sum of the signal electrodes X2 to X6 is 2. Consequently, when the scanning electrodes selected switch from Y1 and Y2 to Y3 and Y4, a voltage change corresponding to a total sum variation of 2 is generated in signal electrodes X2 to X5. In other words, for all of the signal electrodes X2 to X5, the total of voltage changes of signal electrodes becomes four times the total sum variation of 2.

Conversely, when selection voltages are applied to scanning electrodes Y3 and Y4 of frame 1, and an inverted line vector is used (when polarity is inverted), the total sum variation for all signal electrodes becomes 0, and the total of voltage changes of the signal electrodes is 0.

In these circumstances, therefore, an inverted line vector is used and polarity is inverted. Generally, the difference in voltage change of each signal electrode—in other words, the total difference in total sum—is noted, and when the selected scanning electrodes are switched, and the said total derived when an inverted line vector is used is smaller than the said total when one is not used, then polarity inversion control comes into effect.

A more concrete depiction of the relationship is as follows.

When a certain line vector is used and the total sum of the product of the on/off-status of a certain pixel and the selected scanning electrodes is −2, 0 and +2, and then an inverted line vector is used and the said total sum of the product becomes +2, 0 and −2, then each of the symbols are inverted. When the two selected scanning electrodes switch, the following values N1 to N9 and MU, ML, NU, and NL are defined.

N1: the number of signal electrodes which will maintain a signal voltage of +v

N2: the number of signal electrodes which will change from a signal voltage of +v to 0 V N3: the number of signal electrodes which will change from a signal voltage of +v to −v N4: the number of signal electrodes which will change from a signal voltage of 0 V to +v N5: the number of signal electrodes which will maintain a signal voltage of 0 V N6: the number of signal electrodes which will change from a signal voltage of 0 V to −v N7: the number of signal electrodes which will change from a signal voltage of −v to +v N8: the number of signal electrodes which will change from a signal voltage of −v to 0 V N9: the number of signal electrodes which will maintain a signal voltage of −v MU: the number of signal electrodes which had a signal voltage of +v applied to them prior to the selected scanning electrodes switching ML: the number of signal electrodes which had a signal voltage of −v applied to them prior to the selected scanning electrodes switching NU: the number of signal electrodes which had a signal voltage of +v applied to them after the selected scanning electrodes switched NL: the number of signal electrodes which had a signal voltage of −v applied to them after the selected scanning electrodes switched Defined thus, the following relationships emerge:

MU=N1+N2+N3; ML=N7+N8+N9; NU=N1+N4+N7; NL=N3+N6+N9.

It also becomes possible to represent the total change amount in signal voltages when the selection of the scanning electrodes switches as follows:

$$N2+2N3-N4+N6-2N7-N8$$

This relationship may be further represented as follows:

$$(N1+N2+N3)-(N7+N8+N9)-(N1+N4+N7)+(N3+N6+N9)$$

The contents of the brackets may be replaced respectively with MU, ML, NU and NL, giving:

$$MU-ML-NU+NL$$

If, when the selection of the scanning electrodes switches, and if the polarity of the selection voltage after the switch is taken to have inverted, the symbol of the aforementioned total sum of the product will invert, and the polarity of the voltage applied to the signal electrode will invert. Thus, the aforementioned N1 to N9, MU, ML, NU, and NL will be as follows:

N1: the number of signal electrodes which will change from a signal voltage of +v to −v N2: the number of signal electrodes which will change from a signal voltage of +v to 0 V N3: the number of signal electrodes which will maintain a signal voltage of +v N4: the number of signal electrodes which will change from a signal voltage of 0 V to −v N5: the number of signal electrodes which will maintain a signal voltage of 0 V N6: the number of signal electrodes which will change from a signal voltage of 0 V to +v N7: the number of signal electrodes which will maintain a signal voltage of −v N8: the number of signal electrodes which will change from a signal voltage of −v to 0 V N9: the number of signal electrodes which will change from a signal voltage of −v to +v From the foregoing, it is possible to represent the total change amount in signal voltages when the selection of the scanning electrodes changes, as:

$$MU-ML+NU-NL$$

It is therefore possible to calculate the difference in the absolute values of the total change amount in signal voltages when polarity inversion does not occur (MU−ML−NU+NL) and the total change amount in signal voltages when polarity inversion does occur (MU−ML+NU−NL) by counting MU, ML, NU and NL.

Hereafter the absolute value of the total change amount in signal voltages when polarity inversion does not occur (MU−ML−NU+NL) will be referred to as "change amount at non-inversion", and the absolute value of the total change amount in signal voltage when polarity inversion does occur (MU−ML+NU−NL) will be referred to as "change amount at inversion".

Figure 22:
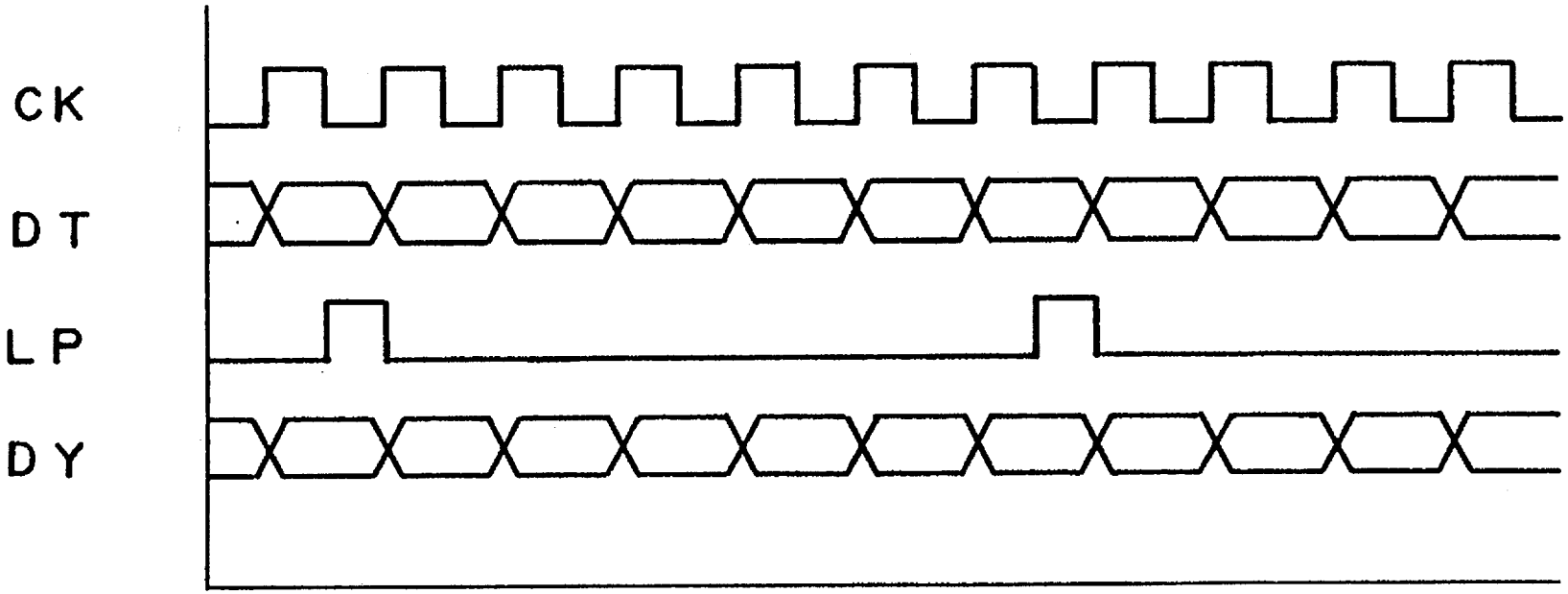
FIG. 22 is a diagram showing the timing of the operations of the liquid crystal display device according to the eleventh embodiment.
Figure 23:
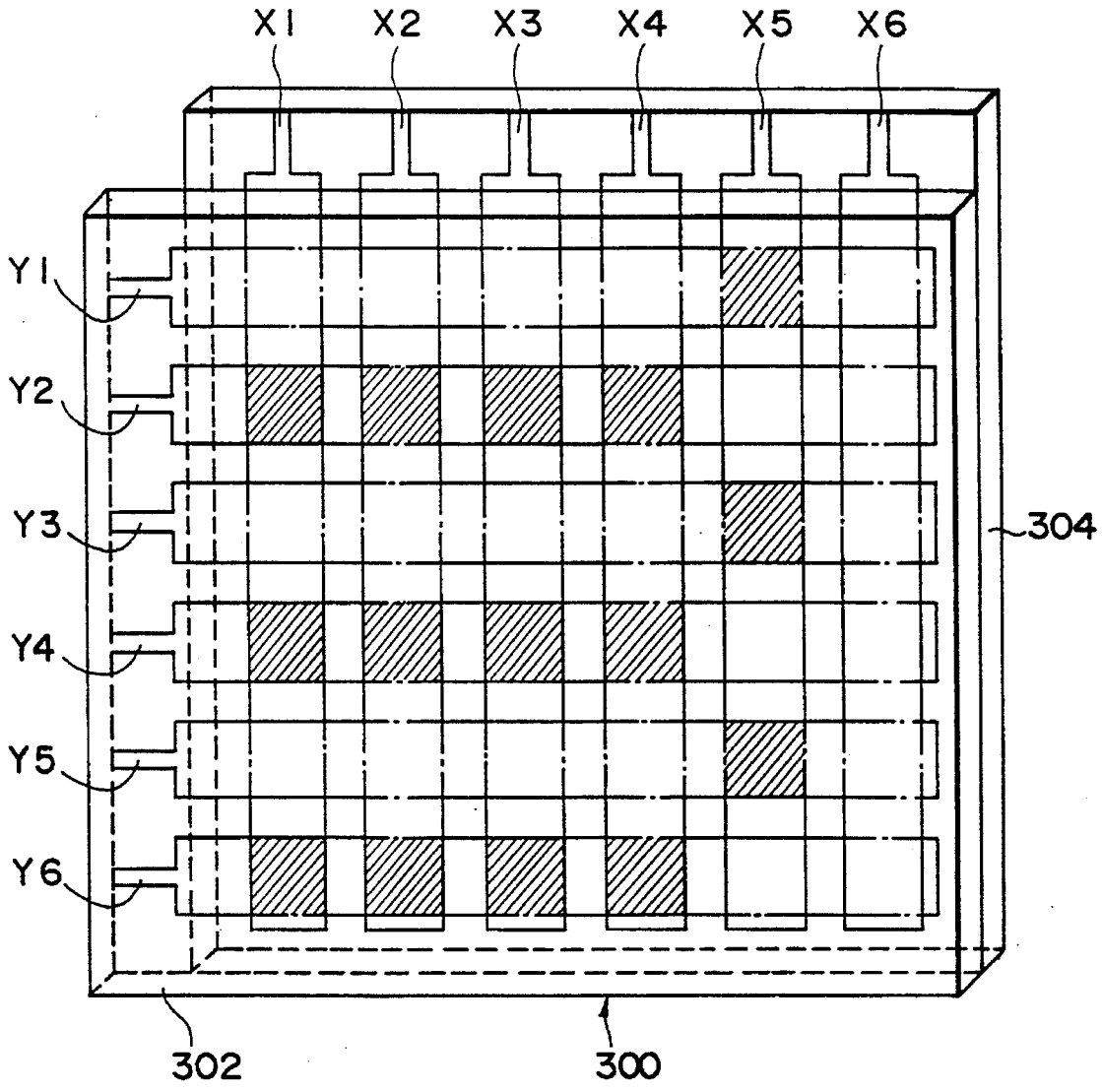
FIG. 23 is a diagram showing the configuration and display image of a conventional liquid crystal display panel.
Figure 24A:
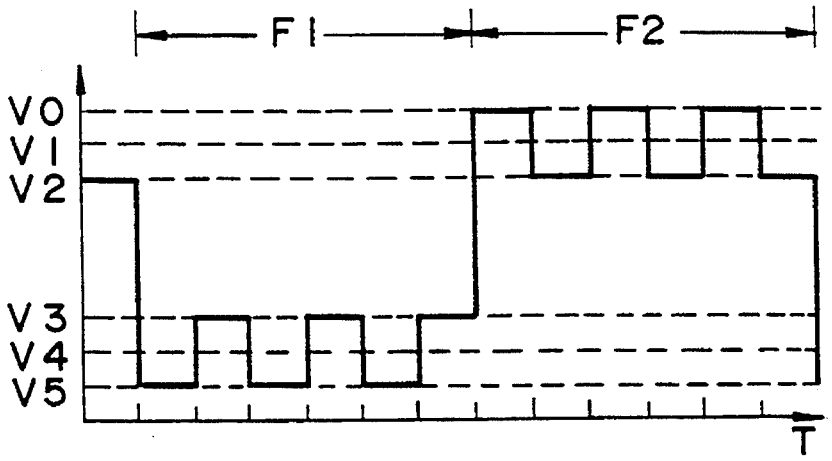
FIGS. 24A through 24C are diagrams showing examples of conventional driving waveforms.
Figure 24B:
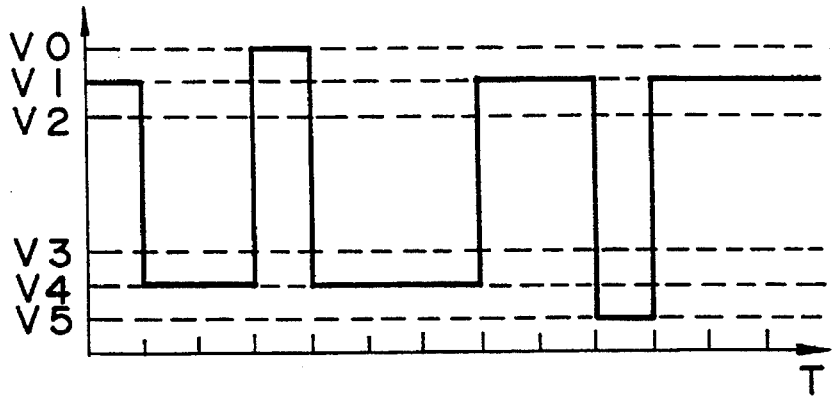
Figure 24C:
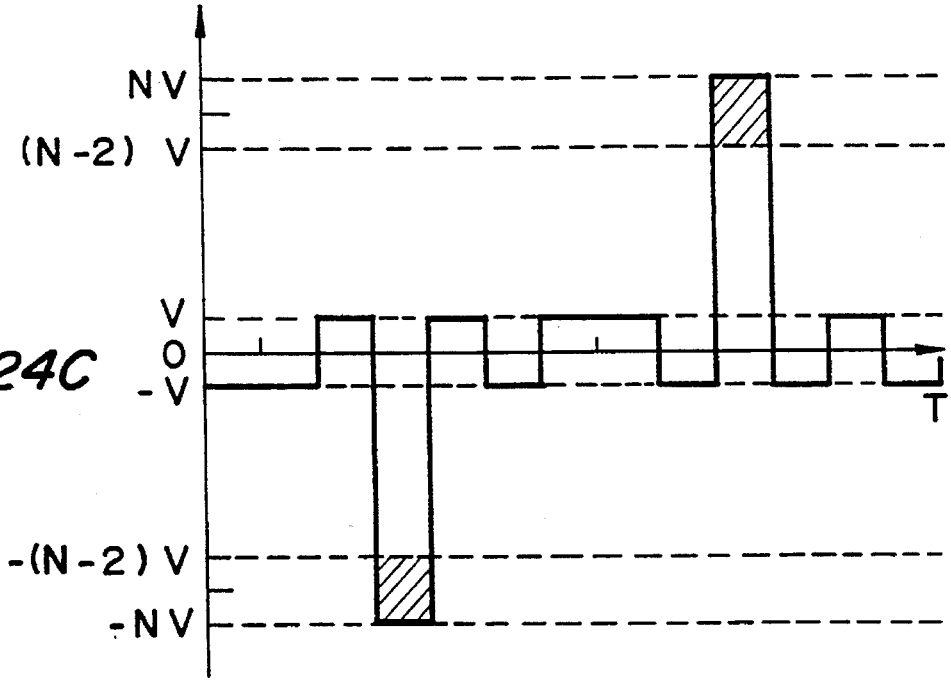
Figure 25A:
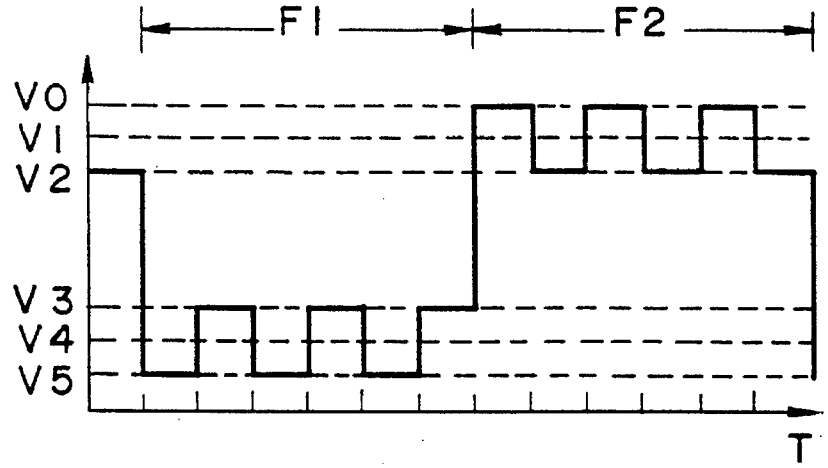
FIG.25A PRIOR ART
FIGS. 25A through 25C are diagrams showing examples of conventional driving waveforms.
Figure 25B:
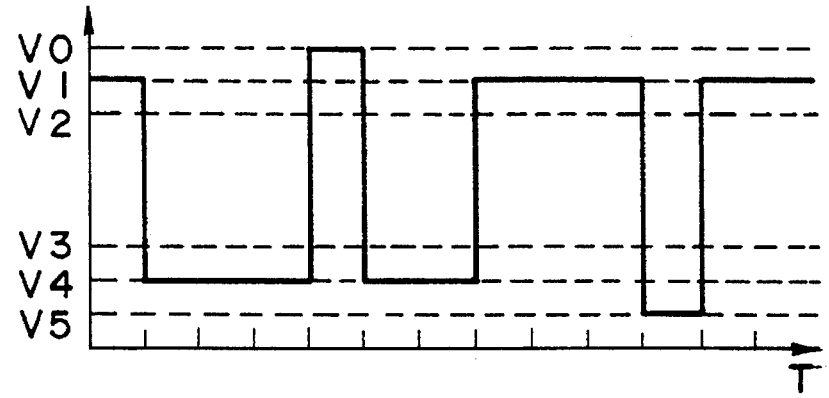
FIG.25B PRIOR ART
Figure 25C:
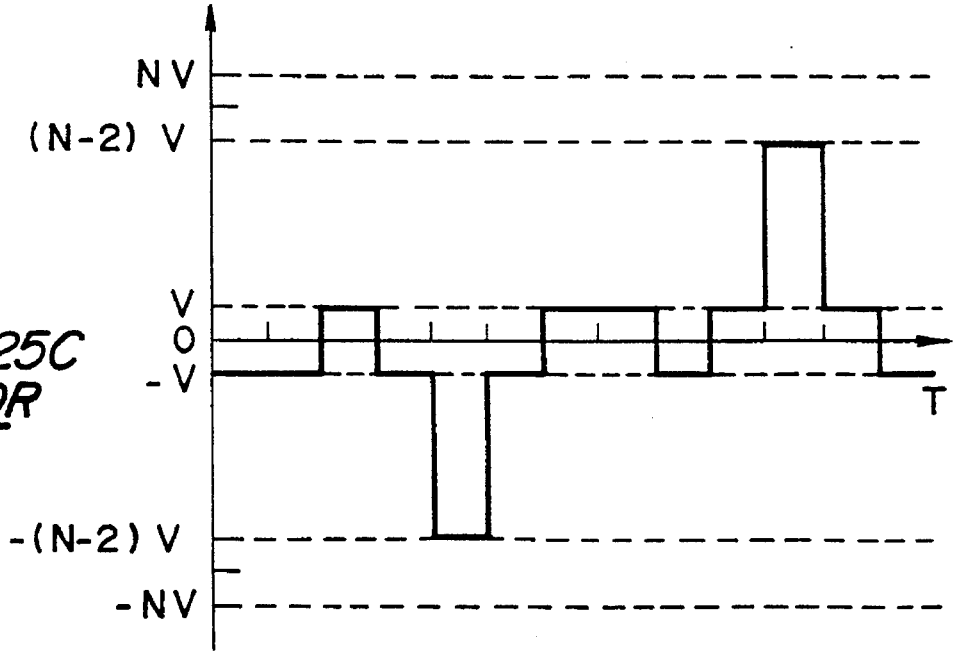
FIG.25C PRIOR ART

FIG. 22 depicts the timing of the operation of the eleventh embodiment liquid crystal display device. The following is a detailed explanation, with reference to FIG. 22, of the operation of the liquid crystal display device shown in FIG. 19.

After shift register circuit 212 in X driver 210 is reset synchronous with the fall of latch pulse LP, synchronous with the fall of clock signal CK, both take in the two-bit data DT. The data DT taken in are shifted two-bits at a time synchronous with the clock signal CK. When the same number of two-bit data as the six signal electrodes of liquid crystal display panel 190 are taken into shift register circuit 212, latch circuit 214 which operates synchronous with latch pulse LP takes in and holds the two-bit data corresponding to each signal electrode and stored within shift register circuit 212.

Level shifter circuit 216 applies one of −v, 0 or+v on-voltage or off-voltage to each signal electrode of liquid crystal display panel 190 in response to the two-bit data held in latch circuit 214 and the logic status of the polarity inversion signal FRI input at the time from polarity inversion control circuit 192. Specifically, level shifter circuit 216 applies a voltage of +v to each of the signal electrodes when the logic of the polarity inversion signal FRI is 0 and the most significant bit of the two-bit data held in latch circuit 214 is 1. When the logic of the polarity inversion signal FRI is 0 and the least significant bit of the two-bit data is 1 it applies a voltage of −v, and when the logic of the polarity inversion signal FRI is 0 and both bits of the two-bit data are 0 it applies a voltage of 0 V.

In contrast, when the logic of the polarity inversion signal FRI is 1, and the most significant bit of the two-bit data held in latch circuit 214 is 1, the voltage level shifter circuit 216 applies to each of the signal electrode a voltage −v. When the logic of the polarity inversion signal FRI is 1 and the least significant bit of the two-bit data is 1, the voltage applied is +v, and when the logic of the polarity inversion signal FRI is 1 and both bits of the two-bit data are 0, the voltage applied is 0 V.

In parallel with the operation of the said X driver 210, shift register circuit 220 in Y driver 218 takes in the two-bit scanning data DY which determines the two scanning electrodes to be selected, synchronous with clock signal CK. The scanning data DY taken in is shifted two-bits at a time synchronous with clock signal CK. When the same number of two-bit data as the six signal electrodes of liquid crystal display panel 190 are taken into shift register circuit 220, latch circuit 222 which operates synchronous with latch pulse LP takes in and holds the two-bit data corresponding to each signal electrode and stored within shift register circuit 220.

Level shifter circuit 224 applies one of−V or +V selection voltages or 0 V non-selection voltage to each scanning electrode of liquid crystal display panel 190 in response to the two-bit data held in latch circuit 222 and the logic status of the polarity inversion signal FRI input at the time from polarity inversion control circuit 192. Specifically, level shifter circuit 224 applies a selection voltage of +V to each of the scanning electrodes when the logic of the polarity inversion signal FRI is 0 and the most significant bit of the two-bit data held in latch circuit 222 is 1. When the logic of the polarity inversion signal FRI is 0 and the least significant bit of the two-bit data is 1 it applies a selection voltage of −V, and when the logic of the polarity inversion signal FRI is 0 and both bits of the two-bit data are 0 it applies a non-selection voltage of 0 V. In contrast, when the logic of the polarity inversion signal FRI is 1, and the most significant bit of the two-bit data held in latch circuit 222 is 1, the selection voltage level shifter circuit 224 applies to each of the scanning electrodes is −V. When the logic of the polarity inversion signal FRI is 1 and the least significant bit of the two-bit data is 1, the selection voltage applied is +V, and when the logic of the polarity inversion signal FRI is 1 and both bits of the two-bit data are 0, the non-selection voltage 0 V is applied.

The operation in this fashion of X driver 210 and Y driver 218 first causes a selection voltage of −V to be applied to scanning electrode Y1, a selection voltage of +V to be applied to scanning electrode Y2, and non-selection voltages of 0 V to be applied to the remaining scanning electrodes, as shown in FIG. 21. At that point it becomes possible to determine the signal voltages applied to each signal electrode X1 to X6 by calculating the product and total sum for each pixel, given that scanning electrodes −V and +V are set at −1 and +1 respectively, and the on-status and off-status pixels are set at −1 and +1 respectively.

In other words, calculating the said product and total sum of the signal electrodes X1 and X6 gives the following:

$$(-1)\times(+1)+(+1)\times(+1)=0$$

Consequently, 0 V is applied to the signal electrodes as an off-voltage.

Polarity inversion control circuit 192 judges whether or not to invert polarity concurrent with this basic display operation, and when polarity is to be inverted, it inverts the logic of polarity inversion signal FRI. A detailed explanation of the operation of polarity inversion control circuit 192 follows.

First, most significant bits data counting circuit 194 is reset synchronous with latch pulse LP, and only when the most significant bit of the data DT is 1, counts up synchronous with clock signal CK. Thus, when all six two-bit data DT corresponding to the signal electrodes have been input, most significant bits data counting circuit 194 outputs the number of data DT which have 1 as the most significant bit, or in other words, outputs the MU value as a count value.

Similarly, least significant bits data counting circuit 196 outputs ML as a count value.

Next, most significant bits data holding circuit 198 takes in and holds the count value from most significant bits data counting circuit 194 synchronous with the latch pulse LP. In other words, most significant bits data counting circuit 198 takes in the MU value output as a count value and holds it as an NU value. Similarly, least significant bits data holding circuit 200 takes in the count value (ML value) of least significant bits data counting circuit 196 and holds it as an NL value.

Next, non-inversion case arithmetic circuit 202 calculates the absolute value of MU−ML+NU−NL from the MU, ML, NU and NL values output from most significant bits data counting circuit 194, least significant bits data counting circuit 196, most significant bits data holding circuit 198, and least significant bits data holding circuit 200, and outputs the variation amount at non-inversion. Similarly, inversion case arithmetic circuit 204 calculates the absolute value of MU−ML−NU+NL, and outputs the variation amount at inversion.

The variation amount at non-inversion output from non-inversion case arithmetic circuit 202, and the variation amount at inversion output from inversion case arithmetic circuit 204 are input to magnitude comparison circuit 206, which compares the magnitude of the two inputted values. When the variation amount at non-inversion is larger than the variation amount at inversion, it outputs a comparison result of 1.

Polarity inversion circuit 132 inverts the logic of the polarity inversion signal FRI from 1 to 0, or from 0 to 1 synchronous with the latch pulse LP when the result of comparison by magnitude comparison circuit 206 is 1.

In this fashion polarity inversion control circuit 192 controls inversion when the selected scanning electrodes switch, such that when the total sum of voltage variations of voltages of the signal electrodes becomes smaller, the electrodes for which polarity has been inverted have their polarity inverted, and do not when that total sum becomes larger.

The said means of control ensures that the total of differences in voltage changes of signal electrodes is kept to a minimum. It thus becomes possible to limit distortions in voltages of scanning electrodes to a minimum, and to reduce unevenness in display.

TWELFTH EMBODIMENT

It is possible to incorporate the said liquid crystal display devices of the seventh to eleventh embodiments into electronic appliances which have display functions. For example, typical electronic equipment would be PCs, word processors, electronic memos, and work stations. If used as the display device for such equipment, the liquid crystal display device which is the subject of this invention makes possible high grade display with little display unevenness.

The foregoing has been an explanation of the embodiments of the invention. The embodiments are, of course, not limited only to those herein. For example, the explanation in the eighth embodiment dealt with the use of the invention in conjunction with forced inversion control, and in the ninth embodiment with the addition of limits to polarity inversion. Forced inversion control and limits to polarity inversion could also be used in conjunction with other embodiments.

THE EFFECT OF THE INVENTION

As explained in the foregoing, the use of the invention enables a reduction in power consumption and a concomitant reduction in display unevenness by means of a polarity inversion control circuit to control polarity inversion in response to the display pattern on a liquid crystal panel.

I claim:

1. A liquid crystal display device comprising:

a liquid crystal display panel having a plurality of pixels and comprising a liquid crystal layer sandwiched by a plurality of scanning electrodes and a plurality of signal electrodes, each of the plurality of pixels formed by an overlap between one of the plurality of scanning electrodes and one of the plurality of signal electrodes;

first voltage applying means for applying scanning voltages comprising a selection voltage and a non-selection voltage to said plurality of scanning electrodes of said liquid display panel;

second voltage applying means for applying signal voltages comprising an on-voltage and an off-voltage to said plurality of signal electrodes of said liquid crystal display panel;

polarity inversion control means, connected to said first voltage applying means and said second voltage applying means, for controlling a polarity inversion of a driving voltage, the driving voltage being a potential difference between each scanning electrode and a corresponding signal electrode, based on an on/off-status of each pixel corresponding to at least a current one and a prior one of the scanning electrodes of said liquid crystal display panel when said selection and non-selection voltages applied by said first voltage applying means are switched between said scanning electrodes;

wherein said liquid crystal display panel is driven by an AC driver.

2. A liquid crystal display device according to claim 1, wherein said plurality of scanning electrodes, said plurality of signal electrodes and said liquid crystal layer form a plurality of capacitors, and said polarity inversion control means determines a first amount of electric charge to move across the plurality of capacitors if said polarity of said driving voltage is inverted when said selection and non-selection voltages applied by said first voltage applying means to said scanning electrodes are switched between said scanning electrodes, and determines a second amount of electric charge to move across the plurality of capacitors if said polarity is not inverted when said selection and non-selection voltages applied by said first voltage applying means are switched between said scanning electrodes, said polarity inversion control means inverting said polarity of said driving voltage when said first amount of electric charge is smaller than said second amount of electric charge.

3. A liquid crystal device according to claim 2, wherein said polarity control means determines a number of said signal electrodes which are changed between the on-voltage and the off-voltage when said selection and non-selection voltages applied by said first voltage applying means are switched between said scanning electrodes, said polarity inversion control means determining whether said first amount of said electric charge is smaller than said second amount of electric charge by comparing said number of said signal electrodes to a given number.

4. A liquid crystal display device according to claim 3, wherein said given number is approximately one half a total number of said signal electrodes.

5. A liquid crystal display device according to claim 3, wherein said given number is more than one half a total number of said signal electrodes.

6. A liquid crystal display device according to claim 3, wherein said given number is determined based on capacitances formed by said pixels on the scanning electrodes between said scanning electrodes and said signal electrodes when said selection and non-selection voltages applied by said first voltage applying means are switched between said scanning electrodes.

7. A liquid crystal display device according to claim 3, wherein said given number is set based on a capacitance contained in a power supply circuit which generates said scanning voltages and said signal voltages.

8. A liquid crystal display device according to claim 2, wherein said polarity inversion control means comprises first control means for inverting a polarity of said driving voltage based on the on/off-status of at least a portion of said pixels of said liquid crystal display panel, and second control means for inverting the polarity of said driving voltage at given regular intervals independently of the on/off-status of said pixels of said liquid crystal display panel.

9. A liquid crystal display device according to claim 2, wherein said first and second voltage applying means apply voltages to said liquid crystal display panel according to an amplitude selective addressing scheme.

10. A liquid crystal display device according to claim 1, wherein said polarity inversion control means determines a total sum of a change in voltage of the signal electrodes, measured from said non-selection voltage, if a polarity of said driving voltage is inverted when said selection voltage applied by said first voltage applying means is switched between said scanning electrodes, and said polarity inversion control means determines a total sum of the change in voltage of the signal electrodes, measured from said non-selection voltage, if the polarity of said driving voltage is not inverted when said selection and non-selection voltages applied by said first voltage applying means are switched between said scanning electrodes, said polarity inversion control means inverting the polarity of said driving voltage when said total voltage charge when the polarity of said driving voltage is inverted is smaller than said total voltage charge when the polarity of said driving voltage is not inverted.

11. A liquid crystal display device according to claim 10, wherein said polarity inversion control means comprises first control means for inverting the polarity of said driving voltage based on the on/off-status of at least a portion of said pixels of said liquid crystal display panel, and second control means for inverting the polarity of said driving voltage at given regular intervals independently of the on/off-status of said pixels of said liquid crystal display panel.

12. A liquid crystal display device according to claim 10, wherein said polarity inversion control means limits a number of times of said polarity inversions.

13. A liquid crystal display device according to claim 10, wherein said polarity inversion control means changes a frequency of said polarity inversions based on a number of times when polarity inversion conditions are satisfied within a given period of time.

14. A liquid crystal display device according to claim 10, wherein said first and second voltage applying means apply voltages to said liquid crystal display panel according to an amplitude selective addressing scheme.

15. Electronic equipment using a liquid crystal display device comprising:

a liquid crystal display panel having a plurality of pixels and comprising a liquid crystal layer sandwiched by a plurality of scanning electrodes and a plurality of signal electrodes, each of the plurality of pixels formed by an overlap between one of the plurality of scanning electrodes and one of the plurality of signal electrodes;

first voltage applying means for applying scanning voltages comprising a selection voltage and a non-selection voltage to said plurality of scanning electrodes of said liquid crystal display panel;

second voltage applying means for applying signal voltages comprising an on-voltage and an off-voltage to said plurality of signal electrodes of said liquid crystal display panel; and polarity inversion control means, connected to said first voltage applying means and said second voltage applying means, for controlling a polarity inversion of a driving voltage, the driving voltage being a potential difference between each scanning electrode and a corresponding signal electrode, corresponding to an on/off-status of each pixel corresponding to at least a current one and a prior one of the scanning electrodes of said liquid crystal display panel when said selection and non-selection voltages applied by said first voltage applying means are switched between said scanning electrodes;

wherein said liquid crystal display panel displays images.

16. Electronic equipment using the liquid crystal display device according to claim 15, wherein said plurality of scanning electrodes, said plurality of signal electrodes and said liquid crystal layer form a plurality of capacitors, and said polarity inversion control means determines a first amount of electric charge to move across the plurality of capacitors if a polarity of said driving voltage is inverted when said selection voltage applied by said first voltage applying means is switched between the scanning electrodes, and determines a second amount of electric charge to move across the plurality of capacitors if the polarity of said driving voltage is not inverted when said selection and non-selection voltages applied by said first voltage applying means are switched between said scanning electrodes, said polarity inversion control means inverting the polarity of said driving voltage when said first amount of electric charge is smaller than said second amount of electric charge.

17. Electronic equipment using the liquid crystal display device according to claim 15, wherein said polarity inversion control means determines a total sum of a change in voltage of the signal electrodes, measured from said non-selection voltage, if a polarity of said driving voltage is inverted when said selection voltage applied by said first voltage applying means is switched between said scanning electrodes, and said polarity inversion control means determines a total sum of the change in voltage of the signal electrodes, measured from said non-selection voltage, if the polarity of said driving voltage is not inverted when said selection and non-selection voltages applied by said first voltage applying means are switched between said scanning electrodes, said polarity inversion control means inverting the polarity of said driving voltage when said total voltage change when the polarity of said driving voltage is inverted is smaller than said total voltage change when the polarity of said driving voltage is not inverted.

* * * * *